US012576331B2

(12) United States Patent
Zhang et al.

(10) Patent No.: US 12,576,331 B2
(45) Date of Patent: Mar. 17, 2026

(54) ROTATING ASSEMBLY AND JIGSAW PUZZLE TABLE

(71) Applicant: Meng Zhang, Shenzhen (CN)

(72) Inventors: Meng Zhang, Shenzhen (CN); Xiaoling Che, Dangyang (CN); Jinyan Duan, Shenzhen (CN)

(73) Assignee: Meng Zhang, Shenzhen (CN)

( * ) Notice: Subject to any disclaimer, the term of this patent is extended or adjusted under 35 U.S.C. 154(b) by 0 days.

(21) Appl. No.: 19/198,056

(22) Filed: May 4, 2025

(65) Prior Publication Data

US 2025/0262524 A1 Aug. 21, 2025

Related U.S. Application Data

(63) Continuation of application No. 18/817,289, filed on Aug. 28, 2024, now abandoned, which is a continuation of application No. 18/740,863, filed on Jun. 12, 2024, now Pat. No. 12,226,708, and a continuation-in-part of application No. 18/736,862, filed on Jun. 7, 2024, now Pat. No. 12,220,648, and a continuation of application No. 18/732,602, filed on Jun. 3, 2024, now Pat. No. 12,186,676, which is a continuation of application No. 18/541,685, filed on Dec. 15, 2023, now Pat. No. 12,042,740, saidapplication No. 18/736,862 is a continuation-in-part of application No. 18/541,685, filed on Dec. 15, 2023, now Pat. No. 12,042,740, and a continuation of application No. 18/235,896, filed on Aug. 21, 2023, now Pat. No. 12,048,885, and a continuation of (Continued)

(30) Foreign Application Priority Data

Sep. 26, 2021 (CN) ..... 202111131554.1
Sep. 26, 2021 (CN) ..... 202122334815.1
Jan. 28, 2022 (CN) ..... 202210103787.9
Oct. 28, 2022 (CN) ..... 202230717091.6
Jun. 13, 2023 (CN) ..... 202330364018.X
May 8, 2024 (CN) ..... 202420991164.4

(51) Int. Cl.
*A63F 9/10* (2006.01)

(52) U.S. Cl.
CPC ..... *A63F 9/1044* (2013.01); *A63F 2009/105* (2013.01)

(58) Field of Classification Search
CPC .. A63F 9/1044; A63F 2009/105; A47B 25/00; A47B 23/042
USPC ..... 108/5, 59, 10, 94, 22; 248/349.1
See application file for complete search history.

(56) References Cited

U.S. PATENT DOCUMENTS 129,870 A * 7/1872 Stahn ..... A47B 27/02 108/10
702,749 A * 6/1902 Smith ..... A47B 27/02 108/10

(Continued)

*Primary Examiner* — Jose V Chen

(57) ABSTRACT

A rotating assembly and a jigsaw puzzle table using the rotating assembly are disclosed in present disclosure. The jigsaw puzzle table includes a board portion comprising a bottom surface, at least two puzzle drawers, a reinforcing arm connected to the bottom surface of the board portion, a first pivoting arm connected to the bottom surface of the board portion, a supporting shaft located below the board portion and spaced apart from the first pivoting arm; and at least one rotating connection component connecting the first pivoting arm and the supporting shaft. The rotating connection component is configured to enable the board portion to switch between a flat position and a tilted position. The board portion is capable of being rotated through a rotational movement of the rotating assembly.

19 Claims, 61 Drawing Sheets

Related U.S. Application Data application No. 18/235,416, filed on Aug. 18, 2023, now Pat. No. 12,059,631, said application No. 18/817,289 is a continuation of application No. 18/222,990, filed on Jul. 17, 2023, now abandoned, which is a continuation-in-part of application No. 29/859,220, filed on Nov. 8, 2022, now Pat. No. Des. 1,004,709, said application No. 18/235,416 is a continuation-in-part of application No. 17/829,359, filed on Jun. 1, 2022, now Pat. No. 12,104,744, said application No. 18/736,862 is a continuation-in-part of application No. 17/829,359, filed on Jun. 1, 2022, now Pat. No. 12,104,744, said application No. 18/235,896 is a continuation-in-part of application No. 17/829,359, filed on Jun. 1, 2022, now Pat. No. 12,104,744, said application No. 18/817,289 is a continuation of application No. 17/829,359, filed on Jun. 1, 2022, now Pat. No. 12,104,744, said application No. 18/222,990 is a continuation-in-part of application No. 17/720,682, filed on Apr. 14, 2022, now abandoned, and a continuation-in-part of application No. 29/824,951, filed on Jan. 28, 2022, now Pat. No. Des. 1,009,177, and a continuation-in-part of application No. 29/818,457, filed on Dec. 9, 2021, now Pat. No. Des. 1,029,113, said application No. 18/235,896 is a continuation-in-part of application No. 17/505,587, filed on Oct. 19, 2021, now Pat. No. 11,890,551, said application No. 18/235,416 is a continuation-in-part of application No. 17/505,587, filed on Oct. 19, 2021, now Pat. No. 11,890,551, said application No. 18/541,685 is a continuation of application No. 17/505,587, filed on Oct. 19, 2021, now Pat. No. 11,890,551.

(56) References Cited

U.S. PATENT DOCUMENTS 922,565 A * 5/1909 Cole ..... A47B 27/00 211/12
1,203,659 A * 11/1916 Smith ..... A47B 23/043 248/456
2,708,808 A * 5/1955 Simpson ..... A47B 19/06 312/316
3,026,158 A * 3/1962 Freeman ..... A47B 5/04 108/134
3,123,935 A * 3/1964 Williams ..... A47B 13/16 248/500
3,125,971 A * 3/1964 Wetherill ..... A47B 25/00 108/125
3,682,109 A * 8/1972 Gordon ..... A47B 13/081 108/9
3,773,154 A * 11/1973 Mitchell ..... A47B 23/043 248/455
D249,532 S * 9/1978 Cudahy, III ..... D19/113
4,312,507 A * 1/1982 Smith ..... A63F 3/0023 273/287
4,865,325 A * 9/1989 Stolz ..... A63F 9/1044 273/157 R
5,529,173 A * 6/1996 Salacuse ..... B65D 75/22 206/315.1
D400,600 S * 11/1998 Ackerman ..... D21/478
6,045,108 A * 4/2000 Cziraky ..... A45C 9/00 248/461
7,073,449 B2 * 7/2006 Pipkin ..... B64D 11/0638 108/9
7,552,821 B1 * 6/2009 Demers ..... A63F 9/1044 206/499
8,322,290 B1 * 12/2012 Mignano ..... A47B 23/043 248/456
8,910,838 B2 * 12/2014 Palmer ..... A47B 23/002 108/43
9,044,688 B1 * 6/2015 Janay ..... B65D 25/22
9,468,290 B2 * 10/2016 Roth ..... A47B 19/06
11,388,990 B1 7/2022 Watkins
D977,025 S * 1/2023 Fan ..... D21/480
12,226,708 B2 * 2/2025 Che ..... A63F 9/10
2011/0056412 A1 * 3/2011 Grammer ..... A45C 9/00 108/1
2021/0170268 A1 * 6/2021 Malki ..... A63F 9/1044
2023/0097737 A1 * 3/2023 Che ..... A47B 83/045 108/1

* cited by examiner

ROTATING ASSEMBLY AND JIGSAW PUZZLE TABLE

CROSS-REFERENCE TO RELATED APPLICATIONS

This application is a continuation of U.S. patent application Ser. No. 18/817,289, filed on Aug. 28, 2024, which is a continuation-in-part of U.S. patent application Ser. No. 18/736,862, filed on Jun. 7, 2024, and U.S. Pat. No. 12,220,648; a continuation-in-part of U.S. patent application Ser. No. 17/829,359, filed on Jun. 1, 2022, and U.S. Pat. No. 12,104,744; a continuation of U.S. patent application Ser. No. 18/732,602, filed on Jun. 3, 2024, and U.S. Pat. No. 12,186,676; a continuation of U.S. patent application Ser. No. 18/222,990, filed on Jul. 17, 2023; a continuation of U.S. patent application Ser. No. 18/740,863, filed on Jun. 12, 2024, and U.S. Pat. No. 12,226,708; and claims the foreign priority of Chinese Patent Application No. 202420991164.4, filed on May 8, 2024, the contents of which are incorporated herein in their entireties.

U.S. patent application Ser. No. 18/736,862 is a continuation of U.S. patent application Ser. No. 18/235,896, filed on Aug. 21, 2023, and U.S. Pat. No. 12,048,885; a continuation of U.S. patent application Ser. No. 18/235,416, filed on Aug. 18, 2023, and U.S. Pat. No. 12,059,631; a continuation-in-part of U.S. patent application Ser. No. 18/541,685, filed on Dec. 15, 2023, and U.S. Pat. No. 12,042,740; and a continuation-in-part of U.S. patent application Ser. No. 17/829,359, filed on Jun. 1, 2022, and U.S. Pat. No. 12,104,744. U.S. patent application Ser. No. 18/235,416 is a continuation-in-part of U.S. patent application Ser. No. 17/505,587, filed on Oct. 19, 2021, and U.S. Pat. No. 11,890,551, and a continuation-in-part of U.S. patent application Ser. No. 17/829,359. U.S. patent application Ser. No. 18/235,896 is a continuation-in-part of U.S. patent application Ser. No. 17/505,587 and a continuation-in-part of U.S. patent application Ser. No. 17/829,359. U.S. patent application Ser. No. 18/541,685 is a continuation of U.S. patent application Ser. No. 17/505,587. Through U.S. patent application Ser. No. 17/505,587, this application claims priority to Chinese Patent Application No. 202111131554.1, filed on Sep. 26, 2021, and Chinese Patent Application No. 202122334815.1, filed on Sep. 26, 2022. Through U.S. patent application Ser. No. 18/235,896, this application claims priority to Chinese Patent Application No. 202330364018.X, filed on Jun. 13, 2023.

The U.S. patent application Ser. No. 18/732,602 is a continuation of U.S. patent application Ser. No. 18/541,685.

U.S. patent application Ser. No. 18/222,990 is a continuation-in-part of U.S. patent application Ser. No. 17/720,682, filed on Apr. 14, 2022, which claims priority to Chinese Patent Application No. 202210103787.9, filed on Jan. 28, 2022. U.S. patent application Ser. No. 18/222,990 is a continuation-in-part of U.S. patent application Ser. No. 29/824,951, filed on Jan. 28, 2022. U.S. patent application Ser. No. 18/222,990 is a continuation-in-part of U.S. patent application Ser. No. 29/818,457, filed on Dec. 9, 2021. U.S. patent application Ser. No. 18/222,990 is a continuation-in-part of U.S. patent application Ser. No. 29/859,220, filed on Nov. 8, 2022, which claims priority to Chinese Patent Application No. 202230717091.6, filed on Oct. 28, 2022.

All of the above-identified applications are hereby incorporated by reference herein in their entireties and made a part of this specification.

TECHNICAL FIELD

The present disclosure relates to the field of puzzle game accessories, and in particular to a jigsaw puzzle table with a rotating assembly, wherein the jigsaw puzzle table is movable with respect to one or more players through the rotating assembly for allowing the player to move the jigsaw puzzle table for assembling the puzzle pieces thereon at different planar directions, such that the player does not need to physically travel from side to side of the jigsaw puzzle table

BACKGROUND

The jigsaw puzzle, as a puzzle game, is essential in intellectual development for children. Due to the jigsaw puzzle being interesting, the jigsaw puzzle is also popular among adults. When playing the jigsaw puzzle, a user needs to carefully identify puzzle pieces to find similarities between the puzzle pieces to splice the puzzle pieces together. In order to enable the user to splice the puzzle pieces, the jigsaw puzzle table is released to the market. However, the jigsaw puzzle table in the art has a fixed height, and the height cannot be adjusted according to a height of the user. Therefore, the user whose height does not match the height of the jigsaw puzzle table may not use the jigsaw puzzle table comfortably, having a poor usage experience.

When a user challenges a larger scale jigsaw puzzle, it is necessary to prepare a jigsaw puzzle table with sufficient bearing area. However, the arm length of the user is often insufficient to reach the entire game area, and the viewing angle range of the user is not enough to pay attention to the entire game area. As a result, the user often needs to move the position of the puzzle during the game process.

A need exists for a tool that retains all the unfinished pieces and while allowing the player to conveniently player the puzzle. It is to the provision of such a tool that the present disclosure is primarily directed.

SUMMARY OF THE DISCLOSURE

The invention is advantageous in that it provides a movable puzzle platform with a rotating assembly, wherein the puzzle platform is movable for allowing a player to conveniently play the puzzles.

In one aspect, the present disclosure provides a jigsaw puzzle table, comprising: a puzzle board, a rotating assembly comprising a first moving member and a second moving member rotatably coupled to the first moving member and attached to the puzzle board for driving the puzzle board to rotate relative to the first moving member, and a supporting assembly coupled with the first moving member of the rotating assembly for supporting the puzzle board and the rotating assembly. The puzzle board is capable of being rotated on the supporting assembly through a rotational movement of the rotating assembly.

In another aspect, the present disclosure provides a rotating assembly comprises a first moving member comprising a first moving frame, a first rolling portion extending from the periphery of the first moving frame, and a first coupling unit extending from the first rolling portion away from the first moving frame, a second moving member comprising a second moving frame, a second rolling portion extending from the periphery of the second moving frame, and a second coupling unit extending from the second rolling portion away from the second moving frame, and a plurality of rotors rotatably retained between the first moving member and the second moving member. The first rolling portion is symmetrically positioned with respect to the second rolling portion, and each of the plurality of rotors is free to roll on both the first rolling portion of the first moving member and the second rolling portion of the second moving member.

Still further objects and advantages will become apparent from a consideration of the ensuing description and drawings. These and other objectives, features, and advantages of the present disclosure will become apparent from the following detailed description, the accompanying drawings, and the appended claims.

DETAILED DESCRIPTION

Figure 1:
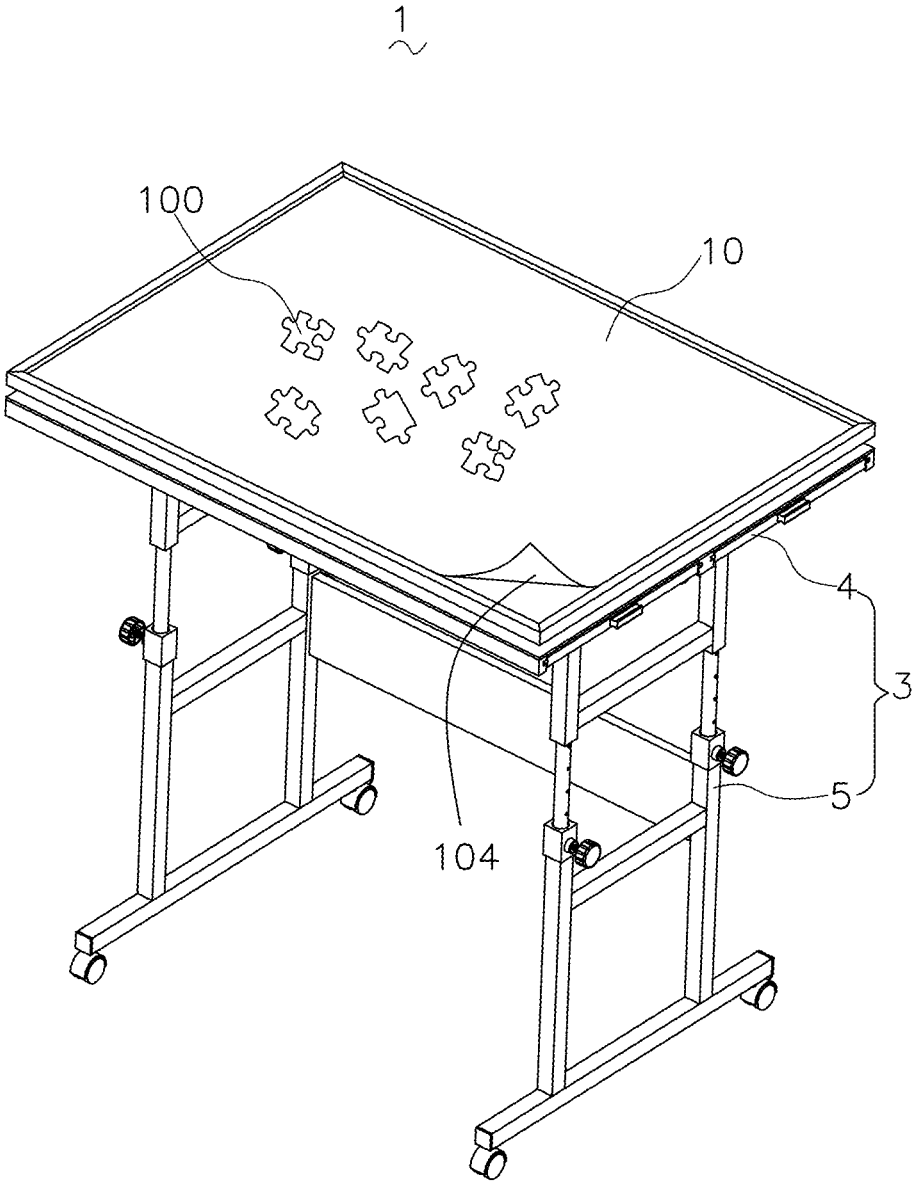
FIG. 1 is an illustrative isometric view of a jigsaw puzzle table according to a first embodiment of the present disclosure.
Figure 2:
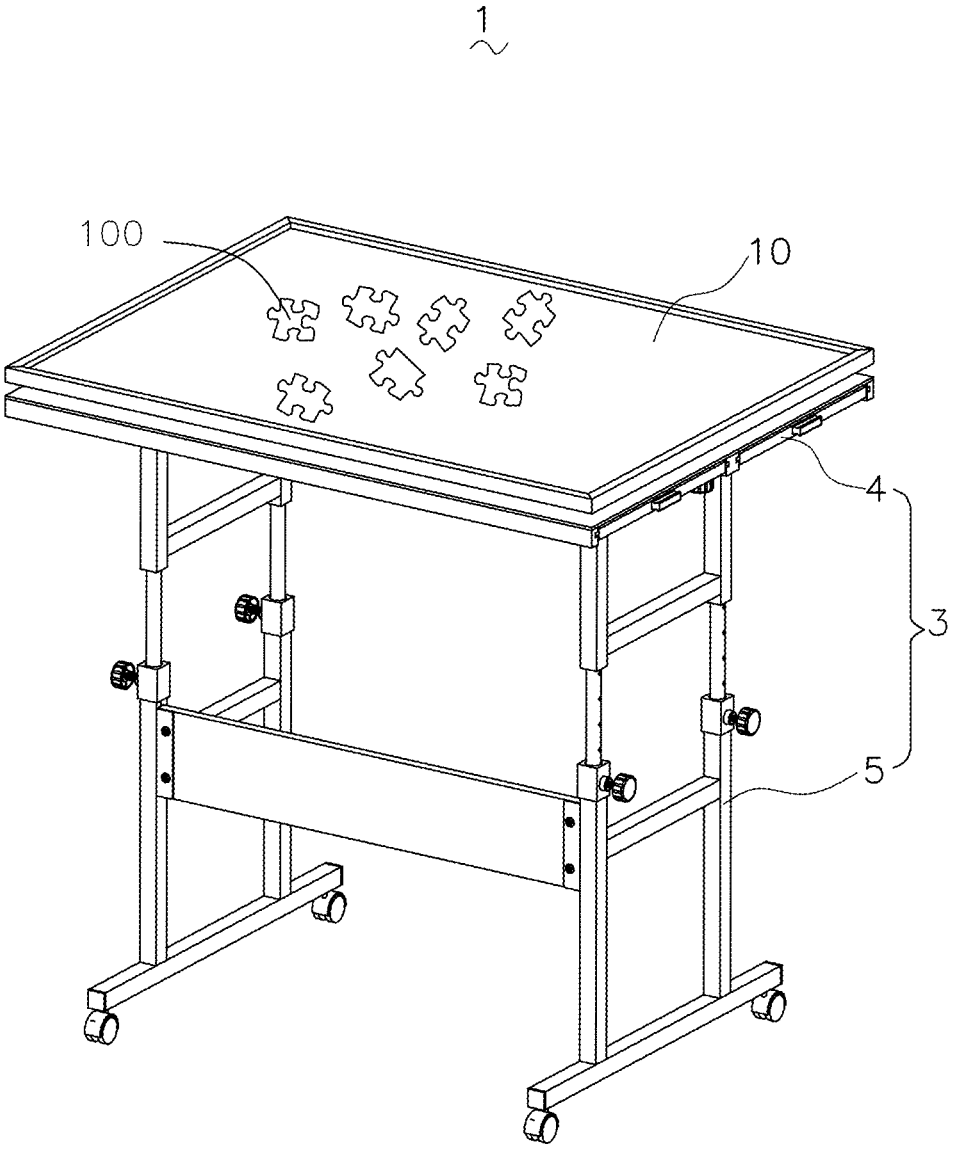
FIG. 2 is an illustrative isometric view of the jigsaw puzzle table shown in FIG. 1, but from another aspect.
Figure 3:
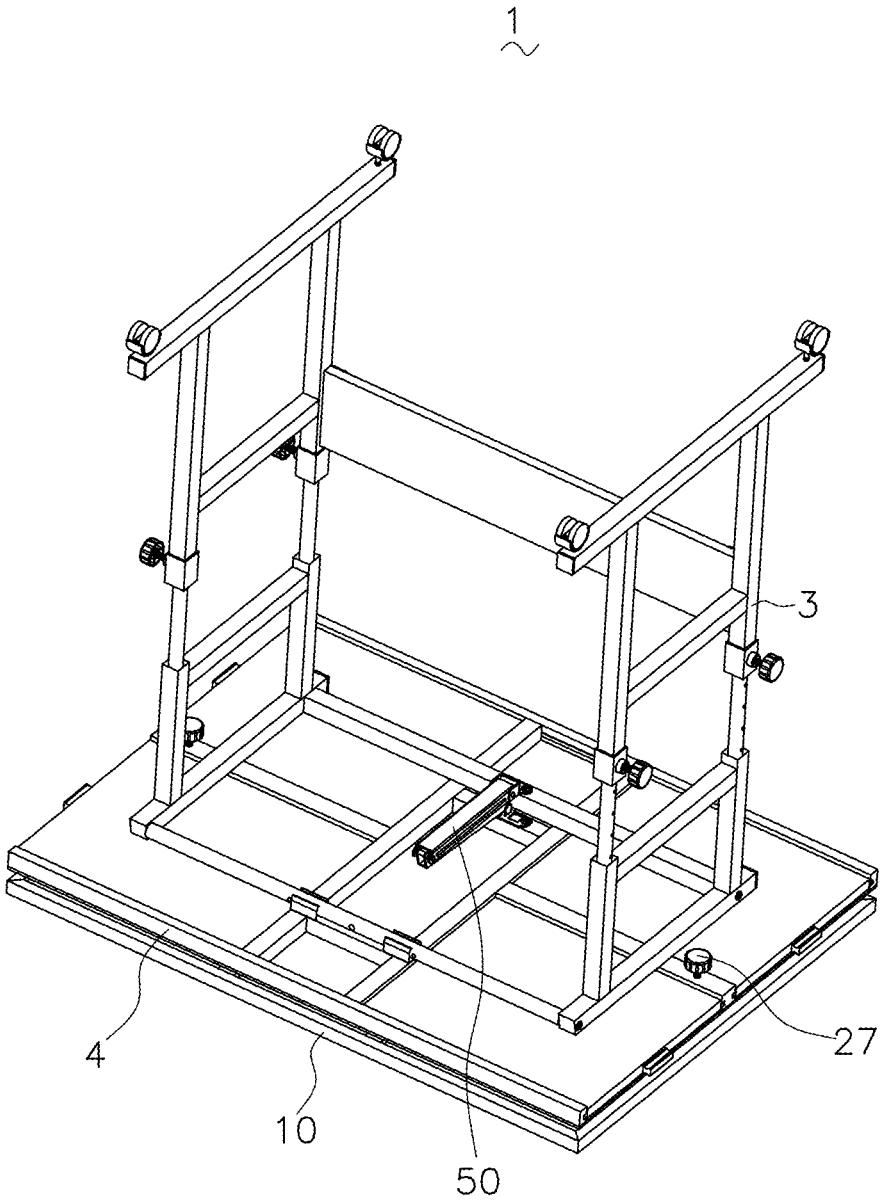
FIG. 3 is an illustrative isometric view of a jigsaw puzzle table according to an embodiment of the present disclosure, this time viewed from a third angle.
Figure 4:
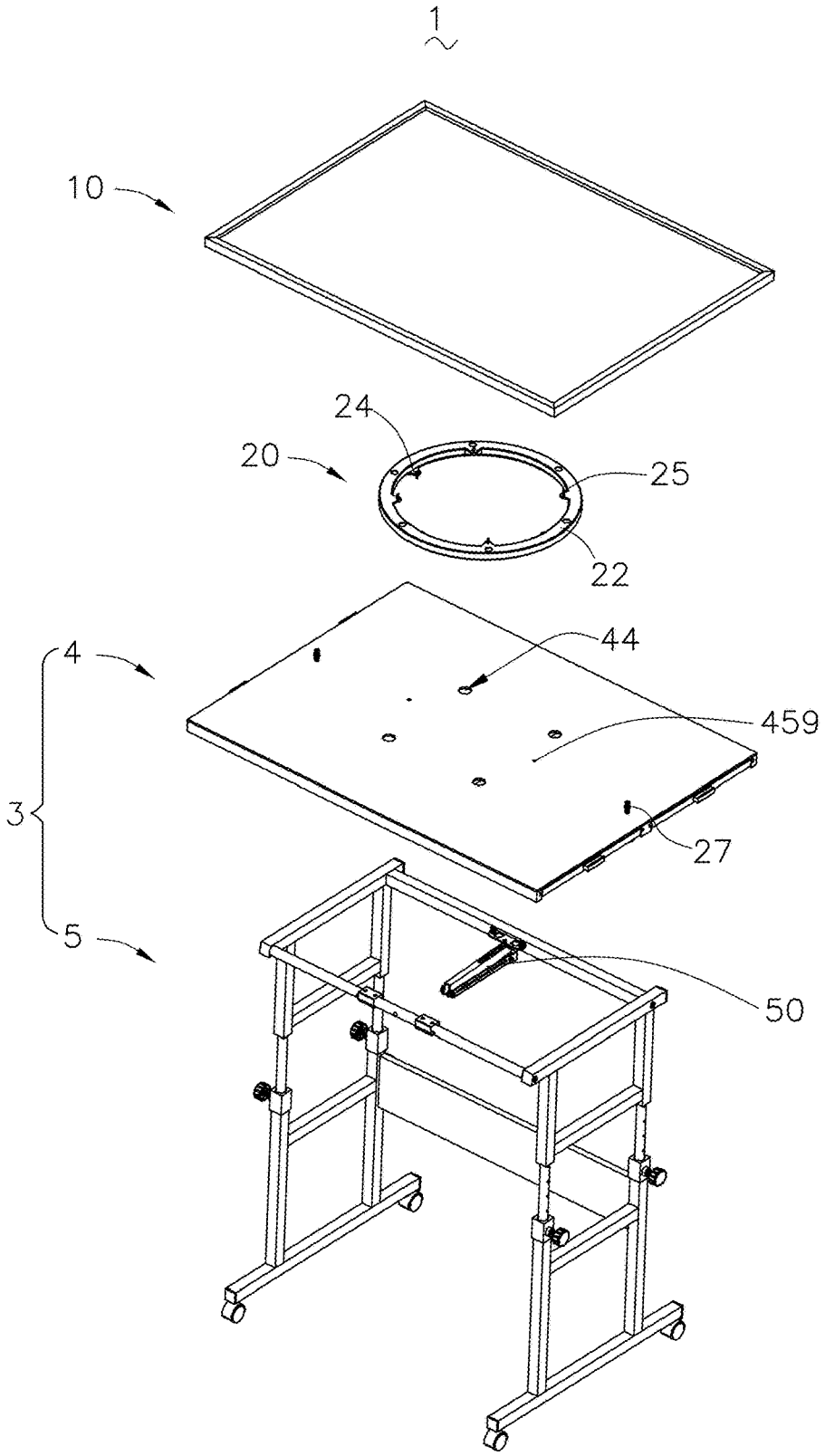
FIG. 4 is a partial exploded perspective view of the jigsaw puzzle table shown in FIG. 1.
Figure 5:
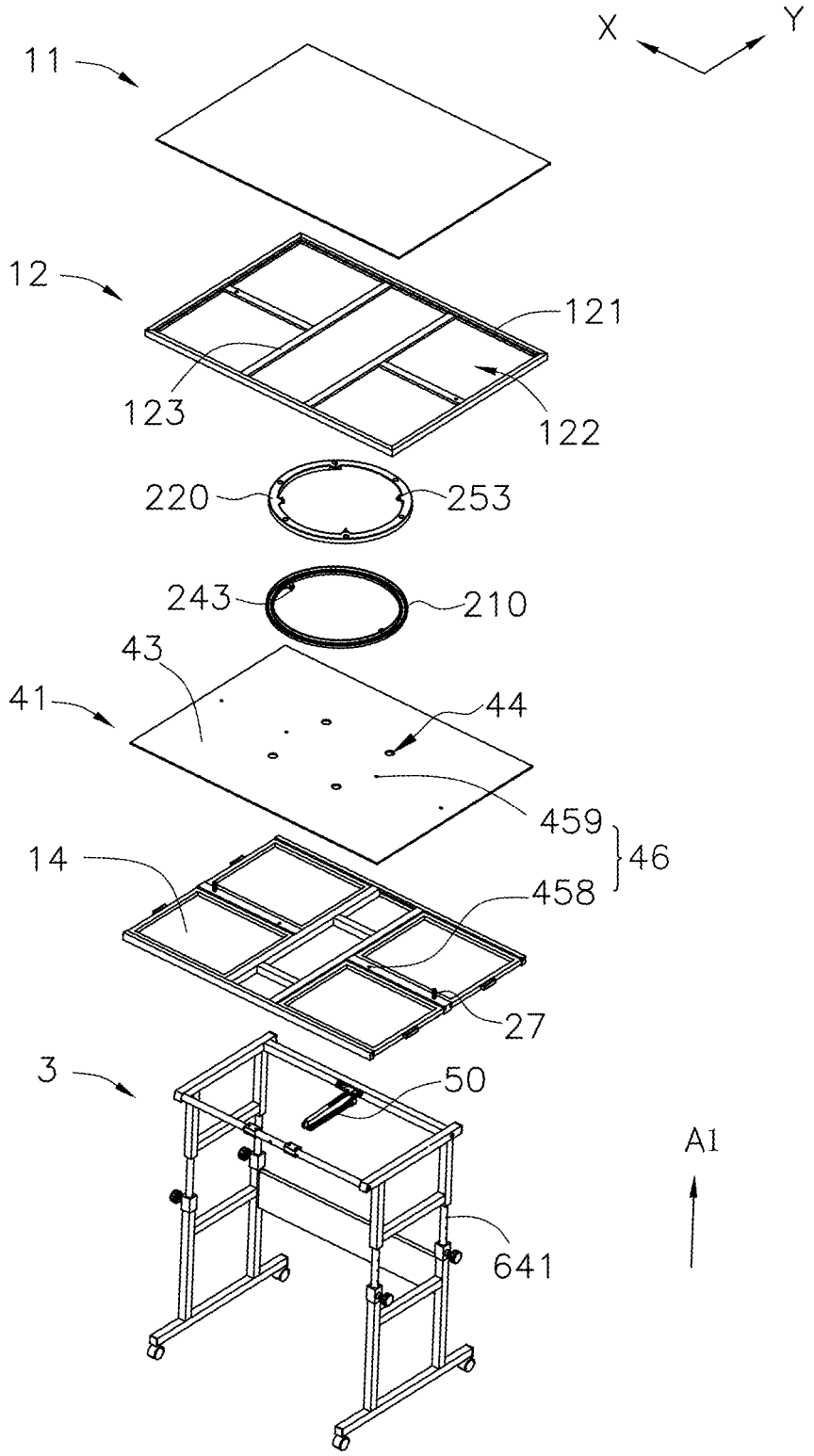
FIG. 5 is a partial exploded perspective view of the jigsaw puzzle table shown in FIG. 4.
Figure 6:
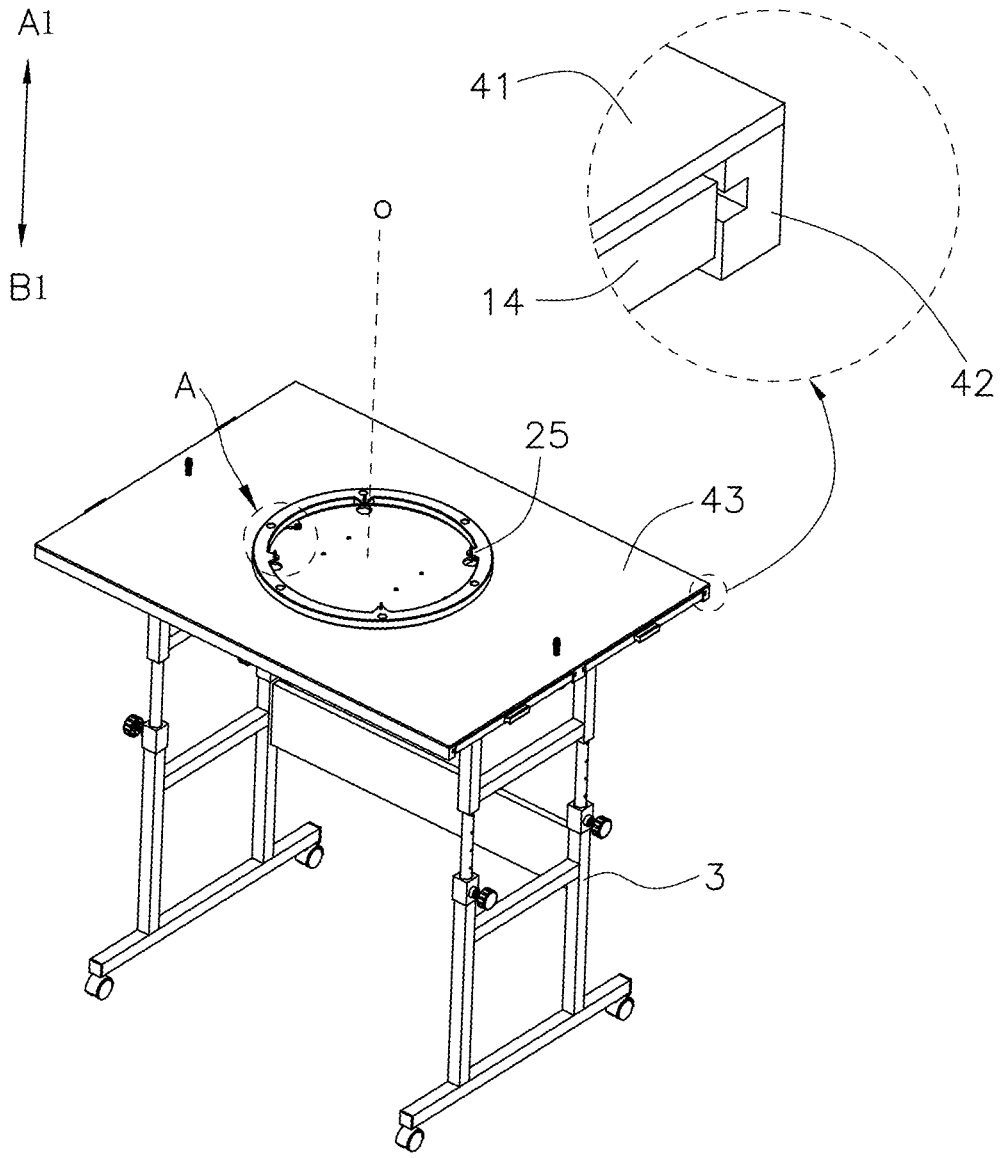
FIG. 6 is an illustrative isometric view of a rotating assembly and a supporting assembly of the jigsaw puzzle table shown in FIG. 1.
Figure 7:
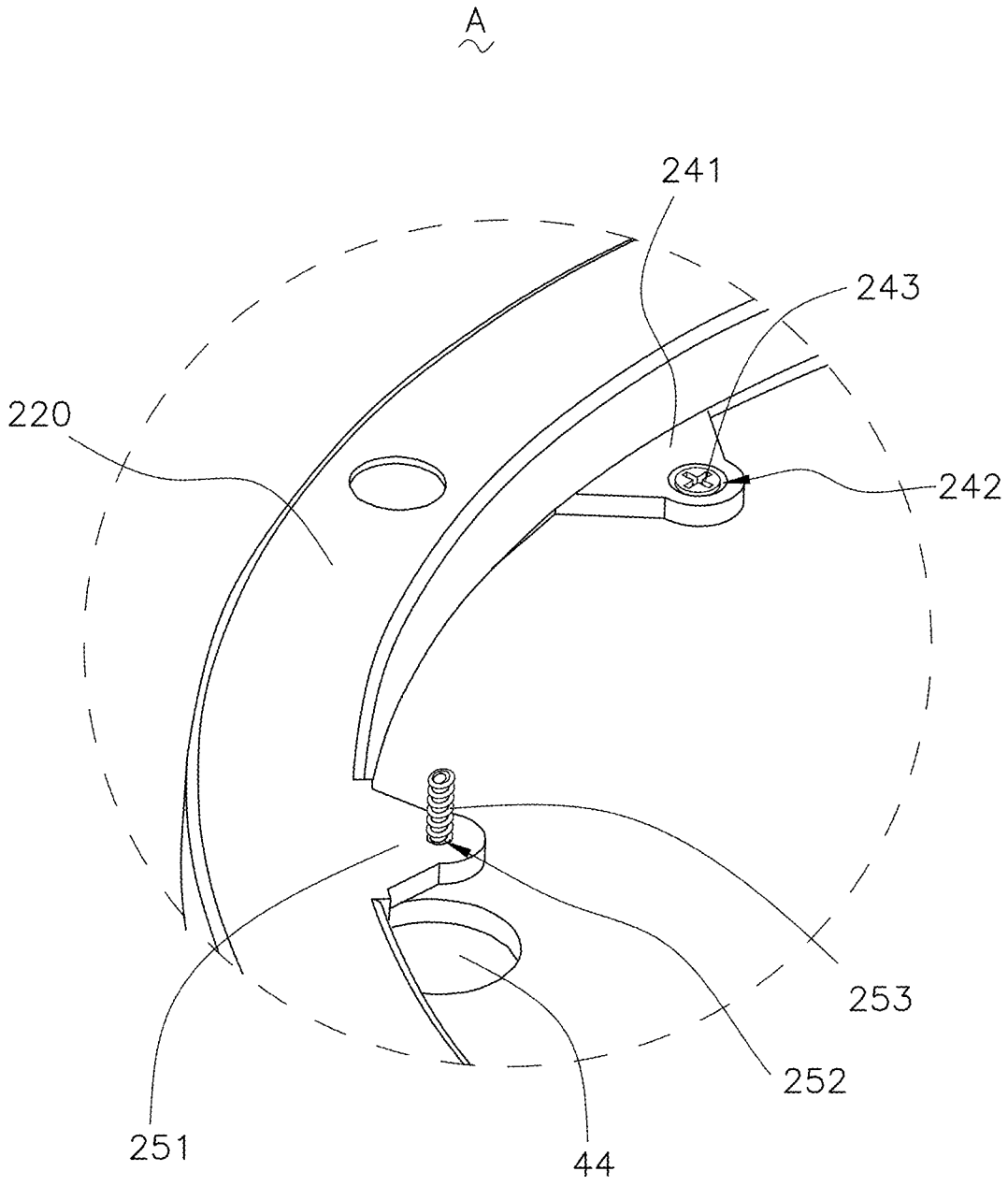
FIG. 7 is an enlarged view of Part A in FIG. 6.
Figure 8:
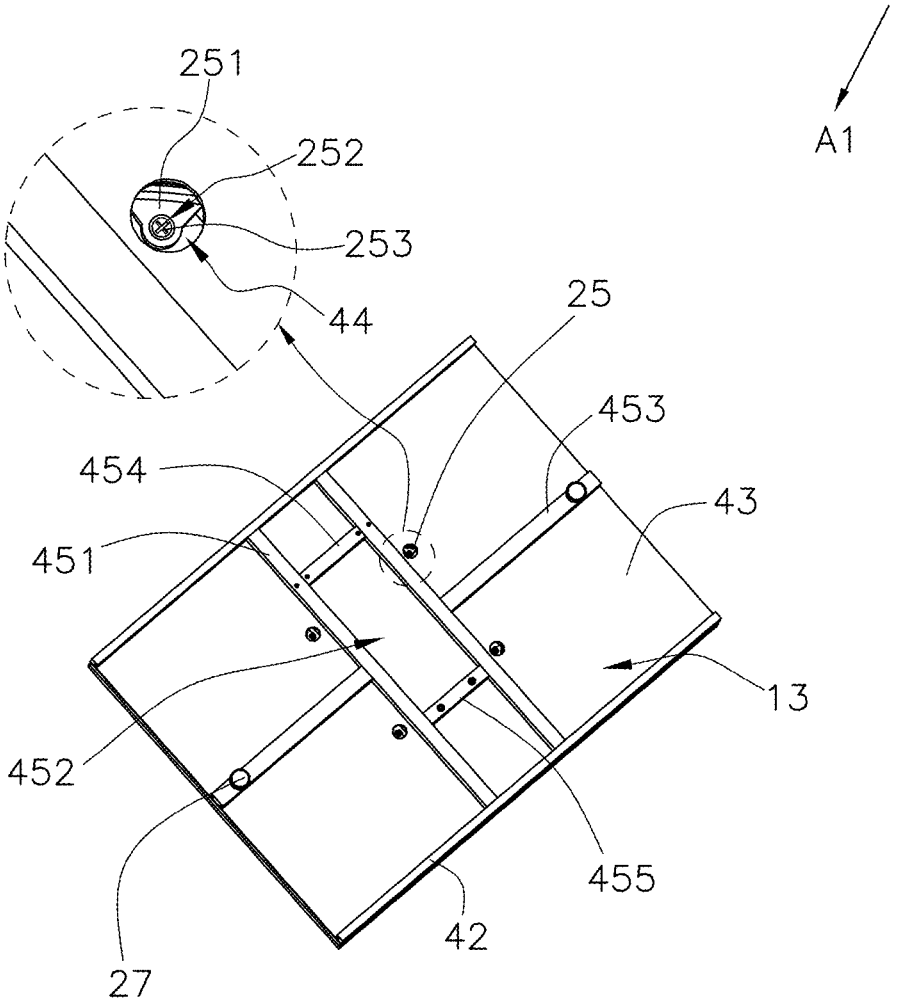
FIG. 8 is an illustrative isometric view of the rotating assembly and a puzzle board of the jigsaw puzzle table shown in FIG. 1.
Figure 9:
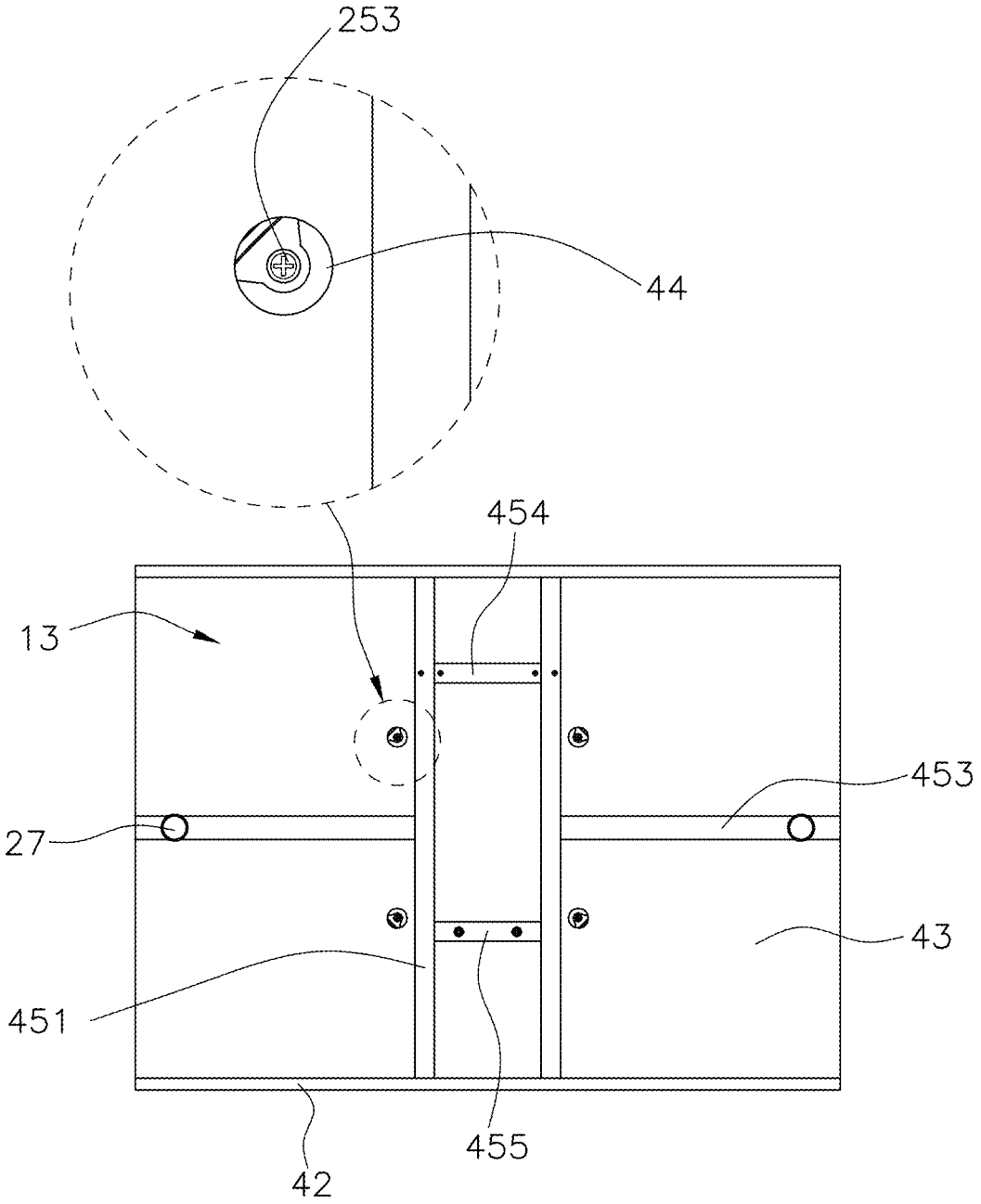
FIG. 9 is a bottom view of the rotating assembly and the puzzle board of the jigsaw puzzle table shown in FIG. 1.
Figure 10:
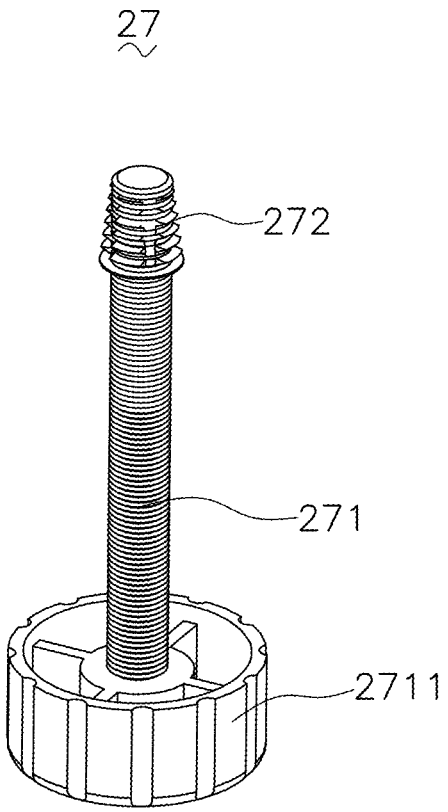
FIG. 10 is an illustrative isometric view of a rotating locking assembly of the jigsaw puzzle table shown in FIG. 1.
Figure 11:
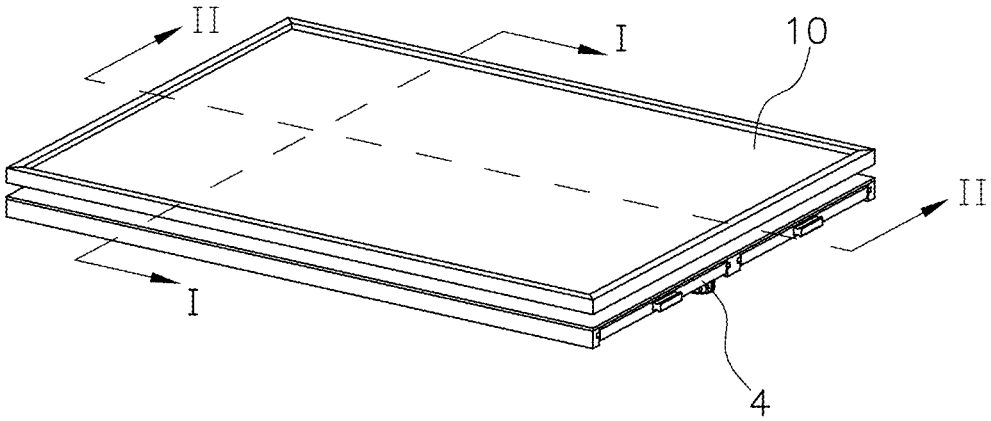
FIG. 11 is an illustrative isometric view of the puzzle board and the rotating assembly of the jigsaw puzzle table shown in FIG. 1.
Figure 12:
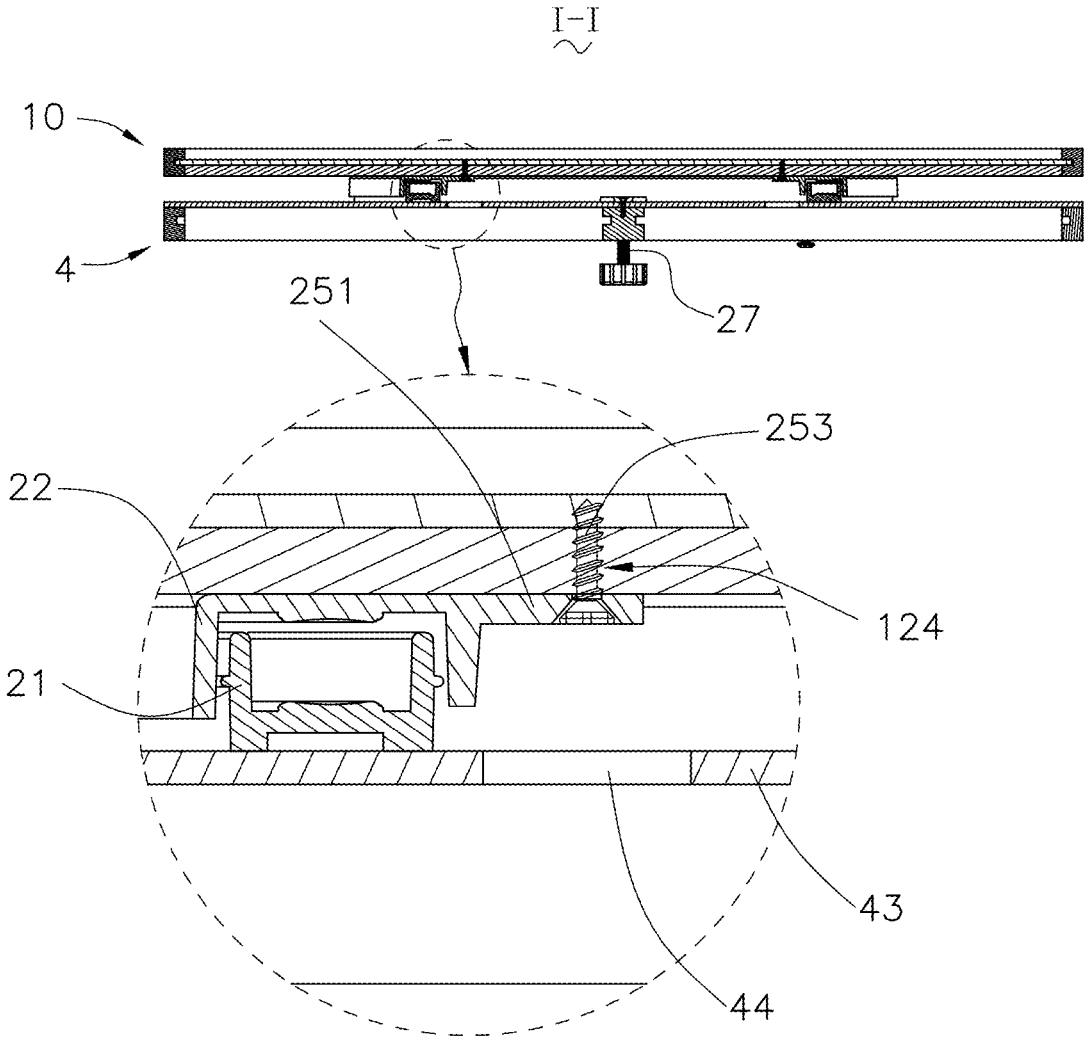
FIG. 12 is an illustrative cross-sectional view of the puzzle board and the rotating assembly of the jigsaw puzzle table taken along line I-I of FIG. 11.
Figure 13:
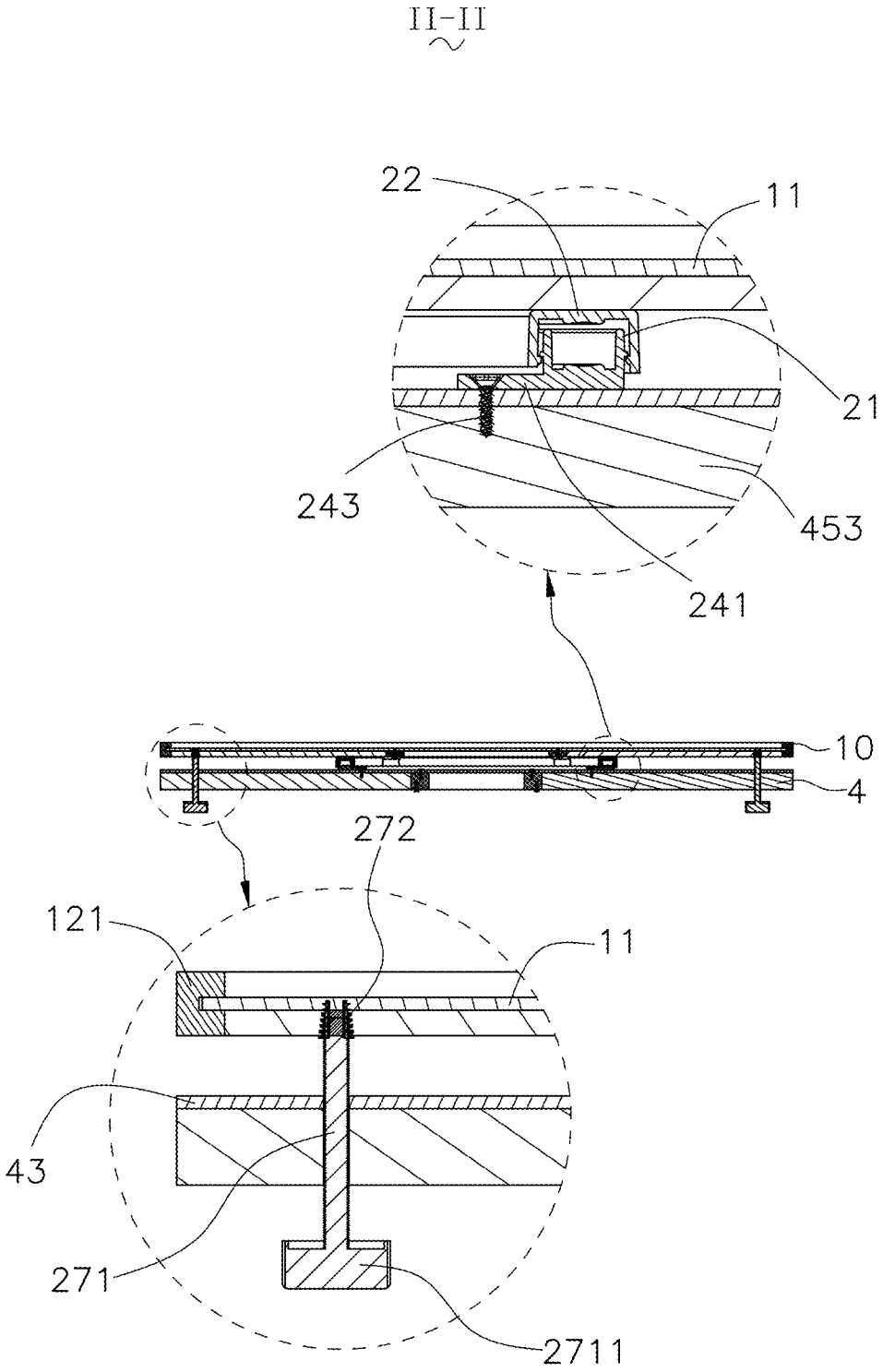
FIG. 13 is an illustrative cross-sectional view of the puzzle board and the rotating assembly of the jigsaw puzzle table taken along line II-II of FIG. 11.
Figure 14:
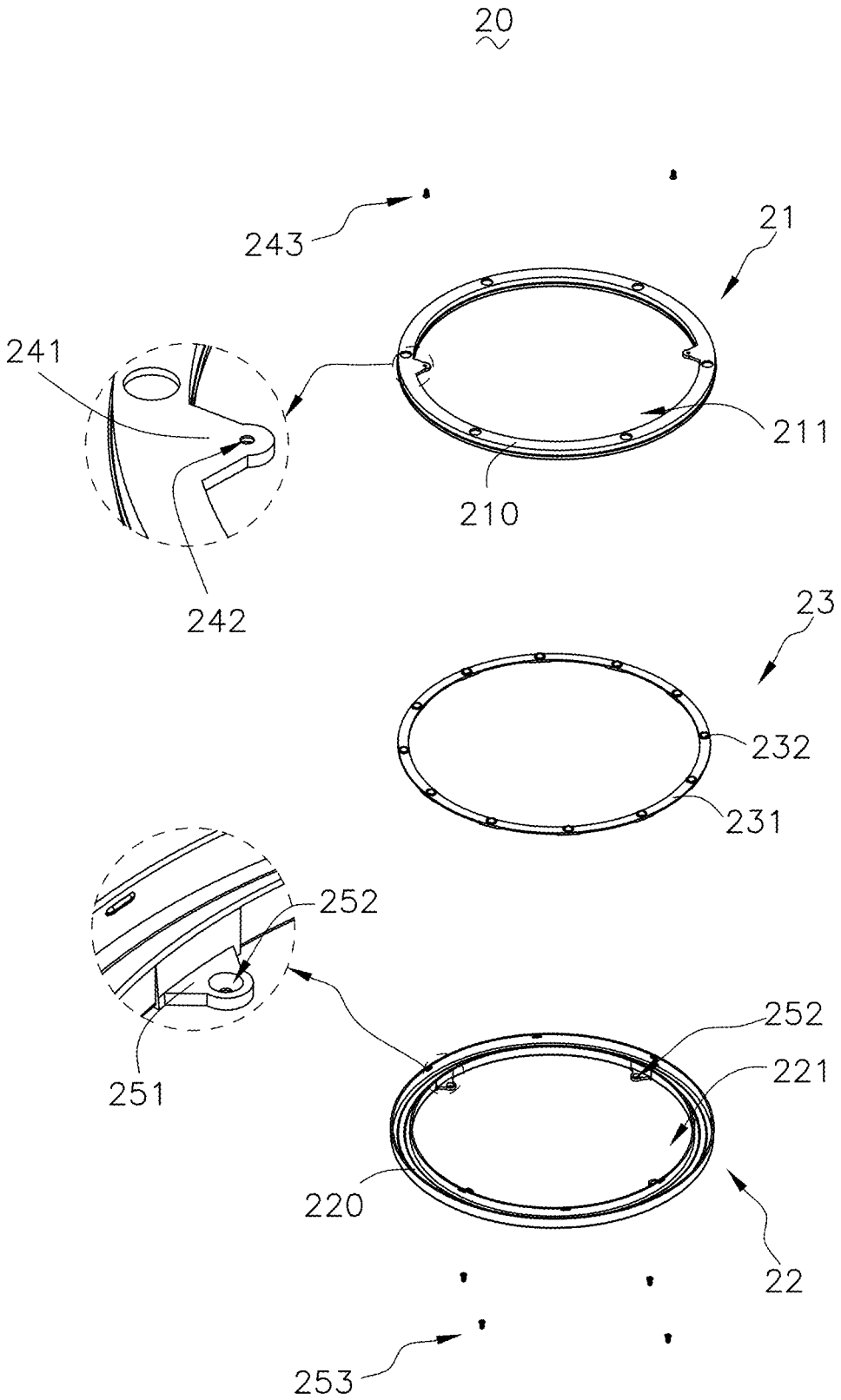
FIG. 14 is an exploded perspective view of the rotating assembly of the jigsaw puzzle table shown in FIG. 1.
Figure 15:
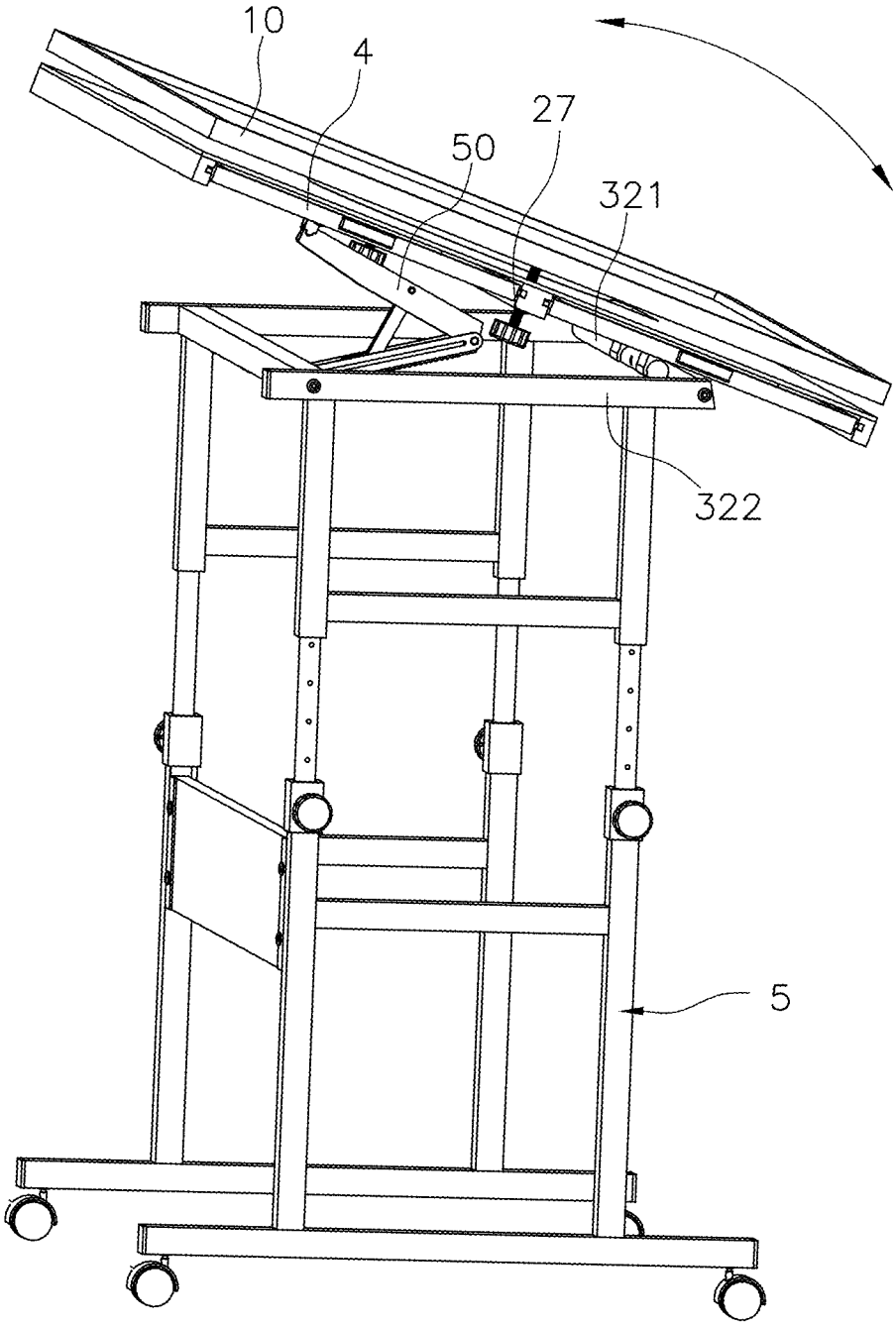
FIG. 15 is an illustrative isometric view of the jigsaw puzzle table of FIG. 1, illustrating the puzzle board tilted at a certain angle and in a locked state.
Figure 16:
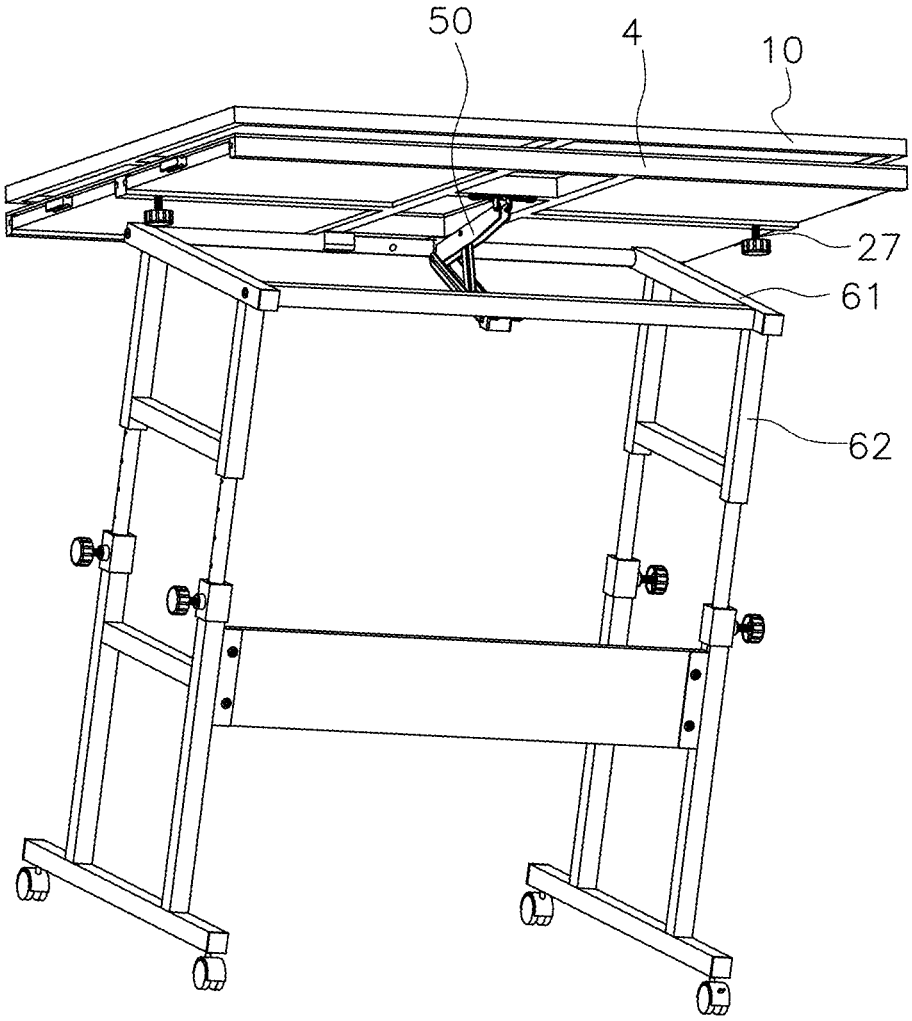
FIG. 16 is similar to FIG. 20, but from another aspect.
Figure 17:
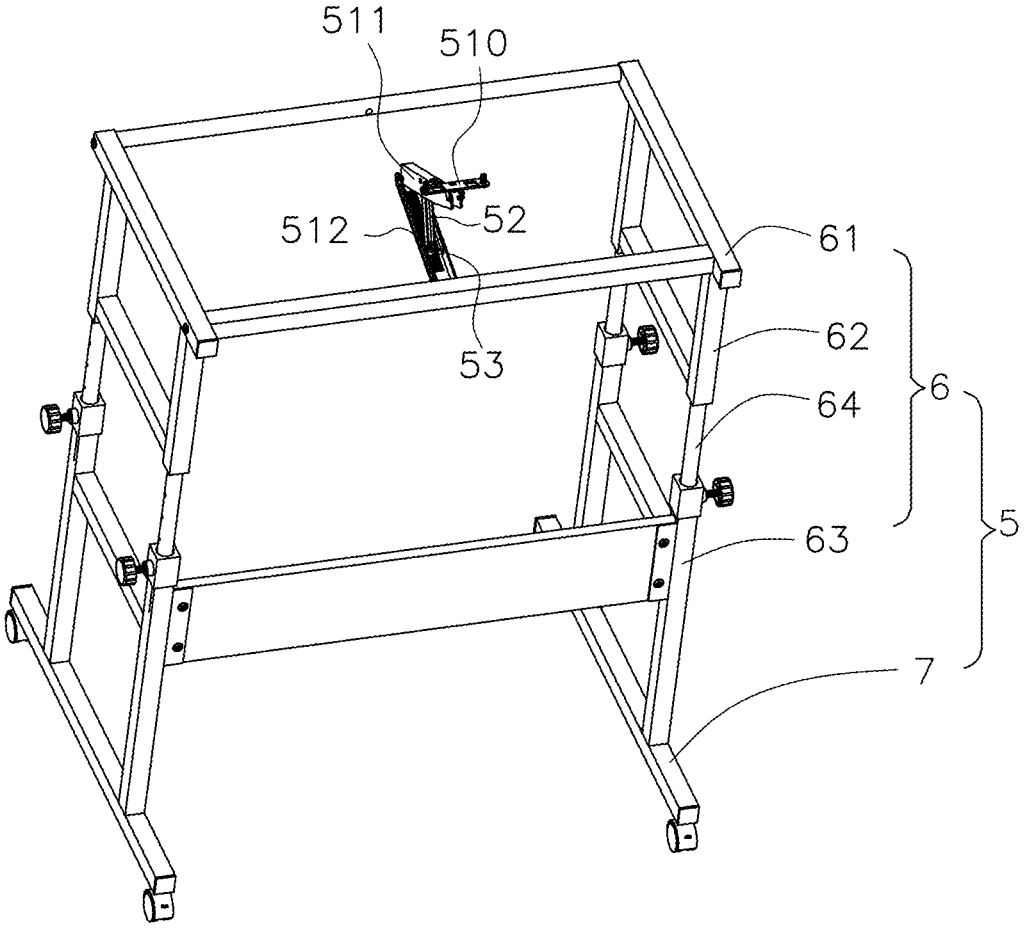
FIG. 17 is an illustrative isometric view of an adjusting structure and a mounting board of the jigsaw puzzle table shown in FIG. 1.
Figure 18:
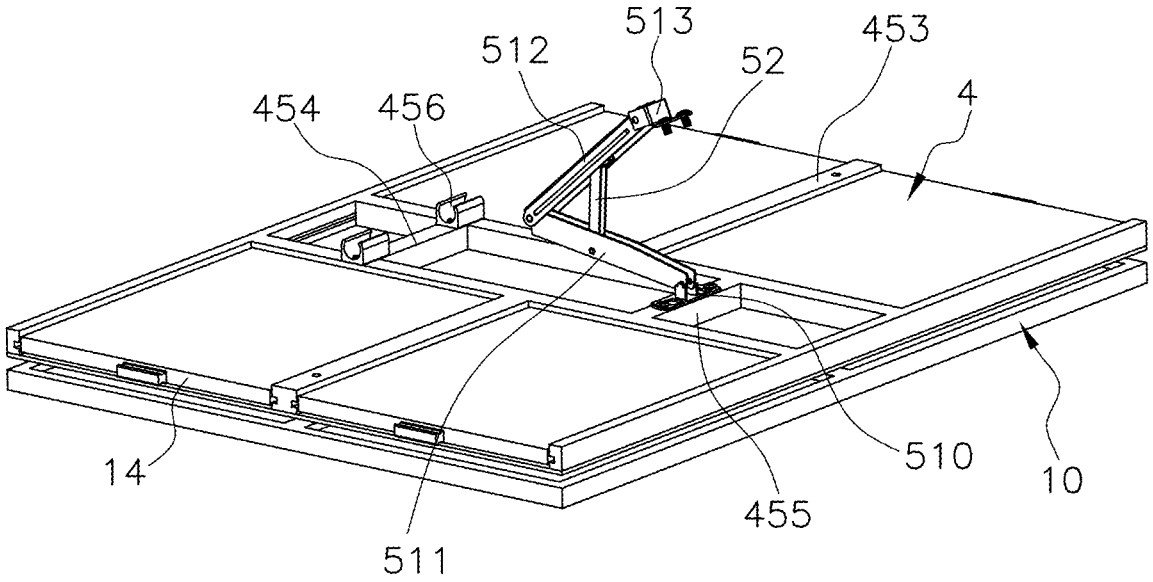
FIG. 18 is an illustrative isometric view of the adjusting structure, the supporting board and the puzzle board of the jigsaw puzzle table shown in FIG. 1, illustrating the adjusting structure in the locked state.
Figure 19:
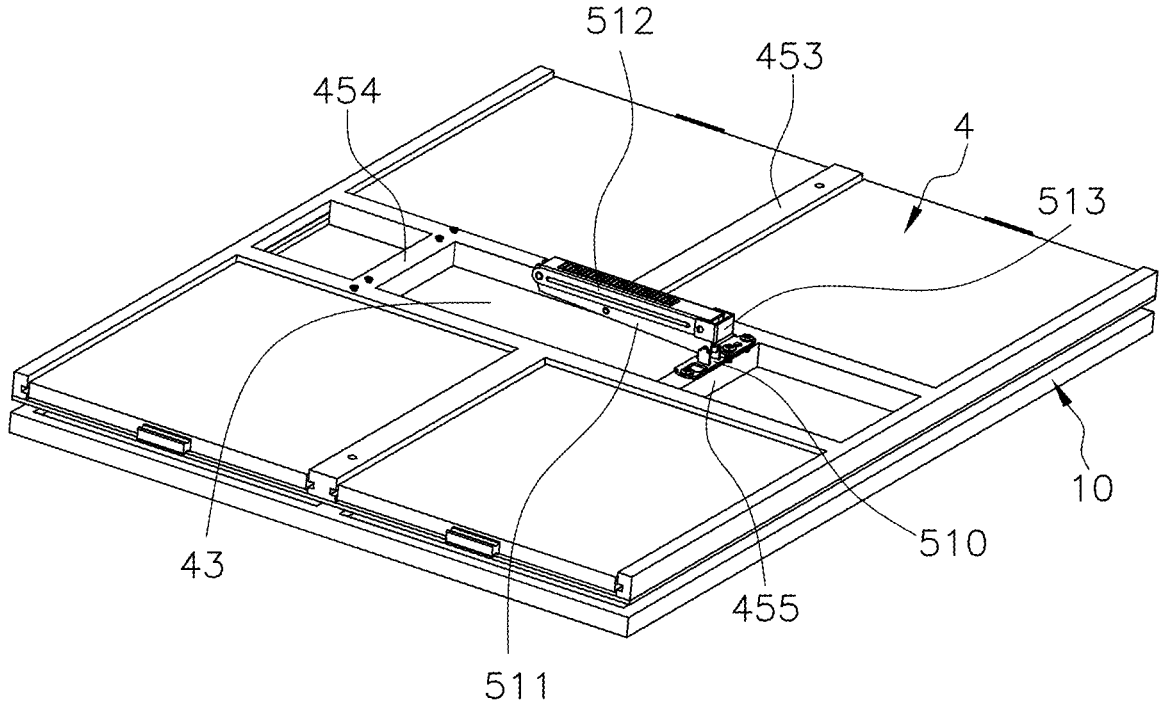
FIG. 19 is an illustrative isometric view of the adjusting structure, the supporting board and the puzzle board of the jigsaw puzzle table shown in FIG. 1, illustrating the adjusting structure in a closed state.
Figure 20:
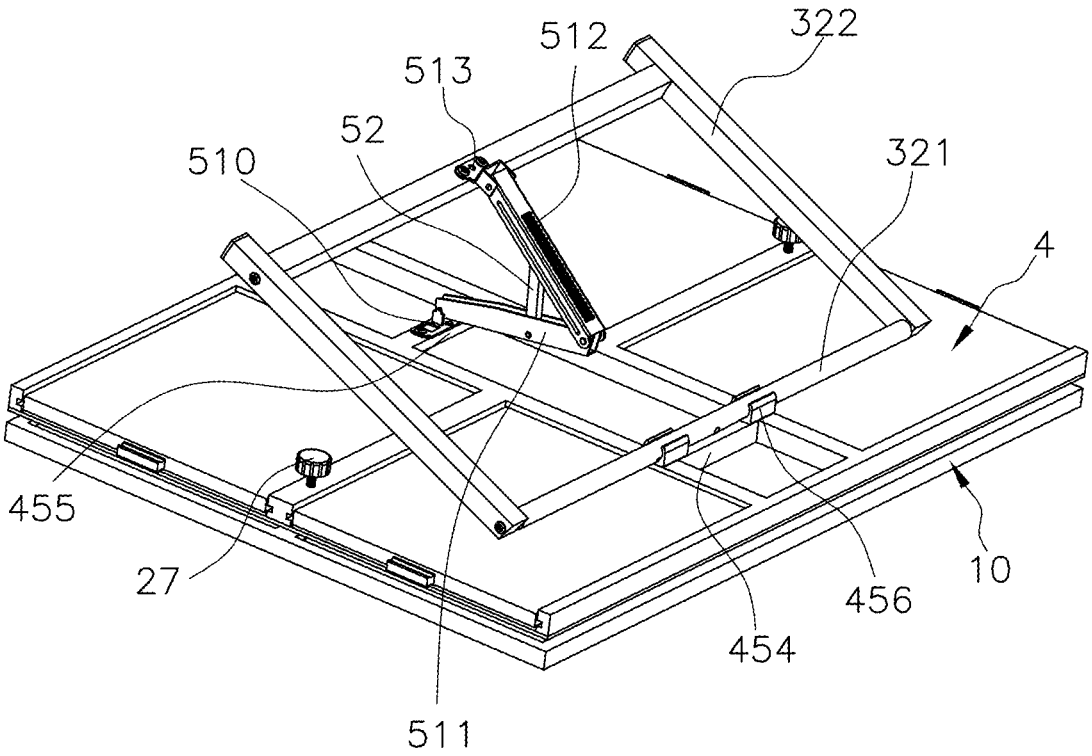
FIG. 20 is an illustrative isometric view of the adjusting structure, the supporting board, the puzzle board and a mounting board of the jigsaw puzzle table shown in FIG. 1, illustrating the adjusting structure in the locked state.
Figure 21:
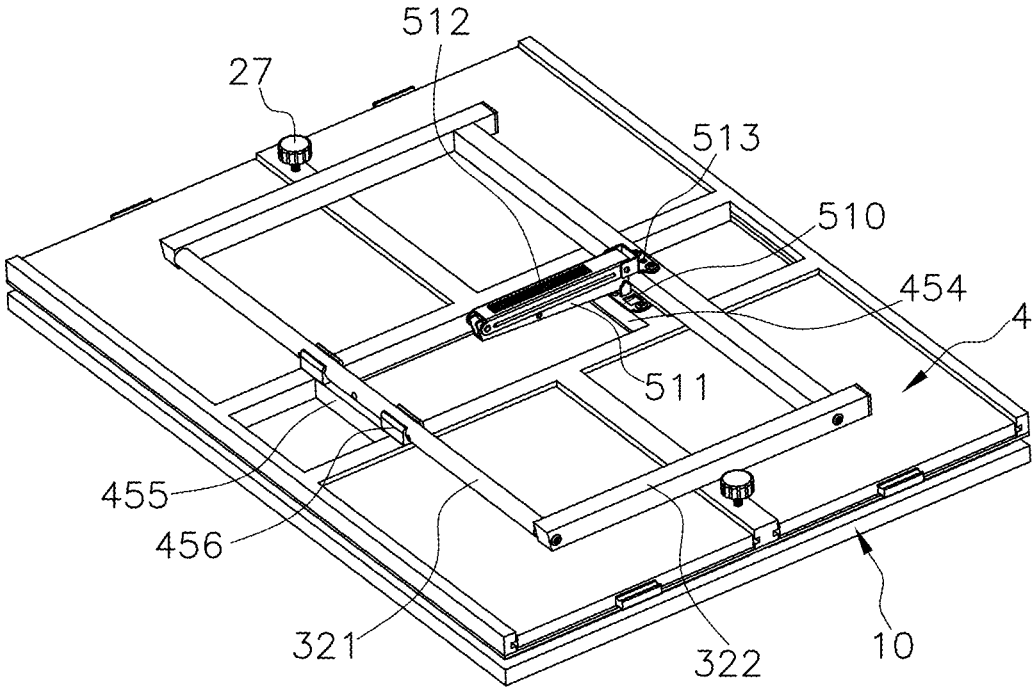
FIG. 21 is an illustrative isometric view of the adjusting structure, the supporting board and a mounting board of the jigsaw puzzle table shown in FIG. 1, illustrating the adjusting structure in the closed state.
Figure 22:
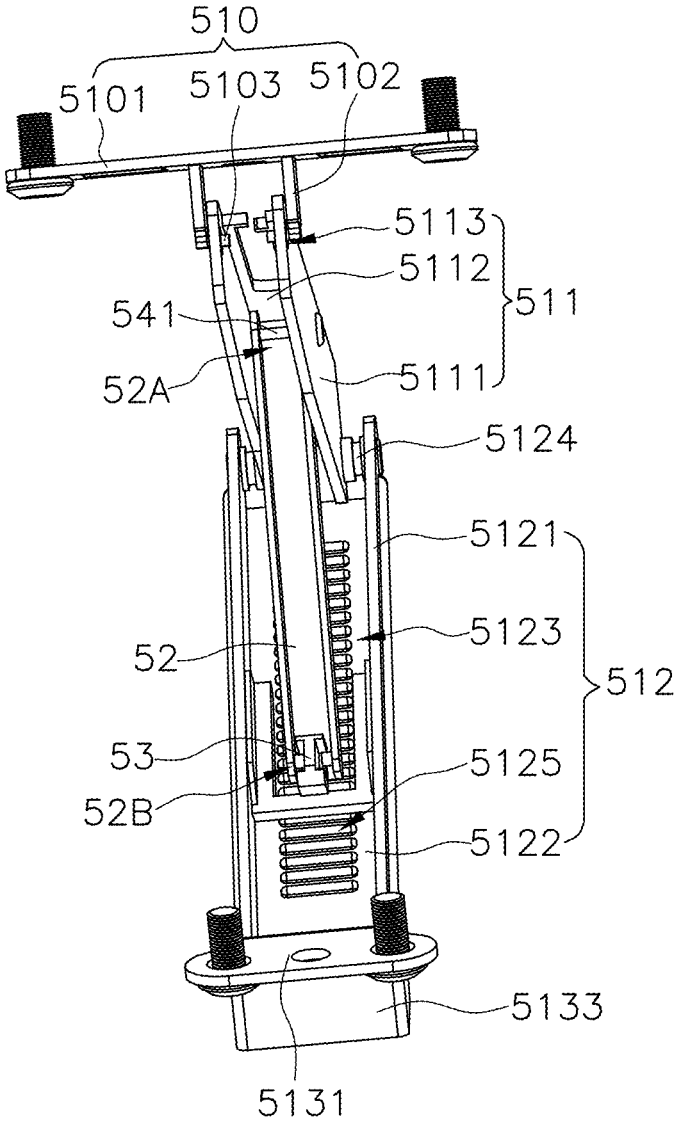
FIG. 22 is an illustrative isometric view of the adjusting structure of the jigsaw puzzle table shown in FIG. 1.
Figure 23:
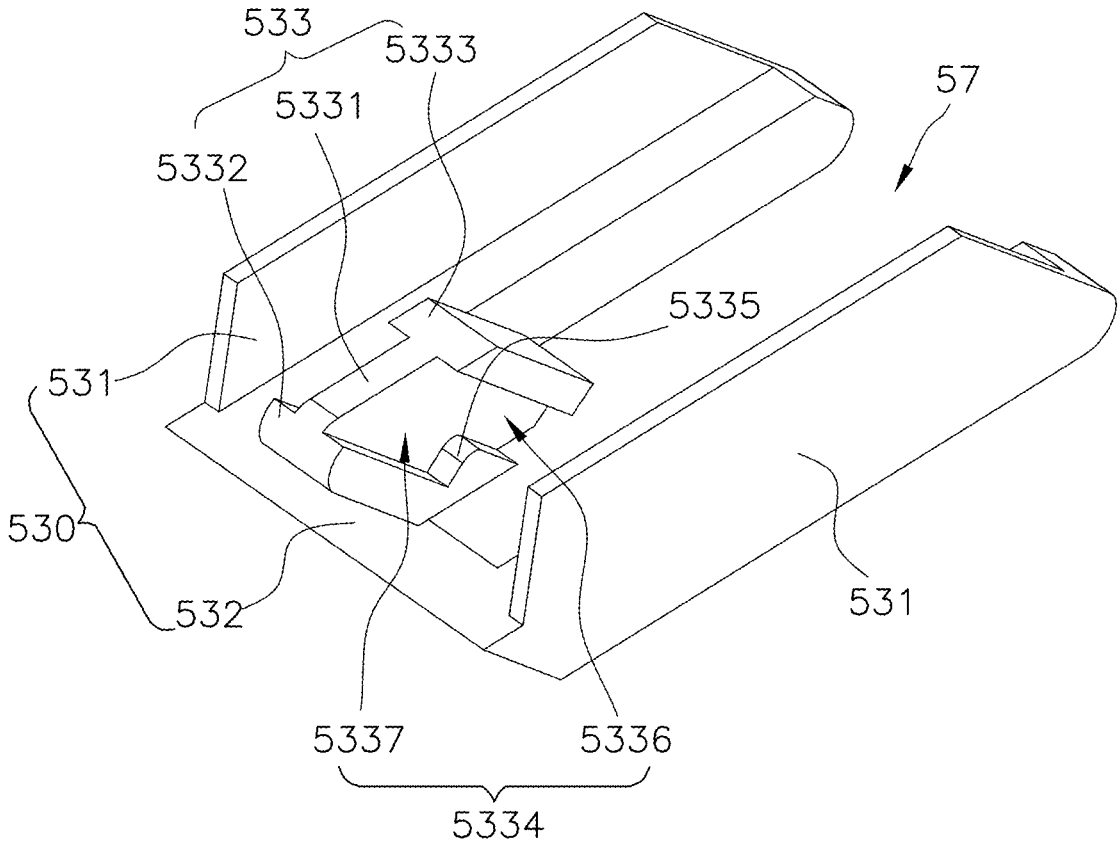
FIG. 23 is an illustrative isometric view of a control unit of the jigsaw puzzle table shown in FIG. 1.
Figure 24:
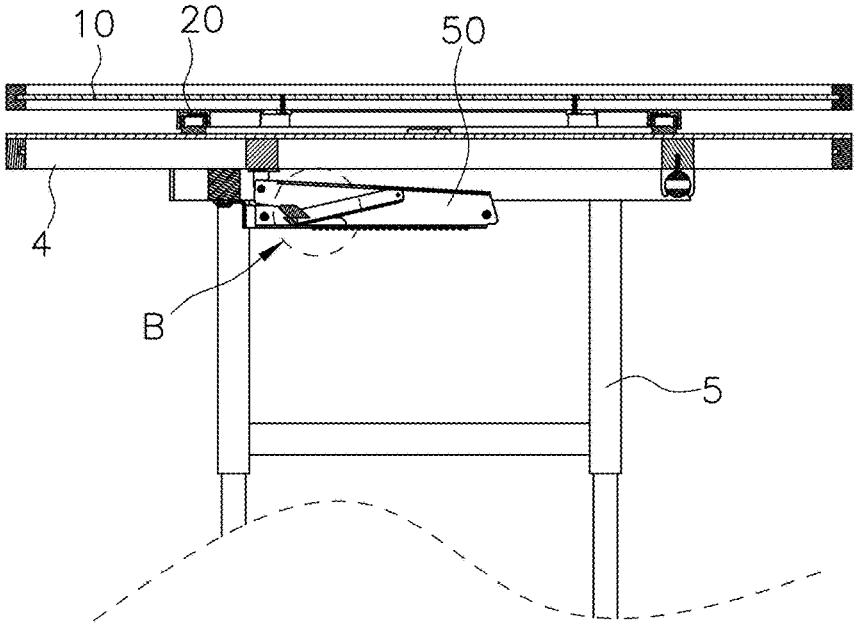
FIG. 24 is an illustrative cross-sectional view of the jigsaw puzzle table shown in FIG. 1, illustrating the adjusting structure in the closed state.
Figure 25:
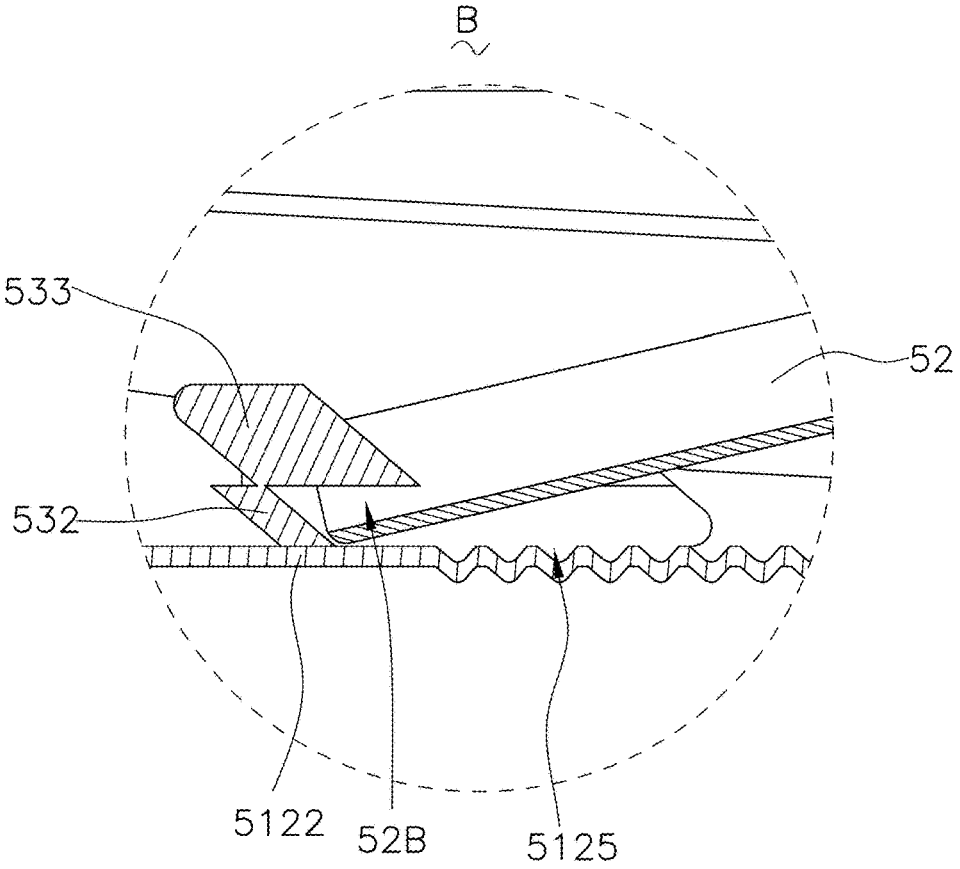
FIG. 25 is an enlarged view of Part B in FIG. 24.
Figure 26:
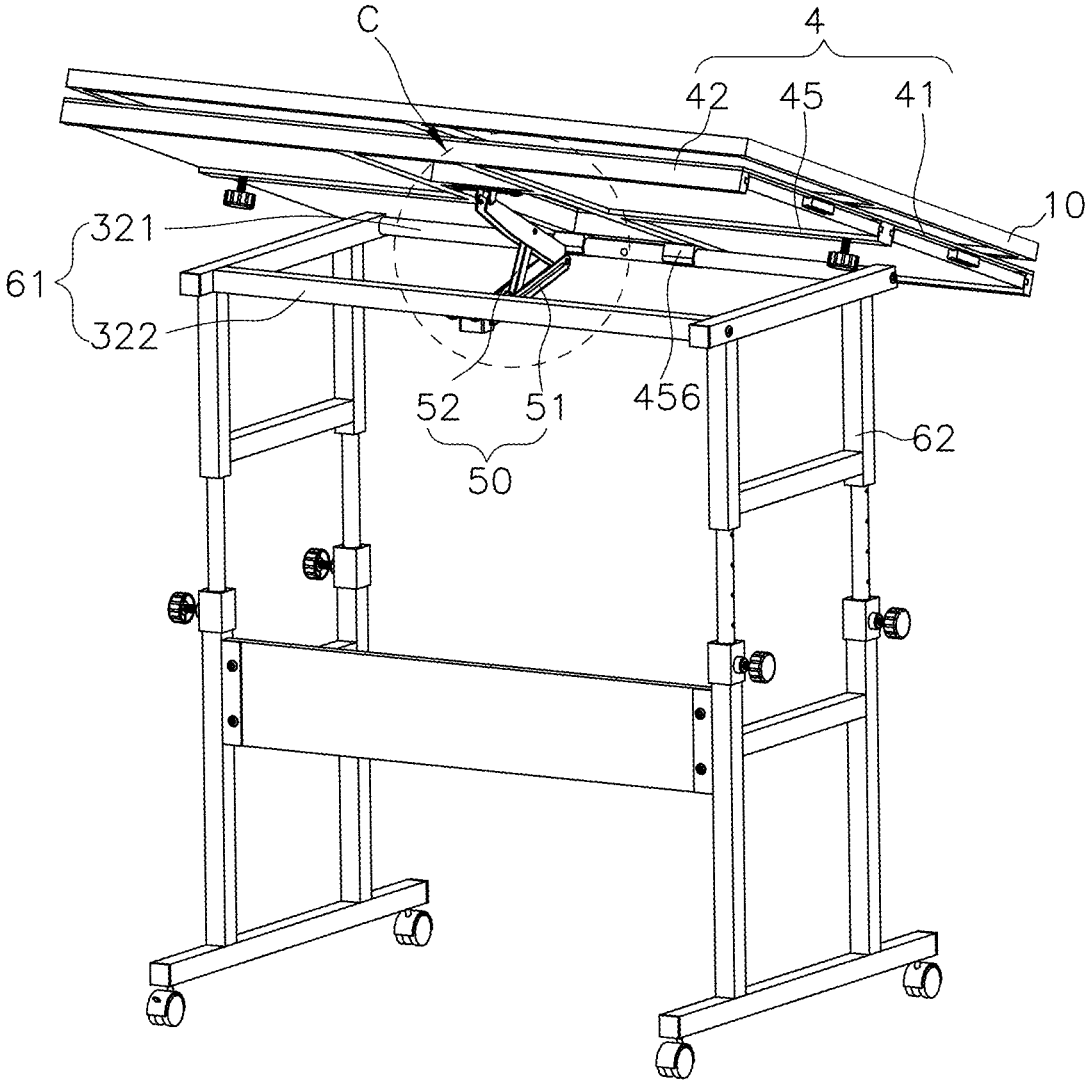
FIG. 26 is an illustrative isometric view of the jigsaw puzzle table shown in FIG. 1, illustrating the adjusting structure in the locked state.
Figure 27:
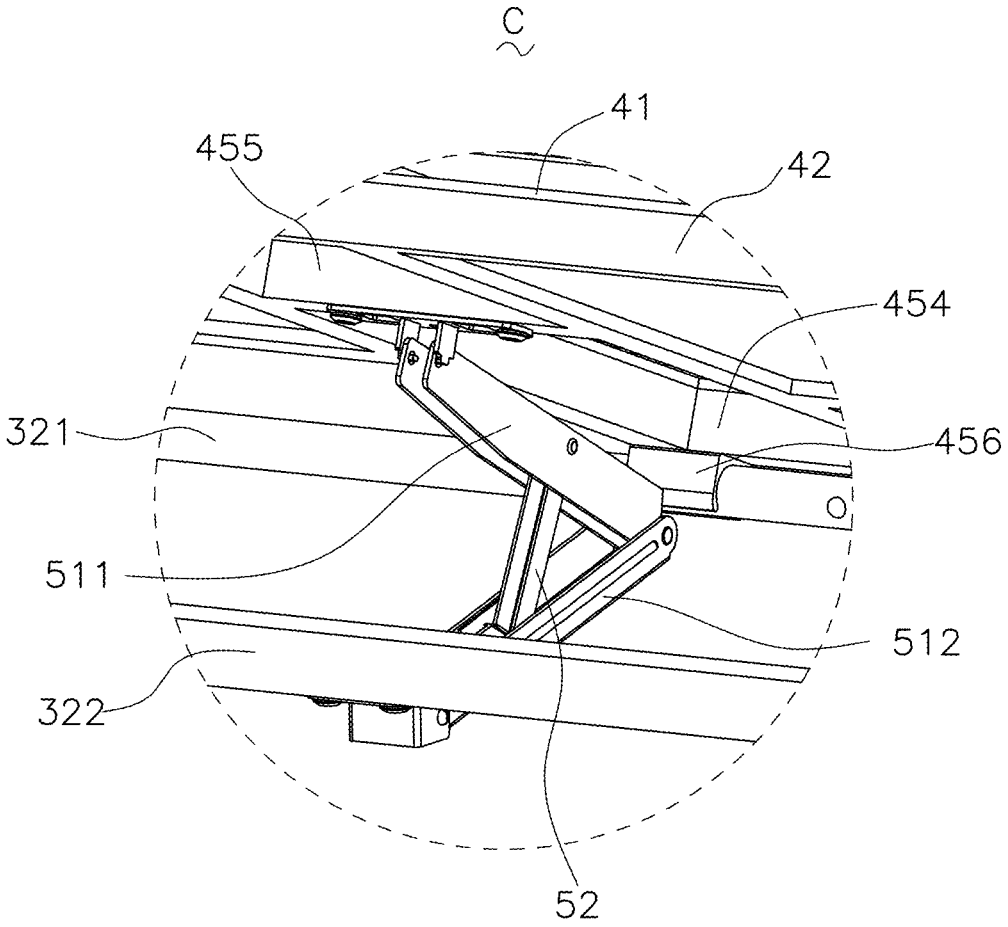
FIG. 27 is an enlarged view of Part C in FIG. 26.
Figure 28:
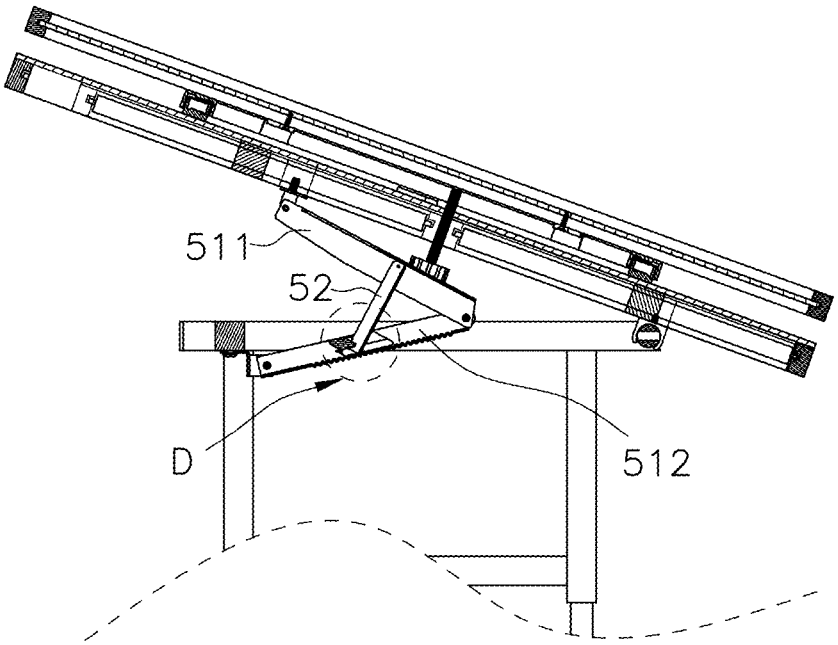
FIG. 28 is an illustrative cross-sectional view of the jigsaw puzzle table shown in FIG. 1, illustrating the adjusting structure in the locked state.
Figure 29:
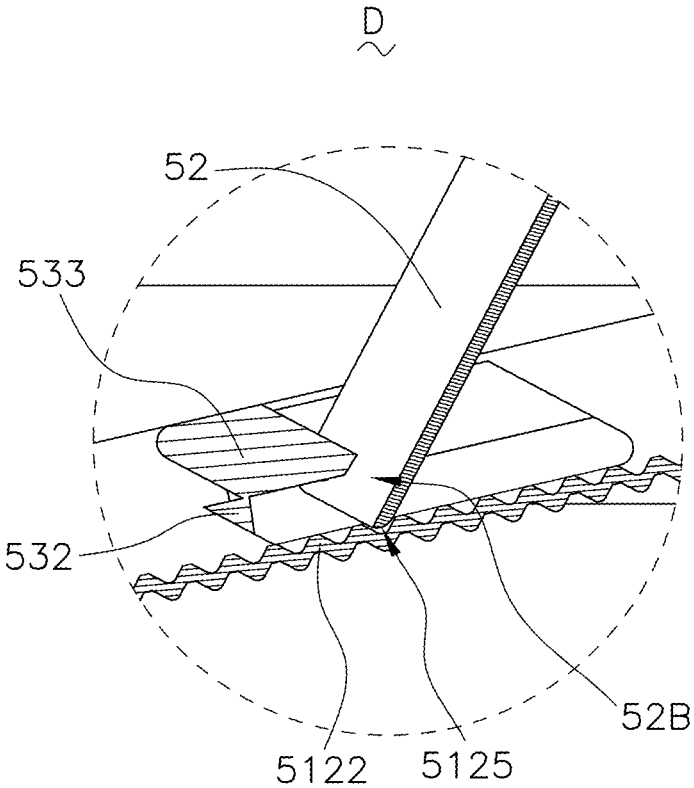
FIG. 29 is an enlarged view of Part D in FIG. 33.
Figure 30:
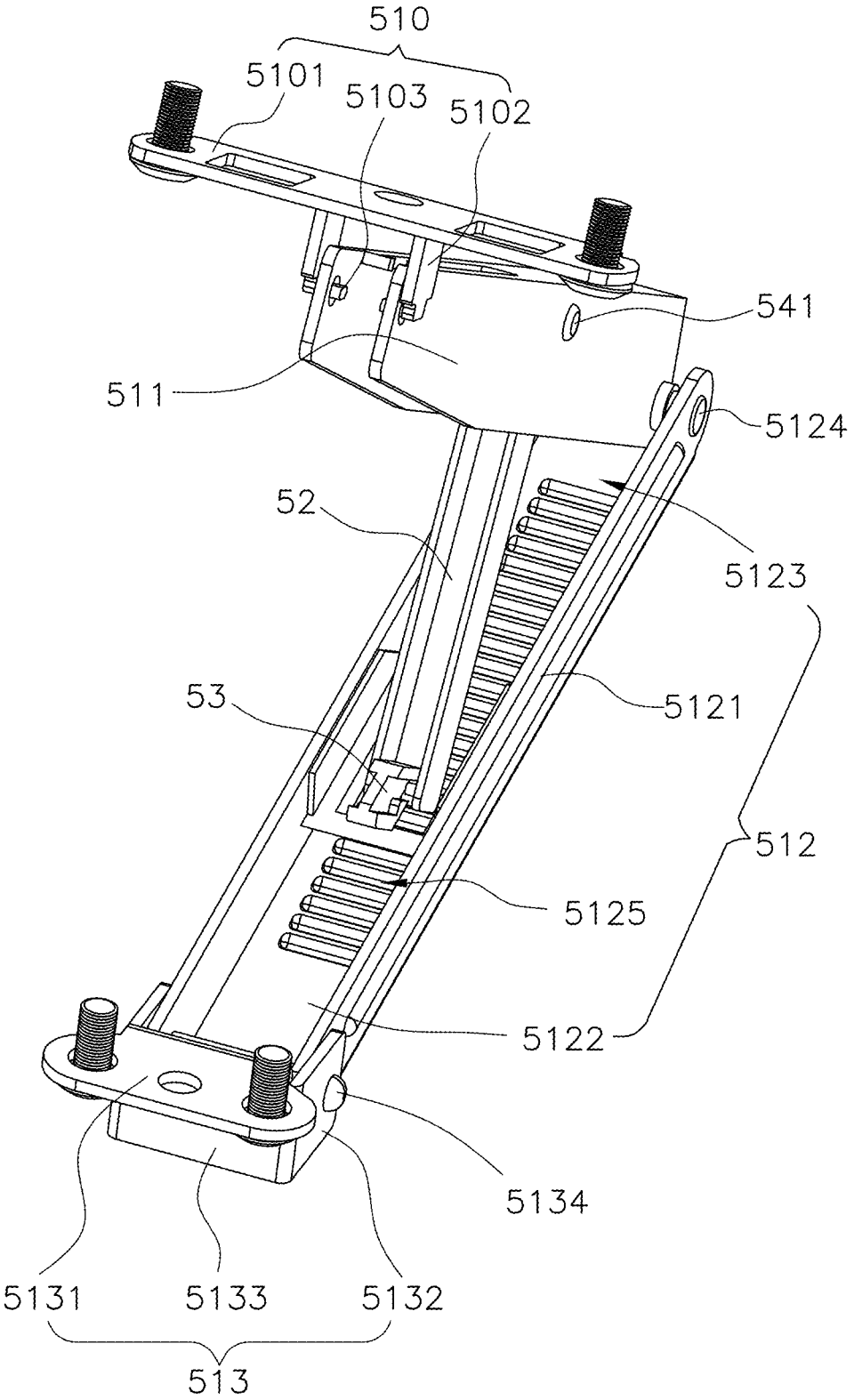
FIG. 30 is an illustrative isometric view of the adjusting structure of the jigsaw puzzle table shown in FIG. 1, illustrating the adjusting structure in a sliding state.
Figure 31:
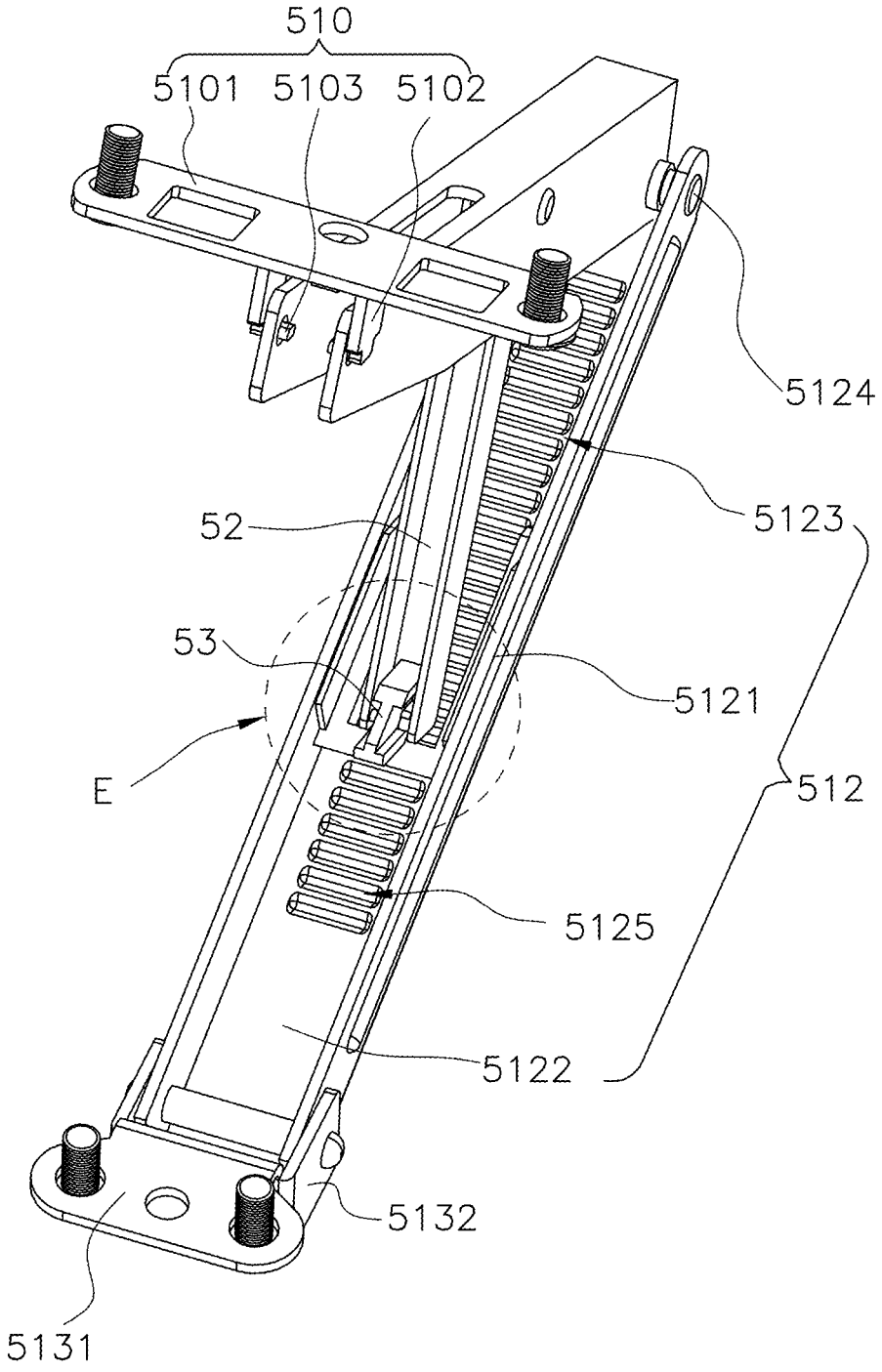
FIG. 31 is similar to FIG. 30, but from another aspect.
Figure 32:
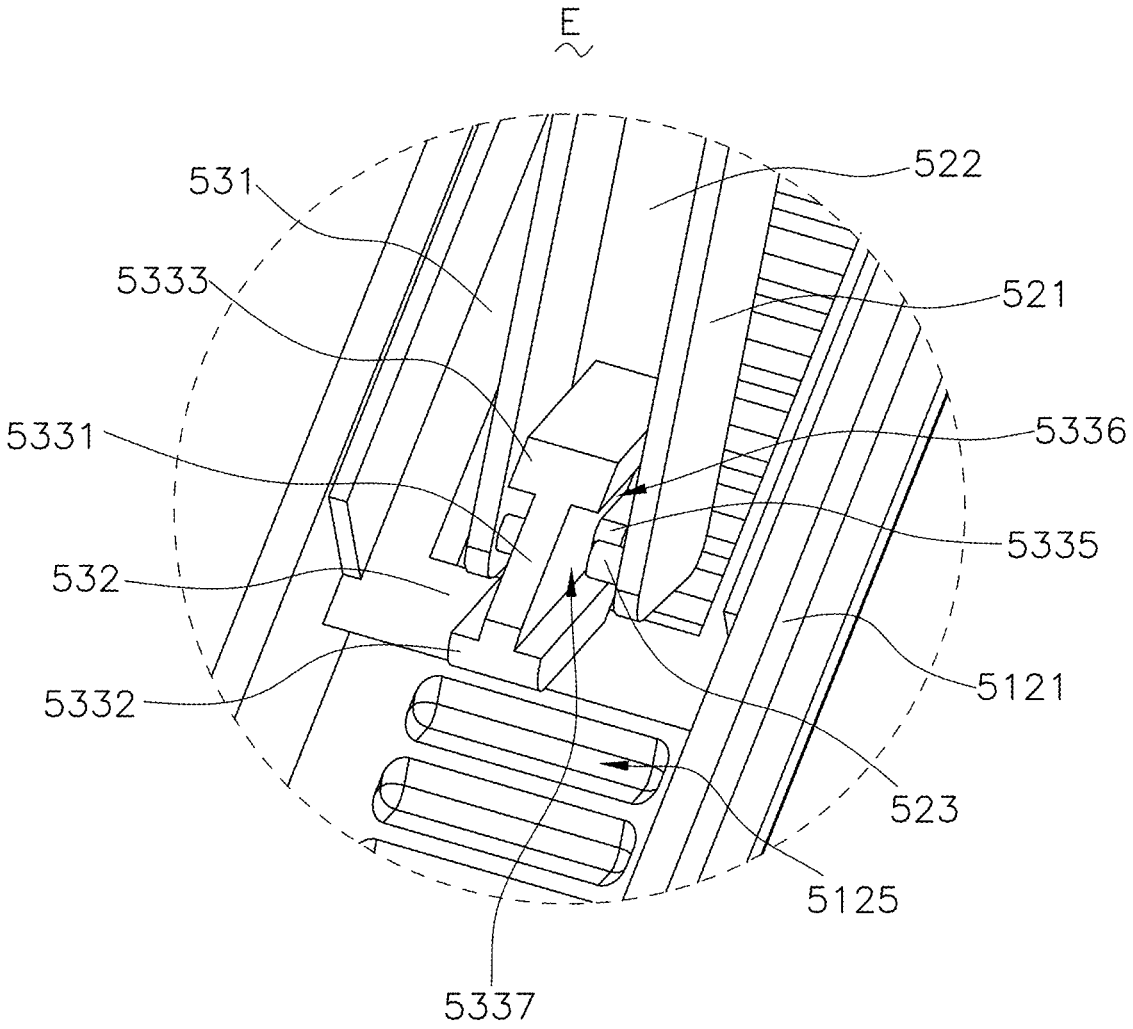
FIG. 32 is an enlarged view of Part E in FIG. 31.
Figure 33:
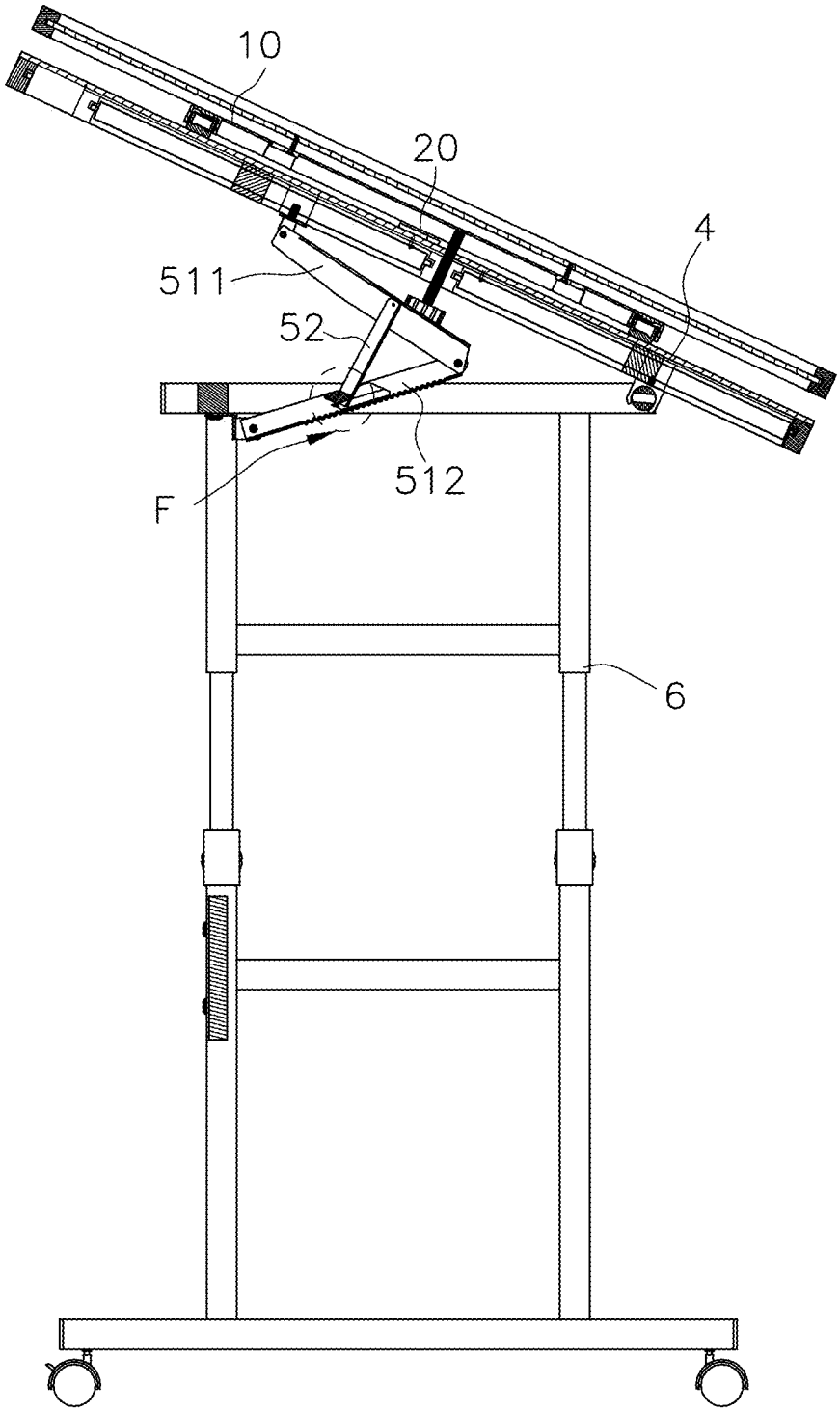
FIG. 33 is an illustrative cross-sectional view of the adjusting structure of the jigsaw puzzle table shown in FIG. 1, illustrating the adjusting structure in a sliding state.
Figure 34:
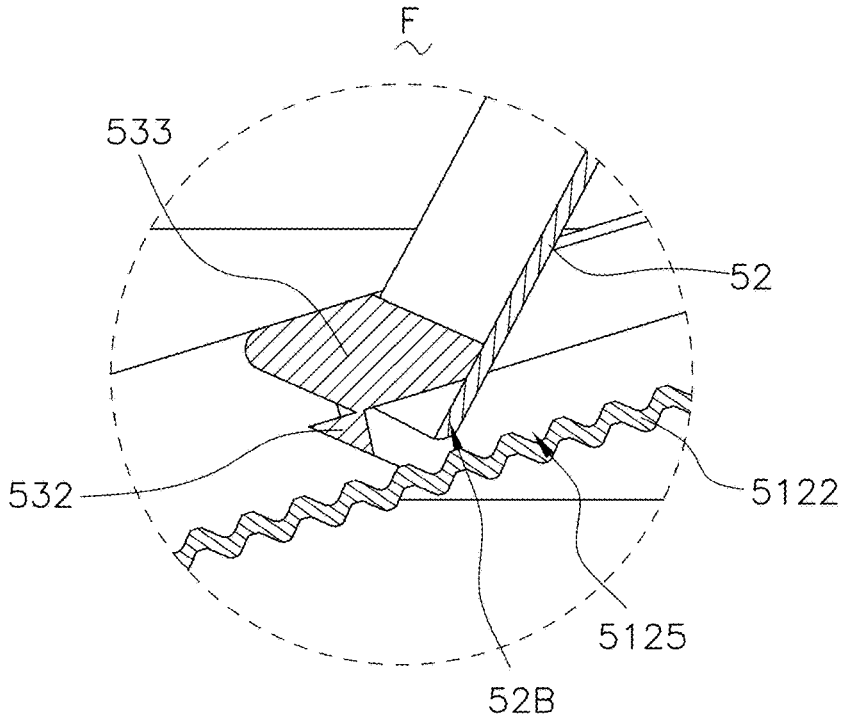
FIG. 34 is an enlarged view of Part F in FIG. 33.
Figure 35:
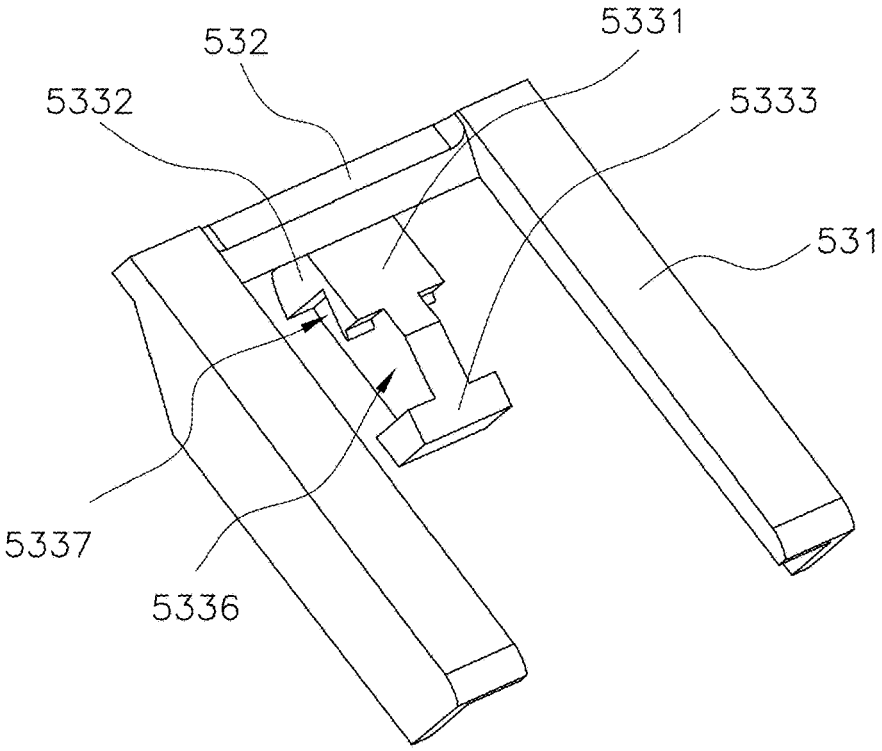
FIG. 35 is similar to FIG. 23, but from another aspect.
Figure 36:
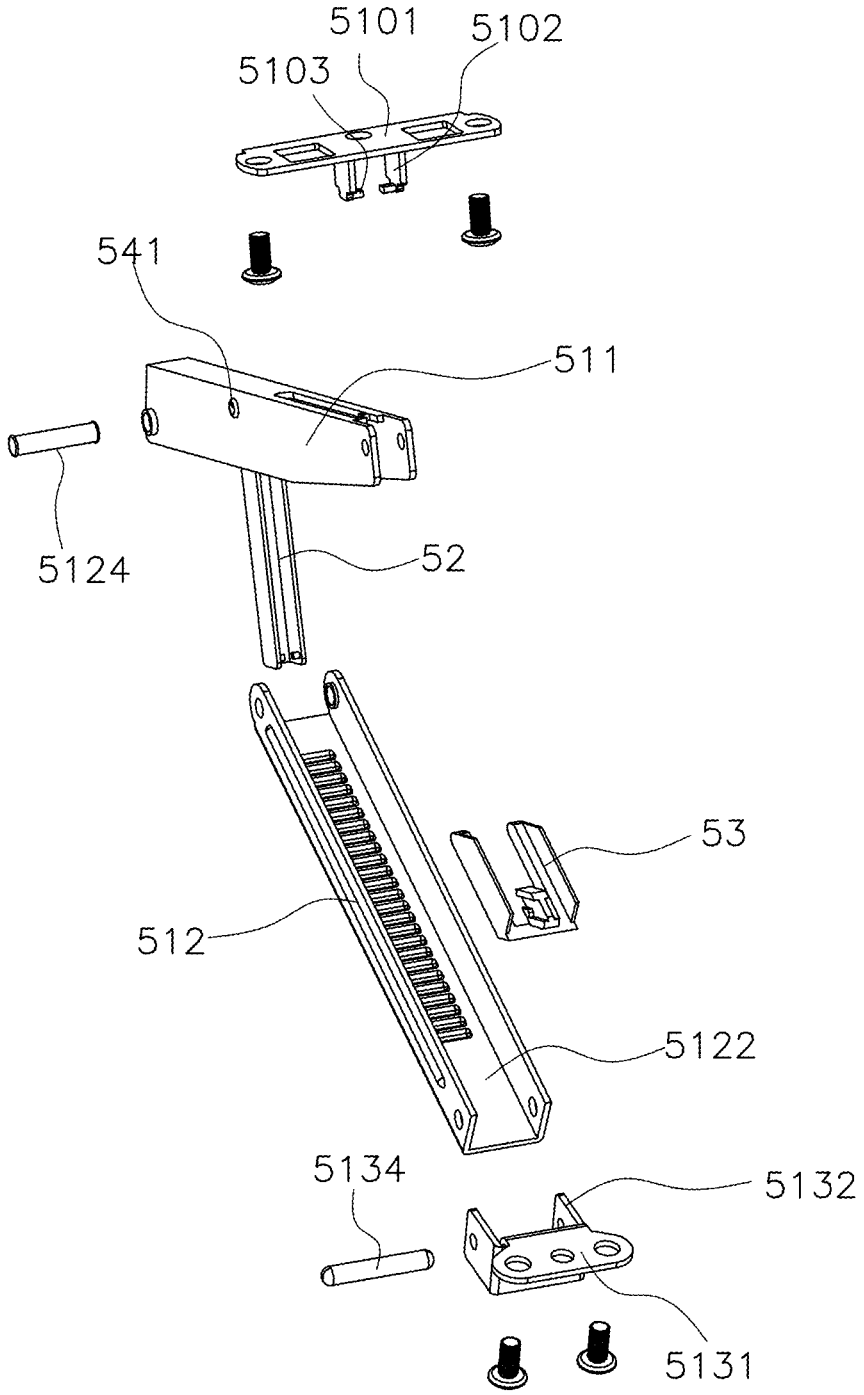
FIG. 36 is an exploded perspective view of the adjusting structure of the jigsaw puzzle table shown in FIG. 1.
Figure 37:
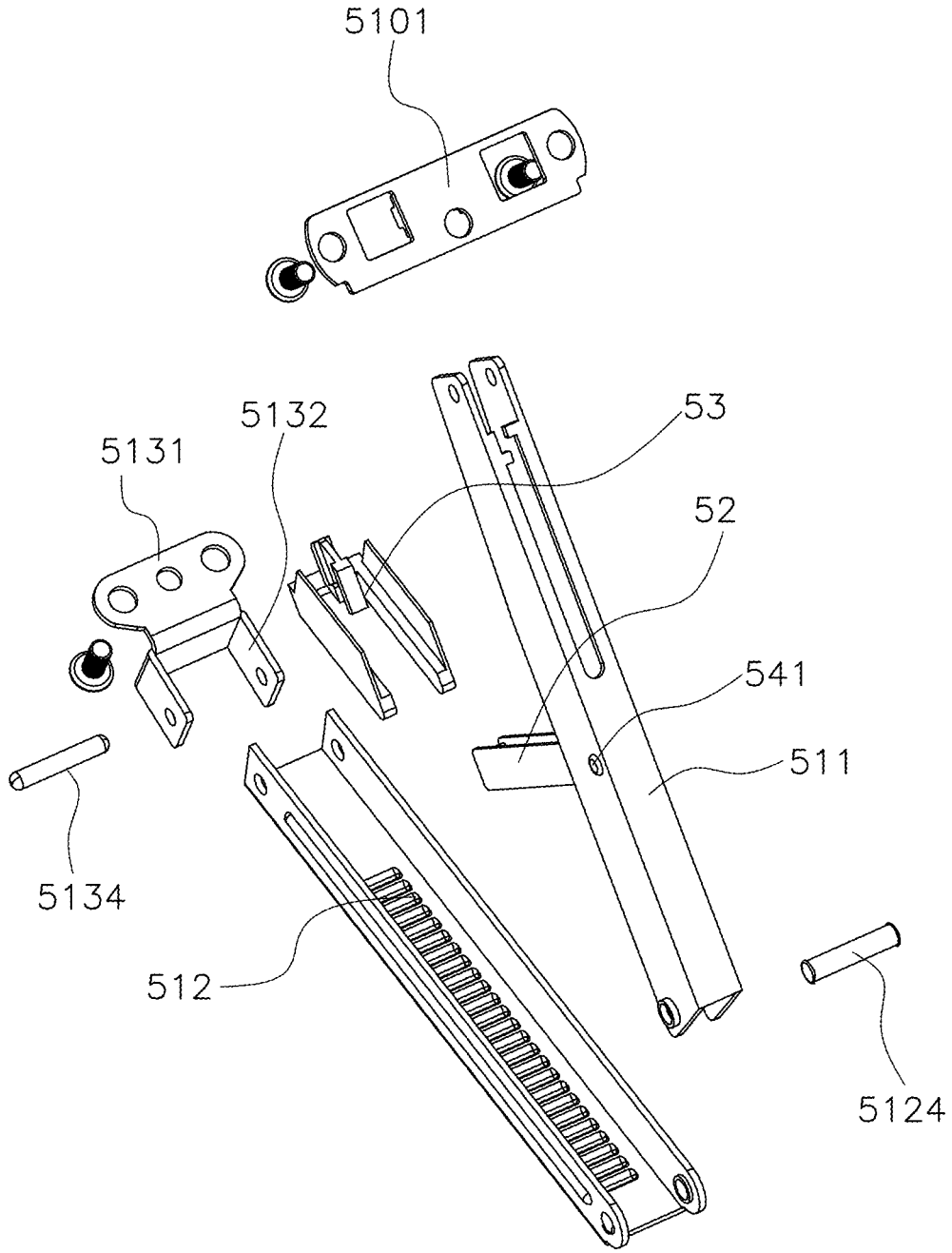
FIG. 37 is similar to FIG. 36, but from another aspect.
Figure 38:
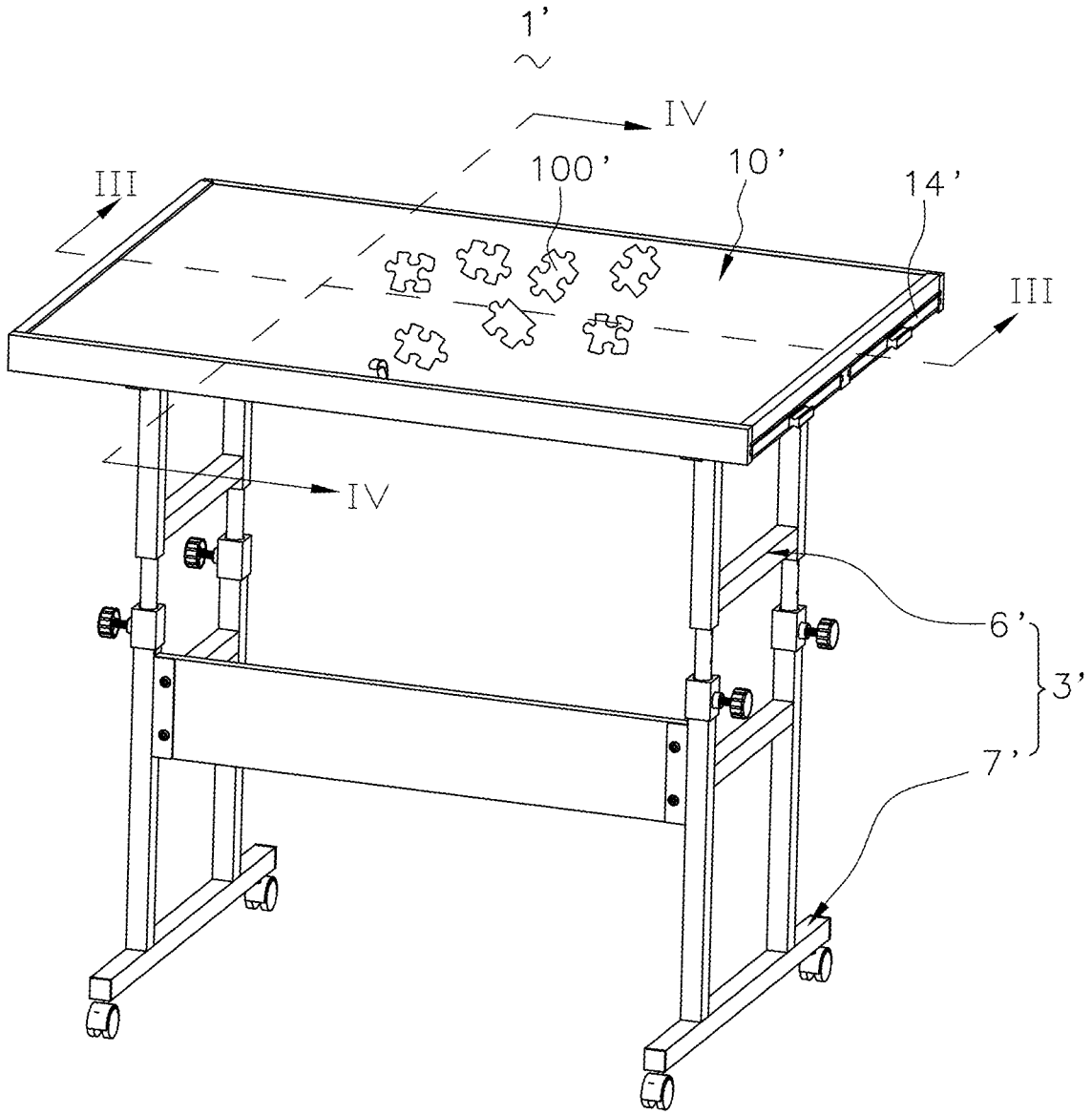
FIG. 38 is an illustrative isometric view of the jigsaw puzzle table according to a second embodiment of the present disclosure.

In order to facilitate understanding of the present disclosure, the present disclosure will be fully described below by referring to the accompanying drawings. The accompanying drawings show preferred embodiments of the present disclosure. However, the present disclosure can be realized in various forms, which are not limited to the embodiments described herein. The embodiments are provided to enable the present disclosure to be understood more thoroughly and comprehensively.

Those skilled in the art should understand that, in the disclosure of the present disclosure, terminologies of "longitudinal," "lateral," "upper," "front," "back," "left," "right," "perpendicular," "horizontal," "top," "bottom," "inner," "outer," and etc. just indicate relations of direction or position are based on the relations of direction or position shown in the appended drawings, which is only to facilitate descriptions of the present disclosure and to simplify the descriptions, rather than to indicate or imply that the referred device or element must apply specific direction or to be operated or configured in specific direction. Therefore, the above-mentioned terminologies shall not be interpreted as confine to the present disclosure.

It is understandable that the term "a" should be understood as "at least one" or "one or more". In other words, in one embodiment, the number of an element can be one and in other embodiment the number of the element can be greater than one. The term "a" is not construed as a limitation of quantity.

In the description of the present disclosure, it should be noted that the terms "mounted," "connected," and "linked" should be understood in a general manner, which could be, for example, affixedly connected, detachably connected, or integrally connected. Unless expressly specified and defined otherwise, it may also be a mechanical connection, an electrical connection or may be in communication with each other; it may be directly connected or indirectly connected by means of an intermediate medium, and may be an interaction relationship between two or more elements inside the two elements. For a person of ordinary skill in the art, the specific meanings of the above terms in the present disclosure may be understood according to specific situations.

It should be noted that when an element is "fixed" to another element, it means that the element is directly arranged on the element, or an intermediate element is arranged therebetween. When an element is "connected" to another element, it means that the element is directly connected to the element, or an intermediate element is arranged therebetween. Furthermore, the term "and/or" is merely a description of an associative relationship between associated objects and indicates that three relationships may exist. For example, A and/or B means that A exists alone, both A and B exist, and B exists alone.

Unless otherwise defined, all technical and scientific terms used herein have the same meaning as commonly understood by any ordinary skilled person in the art. Terms in the specification of the present disclosure are used only for the illustrative purposes only. For example, "in," "out," "left," "right," and similar expressions are used for illustrative purposes only, and are not intended to limit the present disclosure.

As shown in FIGS. 1 to 37, schematic views of the jigsaw puzzle table 1 from a first embodiment of the present disclosure are presented. The jigsaw puzzle table 1 is arranged for a user or player to assemble a plurality of puzzle pieces 100 thereon. Accordingly, the jigsaw puzzle table 1 comprises a puzzle board 10, a rotating assembly 20 attached to the puzzle board 10 and a supporting assembly 3 for adjusting the supporting height of the jigsaw puzzle table 1. The rotating assembly 20 is mounted between the puzzle board 10 and the supporting assembly 3. The puzzle board 10 and rotating assembly 20 are supported by the supporting assembly 3, respectively. The supporting assembly 3 comprises a supporting board 4 and a lower frame 5 coupled with the supporting board 4 for adjusting the supporting height of the jigsaw puzzle table 1. The lower frame 5 comprises a board bracket 6 and a foot structure 7 connected to the board bracket 6. The board bracket 6 is used to connect the supporting board 4 and the foot structure 7. The foot structure 7 rests on the ground or other surfaces.

The puzzle board 10 is arranged above the supporting board 4. The rotating assembly 20 is disposed between the puzzle board 10 and the supporting board 4. The puzzle board 10 is placed flat on the supporting board 4 and comprises a puzzle plate 11 for placing the puzzle pieces 100 and a fixing frame 12 for supporting the puzzle plate 11. The puzzle plate 11 is positioned away from the supporting assembly 3, allowing the user to assemble the puzzle pieces 100 on it. The puzzle plate 11 has a rectangular shape defined by two longer longitudinal sides aligned along a longitudinal direction X and two shorter transverse sides aligned along a lateral direction Y, which is perpendicular to the longitudinal direction X. Accordingly, the puzzle board 10 defines an XY coordinate surface. The fixing frame 12 has a fixing portion 121, a hollow space 122 surrounded by a fixing portion 121 and the fixing arm 123 received in the hollow space 122, and connected to the fixing portion 121. The puzzle plate 11 is mounted on the fixing arm 123 and received in the hollow space 122. The edge of the puzzle plate 11 is secured by the fixing portion 121. The puzzle plate 11 is substantially parallel to the supporting board 4. The fixing arm 123 comprises at least one fixing hole 124 coupled with the rotating assembly 20. As shown in FIG. 1, the puzzle board 10 further comprises an anti-slipping layer 104 overlappedly provided on the puzzle plate 11 for preventing the puzzle pieces 100 being slipped thereon. Preferably, the anti-slipping layer 104 has a self-adhesive bottom surface adhered on the puzzle plate 11, wherein the anti-slipping layer 104 can be removed from the puzzle plate 11 without damaging the puzzle plate 11 and the anti-slipping layer 104. Therefore, the anti-slipping layer 104 is reusable to place on the puzzle plate 11. Furthermore, the anti-slipping layer 104 serves as a backing layer of the puzzle pieces 100 after the puzzle pieces 100 are assembled. The anti-slipping layer 104 can be omitted, and other drawings in this embodiment, except for FIG. 1, also omit the anti-slipping layer 104.

The supporting board 4 comprises a supporting unit 41 substantially parallel to the puzzle plate 11 and a supporting frame 42 for providing supporting force of the supporting unit 41. The supporting unit 41 comprises a supporting portion 43, an installation window 44 drilled completely through the supporting portion 43 and a fastening hole 459 drilled completely through the supporting portion 43 and surrounding the installation window 44. At least part of the rotating assembly 20 is exposed from the installation window 44. The supporting board 4 further comprises a reinforcing arm 45 connected to a bottom surface of the supporting portion 43 and inner sides of the supporting frame 42 for forming at least one drawer cavity 13 and at least one puzzle drawer 14 received in the corresponding drawer cavity 13. The puzzle drawer 14 is movably mounted below the supporting portion 43. The puzzle drawer 14 is movable relative to the supporting portion 43 to be opened or closed. In the present embodiment, the puzzle drawer 14 is disposed below the supporting portion 43. In other embodiments, the puzzle drawer 14 may be provided on the puzzle board 10, as long as it avoids the installation position of the rotating assembly 20. The reinforcing arm 45 comprises a pair of inner reinforcing portions 451 spaced apart from each other for forming an inner receiving space 452 and a pair of dividing reinforcing portions 453 connected to the corresponding inner reinforcing portion 451 and extending away from the inner reinforcing portion 451. Each dividing reinforcing portions 453 comprises at least one reinforcing hole 458. The supporting board 4 further comprises a first pivoting arm 454 received in the inner receiving space 452 and connected with the pair of inner reinforcing portions 451, a second pivoting arm 455 received in the inner receiving space 452 and connected with the pair of inner reinforcing portions 451 and a pivoting member 456 attached on the first pivoting arm 454. The first pivoting arm 454 is spaced apart from the second pivoting arm 455 for forming an inner window 457 together with the pair of inner reinforcing portions 451. The first pivoting arm 454 is substantially parallel to the second pivoting arm 455. When the supporting unit 41 is assembled with the supporting frame 42, the fastening hole 459 of the supporting unit 41 is communicated with the reinforcing hole 458 of the supporting frame 42 to form a connecting hole 46. Referring to FIGS. 4-8, along an assembling direction A1 of the puzzle board 10 and the rotating assembly 20, the projections of the installation window 44 and the inner receiving space 452 on the puzzle plate 11 do not overlap. The installation window 44 and the corresponding drawer cavity 13 are located outside the pair of inner reinforcing portions 451, while the inner receiving space 452 is located inside the pair of inner reinforcing portions 451. The installation window 44 is communicated with a corresponding drawer cavity 13.

The specific setting, position, and quantity of the reinforcing arm 45 need to be flexibly adjusted based on the number and position of other components within the jigsaw puzzle table 1. The reinforcing arm 45 is chosen as a rectangular section strip, which provides a flat surface and serves as a solid foundational base for the fixed installation of other components. The outline of the inner window 457 matches that of the installation window 44. Along the assembling direction A1 of the puzzle board 10 and the rotating assembly 20, the outlines of the inner window 457 and the installation window 44 completely coincide. The inner window 457 is communicated with the installation window 44. Upon assembly, at least part of the rotating assembly 20 is exposed through the inner window 457 and the installation window 44. In other words, at least part of the rotating assembly 20 is visible through the inner window 457 and the installation window 44 by the assembler.

The inner reinforcing portions 451 are arranged along the lateral direction Y and are substantially parallel to each other. The dividing reinforcing portions 453, the first pivoting arm 454, and the second pivoting arm 455 are arranged along the longitudinal direction X and are substantially parallel to each other. In an alternative embodiment, the inner reinforcing portions 451, the dividing reinforcing portions 453, the first pivoting arm 454, and the second pivoting arm 455 may be arranged in any direction according to the requirements of the desired functions.

Although good results have been shown with the rectangular puzzle board 10, it is within the scope of the present disclosure that numerous other shapes of puzzle boards 10 could be utilized to achieve the desired functionality as described herein. The supporting board 4 is also rectangular, allowing it to fit well with the shape of the puzzle board 10, which makes the overall structure of the jigsaw puzzle table 1 more coordinated. In other embodiments, the supporting board 4 may also be circular, elliptical, triangular, or polygonal. The outline of the supporting board 4 is smaller than that of the puzzle board 10, and even smaller than that of the rotating assembly 20. If the outline of the supporting board 4 is less than that of the rotating assembly 20, then at least part of the rotating assembly 20 will be exposed outside the outline of the supporting portion 43. In other words, a part of the rotating assembly 20 extends outside the outline of the supporting board 4.

The board bracket 6 comprises a mounting board 61, an upper bracket 62 connected to the mounting board 61, a lower bracket 63 positioned below the upper bracket 62, an adjusting bracket 64 connecting the upper and lower brackets 62 and 63, and an adjusting structure 50 hinged to the mounting board 61 and the supporting board 4. The adjusting bracket 64 can be partially inserted into or projected from the lower bracket 63, thereby allowing adjustments to the relative position between the upper and lower brackets 62 and 63. By adjusting the height of the adjusting bracket 64 to extend beyond the lower bracket 63, the overall height of the jigsaw puzzle table 1 can be modified. The adjusting bracket 64 has a plurality of telescopic legs. Each leg comprises a plurality of position locating parts 641. Each telescopic leg can be independently adjusted in extension height relative to the other telescopic legs. The position locating parts 641 serves to fix the height of the telescopic leg on one hand, and acts as a scale on the other hand, allowing for comparison of the positions of the position locating parts of each telescopic leg, thereby quickly adjusting the overall height of the jigsaw puzzle table 1.

The mounting board 61 of the board bracket 6 comprises a supporting shaft 321 and a main frame 322 that forms a closed annular shape in conjunction with the supporting shaft 321. The supporting board 4 is rotatably mounted on the supporting shaft 321 through the pivoting member 456. The rotation of the pivoting member 456 drives the supporting board 4 to rotate, causing the supporting board 4 to tilt relative to the board bracket 6. Since the puzzle board 10 is fixed relative to the supporting board 4, when the supporting board 4 tilts, the puzzle board 10 tilts synchronously. This allows the puzzle board 10 to face the user more effectively, facilitating puzzle operation. The shape of the mounting board 61 is also rectangular, and its dimensions are smaller than those of the supporting board 4. Preferably, the board bracket 6 may be completely hidden under the supporting board 4.

In this embodiment, the supporting shaft 321 is detachably coupled with the pivoting member 456. The pivoting member 456 has a circular tubular shape with an opening. The configuration of this opening ensures that the pivoting member 456 can rotate around the supporting shaft 321 while also facilitating easy disassembly and assembly between the pivoting member 456 and the supporting shaft 321. The supporting board 4 and the puzzle board 10 can be detached from the lower frame 5 without restriction from the supporting shaft 321. The supporting board 4 can independently support the puzzle board 10, allowing both the supporting board 4 and the puzzle board 10 to be placed directly on any playing surface, such as a table, wall, floor, or similar structures, or on carriers with a certain spatial height, thereby eliminating the need for the lower frame 5.

There are two pivoting members 456, both of which are simultaneously fixed to the first pivoting arm 454 of the reinforcing arm 45, maintaining a gap between the two pivoting members 456. The configuration of the pivoting member 456 is a circular tubular shape. When the user lifts the puzzle board 10 with external force, the pivoting member 456 can be rotated around the supporting shaft 321, thus facilitating the user's operation. The pivoting member 456 may also be configured as a hinge, magnetic structure, or another similar rotating connection component, as long as it ensures that when the puzzle board 10 tilts, the pivoting member 456 provides sufficient support and guidance for the puzzle board 10. Preferably, the rotating connection component has a self-locking function.

The adjusting structure 50 drives the supporting board 4 to rotate around the supporting shaft 321, thereby causing the puzzle board 10 and the supporting board 4 to tilt relative to the board bracket 6, enabling the puzzle board 10 to tilt downward, closest to the user, to a desired position.

The connection point of the adjusting structure 50 and the board bracket 6 is located opposite the supporting shaft 321; that is, the adjusting structure 50 is installed on the main frame 322. The adjusting structure 50 comprises an adjusting unit 51, a driving unit 52 pivoted to the adjusting unit 51 and a control unit 53 detachably pivoted to the driving unit 52 for controlling the adjusting structure 50 in a sliding state, locked state and closed state. The force required to switch between the sliding, locked, and closed states of the adjusting structure 50 is applied by the user on the puzzle board 10 or the supporting board 4 and acts directly or indirectly on the driving unit 52 via the adjusting unit 51.

The adjusting unit 51 is a foldable two-section structure and comprises a first fastening unit 510 fixed on the second pivoting arm 455 of the supporting board 4, a first adjusting arm 511 pivoted to the first fastening unit 510, a second adjusting arm 512 pivoted to the first adjusting arm 511, a connecting shaft 5124 connected the first adjusting arm 511 and the second adjusting arm 512, and a second fastening unit 513 fixed on the main frame 322 of the board bracket 6. One end of the first adjusting arm 511 is hinged to the supporting board 4 via the first fastening unit 510, while the other end of the second adjusting arm 512, which is away from the first adjusting arm 511, is hinged to the main frame 322 via the second fastening unit 513.

The first fastening unit 510 comprises a first fixing member 5101 fixed to the second pivoting arm 455, a pair of first connecting walls 5102 extending from the first fixing member 5101 and spaced apart from each other, and two first pivoting shafts 5103 extending from one of the first connecting walls 5102 toward the direction of the other first connecting wall 5102. The first fixing member 5101, the first connecting walls 5102, and the first pivoting shafts 5103 are integrally formed. The pair of first connecting walls 5102 is substantially parallel to each other. The first connecting walls 5102 are perpendicular to the first fixing member 5101, respectively.

The first fixing member 5101 can be fixed to a top surface, a bottom surface, or side surfaces of the second pivoting arm 455. In this embodiment, the first fixing member 5101 is fixed to the bottom surface of the second pivoting arm 455, and the first connecting wall 5102 is directly fixed to the first fixing member 5101. In other embodiments, when the first fixing member 5101 is fixed to other surfaces of the second pivoting arm 455, the first connecting wall 5102 will also need to include a transition component connected to the first adjusting arm 511 and the second pivoting arm 455. The first fixing member 5101 is affixed to the second pivoting arm 455 using a bolt fastening method, ensuring that the first fixing member 5101 is fixed firmly and stably attached to the second pivoting arm 455.

The first adjusting arm 511 comprises a pair of first pivoting parts 5111 and a first connecting part 5112 connected to the pair of first pivoting parts 5111. The first adjusting arm 511 is located between the pair of first connecting walls 5102. Each first pivoting part 5111 is pivoted to a corresponding first connecting wall 5102. Each first pivoting part 5111 comprises a pivoting hole 5113 positioned at the location of the corresponding first pivoting shaft 5103 and the first pivoting shaft 5103 passed through the pivoting hole 5113. The axes of the two first pivoting shafts 5103 are aligned on the same line while maintaining a gap between them.

Each first pivoting part 5111 is connected to the corresponding first pivoting shaft 5103, with the two first pivoting shafts 5103 spaced apart. This arrangement allows each first pivoting part 5111 to easily disengage from its respective first pivoting shaft 5103. It only requires that a compressive force applied to the two first pivoting parts 5111 causes the first pivoting parts 5111 to move toward each other and generate deformation, thereby allowing them to detach from the first pivoting shafts 5103.

The second adjusting arm 512 comprises a pair of second pivoting parts 5121, a second connecting part 5122 connected to the pair of second pivoting parts 5121 and a sliding slot 5123 formed by the pair of second pivoting parts 5121, and the second connecting part 5122. The second connecting part 5122 is positioned at the bottom of the second pivoting parts 5121.

The first adjusting arm 511 is positioned between the pair of second pivoting parts 5121 and hinged to one of the second pivoting parts 5121 through a connecting shaft 5124. The two ends of the connecting shaft 5124 pass through the pair of second pivoting parts 5121 and the pair of first pivoting parts 5111. This configuration allows both the first adjusting arm 511 and the second adjusting arm 512 to rotate around the connecting shaft 5124. The second connecting part 5122 comprises a plurality of locking slots 5125, spaced at intervals along the extension direction of the sliding slot 5123.

The second fastening unit 513 comprises a second fixing member 5131 fixed to the main frame 322, a pair of second connecting walls 5132 extending from the second fixing member 5131, and a connecting member 5133 connected to the second fixing member 5131 and the second connecting walls 5132. The second fixing member 5131, the second connecting walls 5132, and the connecting member 5133 are integrally formed.

The second fixing member 5131 may be attached to the top surface, the bottom surface, or both side surfaces of the main frame 322. In this embodiment, the second fixing member 5131 is secured to the bottom surface of the main frame 322, with the connecting member 5133 accommodating the offset distance between the second fixing member 5131 and the second connecting walls 5132.

The second adjusting arm 512 is positioned between the pair of second connecting walls 5132 and is hinged to the second fastening unit 513 via a third pivoting shaft 5134. The third pivoting shaft 5134 is passed through the pair of second connecting walls 5132, respectively, and the pair of second pivoting parts 5121 are fitted onto the third pivoting shaft 5134, thereby allowing the second adjusting arm 512 to rotate around the second fastening unit 513.

The driving unit 52 comprises a fixing end 52A and a free end 52B. The fixing end 52A is located between the pair of first pivoting parts 5111 of the first adjusting arm 511. The driving unit 52 is hinged to the first adjusting arm 511 via a fourth pivoting shaft 541. The fourth pivoting shaft 541 is passed through the pair of first pivoting parts 5111. The fixing end 52A is fitted onto the fourth pivoting shaft 541, thereby allowing the driving unit 52 to rotate around the fourth pivoting shaft 541.

The free end 52B is suspended between the second adjusting arm 512 and is capable of sliding freely along the sliding slot 5123. The free end 52B can engage with the locking slots 5125 and can be locked into any of those slots.

The control unit 53 comprises a pair of sliding arms 531, a sliding portion 532 connected to the pair of sliding arms 531, and a guiding unit 533 pivoted to the driving unit 52 and connected to the sliding portion 532. The sliding arms 531 extend in the direction of the extension of the sliding slot 5123. The pair of sliding arms 531 and the sliding portion 532 cooperatively form a sliding space 57 that accommodates the free end 52B of the driving unit 52 and the guiding unit 533. The sliding portion 532 is positioned at one end of the sliding arms 531, closer to the second fastening unit 513 than the free end 52B of the driving unit 52, and spaced apart from the free end 52B of the driving unit 52, in order to prevent the driving unit 52 from contacting the sliding portion 532 and the sliding arms 531 during the movement of the driving unit 52. One end of the guiding unit 533 is fixed to the sliding portion 532, while the other end of the guiding unit 533 extends away from the sliding portion 532 and is detachably pivoted to the driving unit 52.

The guiding unit 533 comprises a base portion 5331, a first extending portion 5332 extended from one end of the base portion 5331 and connects to the sliding portion 532, and a second extending portion 5333 extended from the other end of the base portion 5331. The first extending portion 5332 is located close to the sliding portion 532, while the second extending portion 5333 is located away from the sliding portion 532. The first extending portion 5332 and the second extending portion 5333 cooperate with the base portion 5331 to form a guiding portion 5334. The guiding portion 5334 is provided on both sides of the base portion 5331 and serves to guide the movement of the driving unit 52.

The driving unit 52 comprises a pair of third pivoting parts 521 arranged in parallel with a gap between them, a third connecting part 522 connected to the two third pivoting parts 521, and a pair of guiding members 523 protruded from one third pivoting part 521 towards the direction of the other third pivoting part 521. Each guiding members 523 is arranged on the free end 52B, and the pair of guiding members 523 are spaced apart. Each guiding member 523 matches with the guiding portion 5334, and the states of the driving unit 52 are adjusted by the relative position between the guiding member 523 and the guiding portion 5334.

The guiding unit 533 further comprises a position switching part 5335 protruded from the first extending portion 5332 towards the second extending portion 5333. The position switching part 5335 divides the guiding portion 5334 into a position switching groove 5336 and a position retaining groove 5337. The position retaining groove 5337 is enclosed by the first extending portion 5332, the base portion 5331, and the position switching part 5335. The position switching groove 5336 is formed between the second extending portion 5333 and the position switching part 5335. The position retaining groove 5337 is situated further away from the sliding slot 5123 compared to the position switching groove 5336.

The position switching groove 5336 serves as a transition channel, enabling the guiding member 523 to move from the position retaining groove 5337 to the sliding slot 5123, or vice versa, from the sliding slot 5123 back to the position retaining groove 5337. When the guiding member 523 is located between the position retaining groove 5337 and the sliding slot 5123, the positions and states of the driving unit 52 differ. Preferably, the top surface of the position switching part 5335 is designed to be smooth to enhance smoothness during the position switching process and to prevent jamming.

The adjusting structure 50 includes three states: the sliding state, the locked state, and the closed state.

In the closed state: the guiding unit 533 is located at the starting end of the sliding slot 5123, with both the first adjusting arm 511 and the second adjusting arm 512 folded and closed. The driving unit 52 is accommodated at a smaller inclination angle between the first adjusting arm 511 and the second adjusting arm 512, while the free end 52B is stored underneath the guiding unit 533, in close contact with the second connecting part 5122.

In the locked state: the free end 52B is locked in any of the locking slots 5125, and the driving unit 52 is inclined with respect to the puzzle board 10, which restricts the folding and closing of the first adjusting arm 511 and the second adjusting arm 512. This allows the first adjusting arm 511 and the second adjusting arm 512 to maintain a continuous stable state, thereby keeping the supporting board 4 and the puzzle board 10 inclined. It can be understood that in the locked state, the driving unit 52, the first adjusting arm 511, and the second adjusting arm 512 form a triangular stable structure, which further enhances the stability of the jigsaw puzzle table 1 when the puzzle board 10 is inclined.

In the sliding state: the free end 52B is retained within the position retaining groove 5337. Due to the limiting effect of the position switching unit 5335, the free end 52B cannot enter the sliding slot 5123 through the position switching groove 5336, which prevents it from contacting the second connecting part 5122 and entering the locking slots 5125. As the driving unit 52 moves up and down, the guiding member 523 is received in the position retaining groove 5337 and drives either the first extending portion 5332 or the second extending portion 5333 to move within the sliding slot 5123, causing the guiding unit 533 to slide linearly along the sliding slot 5123.

Switching process from closed or locked state to the sliding state: in the closed or locked state, the free end 52B separates from the guiding portion 5334. The user can lift the supporting board 4 or the puzzle board 10 with their hand, thereby driving the driving unit 52 upwards. During this movement, the driving unit 52 causes the control unit 53 to move linearly up along the sliding slot 5123 until it reaches the end of the sliding slot 5123. As the user continues to lift the supporting board 4 or the puzzle board 10, at least one guiding member 523 can enter the position switching groove 5336. After passing the position switching unit 5335, at least one guiding member 523 enters the position retaining groove 5337, achieving the sliding state. At this point, when the user presses down on the supporting board 4 or the puzzle board 10, the driving unit 52 moves downward to adjust to an appropriate position. Throughout this downward movement, at least one guiding member 523 of the driving unit 52 remains restricted by the first extending portion 5332 and the position switching unit 5335, preventing it from disengaging from the position retaining groove 5337. Therefore, the driving unit 52 will drive the control unit 53 to slide synchronously down/up along the sliding slot 5123, maintaining the sliding state. In this embodiment, when the driving unit 52 and the control unit 53 move to the top end of the sliding slot 5123 (the end of the sliding slot 5123), the guiding member 523 is switched into the position switching groove 5336, thereby achieving the sliding state. In an alternative embodiment, the guiding member 523 may be entered into the position switching groove 5336 at any position along the sliding slot 5123.

Switching process from the sliding state to the locked state: In the sliding state, at least one guiding member 523 is accommodated within the position retaining groove 5337. At this moment, the user lifts the supporting board 4 or the puzzle board 10 with their hand, driving the driving unit 52 to move upward. The free end 52B disengages from the position retaining groove 5337, crosses over the position switching unit 5335, and enters the position switching groove 5336. It then exits from the end of the position switching groove 5336 into the sliding slot 5123. By fine-tuning the position of the driving unit 52, it is aligned with the appropriate locking slots 5125, thus entering the locking state.

Switching process from the sliding state to the closed state: First, the user lifts the supporting board 4 or the puzzle board 10 with their hand, causing the free end 52B to disengage from the locking slots 5125. Then, by pressing down on the supporting board 4 or the puzzle board 10, or utilizing the weight of the supporting board 4 and the puzzle board 10, the driving unit 52 is driven to move downward. The free end 52B travels along the sliding slot 5123 until it reaches the starting end of the sliding slot 5123, entering the closed state.

As the driving unit 52 rotates around the fourth pivoting shaft 541, the guiding portion 5334 is set to an inclined position to better accommodate the movement trajectory of the driving unit 52, facilitating the entry and disengagement of the free end 52B from the guiding portion 5334.

The foot structure 7 comprises a supporting beam 71 and at least one universal wheel 72 connected to the supporting beam 71. In order to enable the entire jigsaw puzzle table 1 to be rolled into the desired position and locked in place, the universal wheels 72 with self-locking switches are mounted at the bottom of the supporting beam 71.

The puzzle drawer 14 is mounted on a shorter transverse side of the puzzle board 10. It is understood that the length of the front of the puzzle board 10 is greater than the length of the shorter transverse side of the puzzle board 10. In other words, the length of the long edge of the puzzle board 10 is greater than the length of the short edge of the puzzle board 10. In practice, the frequency that the user faces the front of the puzzle board 10 to assemble the puzzle pieces 100 is higher than the frequency with which the user faces the side of the puzzle board 10 to assemble the puzzle pieces 100. Furthermore, since the length of the side is smaller than the length of the front, more users may face the front of the puzzle board 10 to assemble the puzzle pieces 100. Therefore, by considering various factors, the jigsaw puzzle table 1 provides the rotating assembly 20 configured for being supportively disposed between the puzzle board 10 and the supporting assembly 3, allowing the puzzle board 10 to rotate smoothly in different planar directions with respect to the supporting assembly 3.

The rotating assembly 20 is sandwiched between the supporting board 4 and the puzzle board 10. The rotating assembly 20 comprises a first moving member 21 mounted on the supporting board 4 and a second moving member 22 rotatably coupled to the first moving member 21 and coupled to the puzzle board 10. It is worth mentioning that the rotating assembly 20 is preferred to be coupled coaxially with the center of gravity of the puzzle board 10, such that the puzzle board 10 can be rotated with respect to the supporting board 4 in a balanced manner. The rotating assembly 20 further comprises a rotor mechanism 23 sandwiched between the first and second moving members 21 and 22, such that when the first moving member 21 is rotated with respect to the second moving member 22 along a rotating axis O, the puzzle board 10 self-rotates 360° with respect to the supporting assembly 3. The supporting board 4 is arranged coaxially with the puzzle board 10 and the rotating assembly 20, ensuring that their centers of gravity are aligned along the rotating axis O of the rotating assembly 20, thereby maintaining the stability of the jigsaw puzzle table 1. When the puzzle board 10 is rotated relative to the supporting assembly 3, the rotating axis O of the rotating assembly 2 coincides with the combined center of gravity of both the puzzle board 10 and the supporting board 4. The rotor mechanism 23 comprises a retainer unit 231 and a plurality of ball-shaped rotors 232 that are rotatably retained within the retainer unit 231. The retainer unit 231 is configured to spacedly retain the plurality of rotors 232 in a rollable manner, allowing each rotor 232 to freely roll on both the first moving frame 210 and the second moving frame 220.

According to this embodiment of the present disclosure, the puzzle board 10 is adapted for being self-rotated 360° via a rotational movement between the first and second moving members 21 and 22. In other words, the user can selectively rotate the puzzle board 10 from one long edge to the opposite long edge or to any one of the short edges without walking around the jigsaw puzzle table 1. For example, the user can assemble one puzzle piece 100 at one side of the puzzle table 100 and then rotate the puzzle board 10 by 180° in order to assemble another puzzle piece 100 on the opposite side of the puzzle board 10, which speeds up the assembly time of the puzzle pieces 100. It should be understood that the rotation angle of the puzzle board 10 can be adjusted to be smaller than 360°. The first moving member 21 comprises a first moving frame 210, a first middle hole 211 surrounded by the first moving frame 210, and a first coupling unit 24 connected with the first moving frame 210. The first coupling unit 24 comprises a first coupling base 241 integrally extended from an inner circumferential surface of the first moving frame 210 towards the rotating axis O of the rotating assembly 20, a first coupling hole 242 formed on the first coupling base 241, and a first coupling portion 243 passed through the first coupling hole 242 and the connecting holes 46 of the supporting portion 43. The first moving member 21 is detachably coupled at the supporting portion 43 by inserting the first coupling portion 243 through the first coupling hole 242 into the supporting portion 43. In order to more stably secure the first moving member 21 to the supporting portion 43, the number of first coupling units can be multiple and arranged with space between them.

The second moving member 22 comprises a second moving frame 220, a second middle hole 221 surrounded by the second moving frame, and a second coupling unit 25 connected to the second moving frame 220. The second coupling unit 25 comprises a second coupling base 251 integrally extended from an inner circumferential surface of the second moving frame 220 towards the rotating axis O of the rotating assembly 20, a second coupling hole 252 formed on the second coupling base 251, and a second coupling portion 253 passed through the second coupling hole 252 and the fixing hole 124 of the puzzle board 10. The second moving member 22 is detachably coupled at the puzzle board 10 by inserting the second coupling portion 253 through the second coupling hole 252 and the fixing hole 124 of the puzzle board 10.

When assembled, the first coupling unit 24 and the second coupling unit 25 are arranged in a staggered manner. The second coupling hole 252 is exposed through the installation window 44. When assembling the second moving member 22 with the puzzle board 10, the second coupling unit 25 can be exposed through the installation window 44 along the assembling direction of the puzzle board 10 and the rotating assembly 20, thereby facilitating the assembly of the second moving member 22 with the puzzle board 10. In order to more stably secure the second moving member 22 to the puzzle board 10, the number of second coupling units can be multiple and arranged with spacing between them.

The first moving member 21 and the supporting assembly 3 can be secured together using various methods such as threads, snap-fit, and friction fit. Similarly, the second moving member 22 and the puzzle board can be secured together using the same methods. Therefore, the first and second coupling portions 243 and 253 can be selected from screws, rivets, or similar fasteners. The fixing hole 124 of the puzzle board 10 can be set before assembly or formed during the assembly process of the puzzle board 10 and the second moving member 22. The connecting hole 46 of the supporting board 40 can likewise be set before assembly or formed during the assembly process of the supporting board 40 and the first moving member 21. The extending directions of the first and second coupling bases may be opposite. For example, the first coupling bases may extend from an outer circumferential surface of the first moving frame away from the rotating axis of the rotating assembly.

The outline of the supporting unit 41 is larger than that of the rotating assembly 20. Looking up from the bottom of the jigsaw puzzle table 1, except for the second coupling hole 252 of the rotating assembly 20, which is exposed through the installation window 44, the other structures of the rotating assembly 20 are completely covered by the supporting unit 41. The purpose of the installation window 44 is to allow the assembler to observe the second coupling unit 25 during the assembly process, enabling the assembler to install the rotating assembly 20 onto the puzzle board 10 along the assembling direction A1.

The installation method for the jigsaw puzzle table 1 is as follows: First, assemble the rotating assembly 20 with the supporting board 4. Specifically, Prepare the supporting board 4, but do not install the puzzle drawer 14 first. Position the upper surface of the supporting unit 41 of the supporting board 4 facing the assembler, and then place the rotating assembly 20 on the supporting portion 43. Insert the first coupling portion 243 into the connecting hole 46 of supporting board 4 to secure the rotating assembly 20 to the supporting board 4, thereby obtaining a combination of the rotating assembly 20 and the supporting board 4. A fixing direction B1 of the rotating assembly 20 on the supporting portion 43 differs from the assembling direction A1 of the puzzle board 10 and the rotating assembly 20. In this embodiment, the fixing direction B1 and the assembling direction A1 are completely opposite.

Next, manually rotate the second moving member 22 to adjust the set position of the second coupling hole 252 so that the assembler can observe the second coupling hole 252 through the drawer cavity 13 and the installation window 44. When manually rotating the second moving member 22, the first moving member 21 remains fixed relative to the supporting board 4 and does not rotate; therefore, the second moving member 22 will rotate relative to the first moving member 21, allowing for the adjustment of the set position of the second coupling hole 252. If, after completing the previous step, the assembler can observe the second coupling hole 252 from the installation window 44, this step may not be necessary.

Finally, assemble the combined structure of the rotating assembly 20 and the supporting board 4 with the puzzle board 10. Specifically, position the puzzle plate 11 of the puzzle board 10 facing away from the assembler. Observe the alignment of the fixing hole 124 on the puzzle board 10, ensuring that the second coupling hole 252 and fixing hole 124 align by looking through installation window 44 and drawer cavity 13. Insert the second coupling portion 253 into both second coupling hole 252 and fixing hole 124 to secure rotating assembly 20 to puzzle board 10. Lastly, install the puzzle drawer 14 into the drawer cavity 13.

The jigsaw puzzle table 1 further comprises a rotating locking assembly 27, which is used to limit the rotation between the puzzle board 10 and the supporting board 4. It can be understood that the rotating assembly 20 can drive the puzzle board 10 to rotate in order to adjust the position of the puzzle board 10. However, this process should only occur when it is necessary to rotate the puzzle board 10. When there is no need to rotate the puzzle board 10, the puzzle board 10 should remain in a stable state to avoid any rotation or shaking that could affect the puzzle operation.

Specifically, the rotating locking assembly 27 is used to secure the supporting board 4 to the puzzle board 10, thereby indirectly achieving the goal of limiting the relative rotation between the first moving member 21 and the second moving member 22. It can be understood that the supporting board 4 is fixed to the first moving member 21, and the puzzle board 10 is fixed to the second moving member 22. When a fixation is formed between the supporting board 4 and the puzzle board 10, both the first moving member 21 and the second moving member 22 are simultaneously fixed and cannot produce relative rotation.

The rotating locking assembly 27 comprises a locking part 272 formed on the puzzle board 10 and a contacting portion 271 passed through the supporting portion 43 of the supporting board 4 and detachably connected to the locking part 272. When the contacting portion 271 is connected with the locking part 272, the puzzle board 10 cannot rotate relative to the supporting portion 43. When the contacting portion 271 is separated from the locking part 272, the puzzle board 10 can freely rotate relative to the supporting portion 43 under the drive of the rotating assembly 20.

In this embodiment, the rotating locking assembly 27 is a bolt, which includes a screw 271 (the contacting portion) and a nut 272 (the locking part). One end of the screw 271, which is away from the nut 272, is provided with a bolt head 2711 located beneath the supporting portion 43 of the supporting board 4. The nut 272 is anchored within the puzzle board 10, and the screw 271 passes through the supporting portion 43 of the supporting board 4 and is threadedly connected to the nut 272, achieving the fastening of the supporting board 4 and the puzzle board 10. The number of rotating locking assemblies 27 is preferably two, symmetrically arranged on both sides of the puzzle board 10, so that both sides of the puzzle board 10 are restricted, thus enhancing stability.

The jigsaw puzzle table 1 can be adjusted to a higher or lower position by modifying the height of the board bracket 6. The puzzle board 10 can be rotated on the supporting assembly 3 through a rotational movement of the rotating assembly 20. And the tilt angle of the puzzle board 10 of the jigsaw puzzle table 1 can be altered by controlling the adjusting structure 50 while it is in the locked state.

FIGS. 38-49 show a jigsaw puzzle table 1' of a second embodiment of the present disclosure. The jigsaw puzzle table 1' is arranged for a user or player to assemble a plurality of puzzle pieces 100' thereon. Accordingly, the jigsaw puzzle table 1' comprises a puzzle board 10', a rotating assembly 20' attached to the puzzle board 10', and a supporting assembly 3'. The rotating assembly 20' is mounted between the puzzle board 10' and the supporting assembly 3'. The puzzle board 10' and the rotating assembly 20' are supported by the supporting assembly 3', respectively. The supporting assembly 3' is capable of adjusting the height of the jigsaw puzzle table 1'.

The second embodiment is similar to the first embodiment of the present disclosure except for the following: (1) the supporting board 4' of the first embodiment can be omitted; in this embodiment, the puzzle board 10' is directly mounted on the lower frame 5' of the first embodiment. (2) The drawer cavity 13' and the puzzle drawer 14' are incorporated into the puzzle board 10'. (3) The tilting function is arranged on the puzzle board 10'.

The puzzle board 10' includes a puzzle plate 11', a supporting board 15', and an adjusting structure 50'. The puzzle plate 11' is hinged with the supporting board 15'. The adjusting structure 50' is located between the puzzle plate 11' and the supporting board 15'. The puzzle plate 11' can be switched, via the adjusting structure 50', between a state in which the puzzle plate 11' is placed flat on the support plate 11' and a state in which the puzzle plate 11' is tilted at an angle with respect to the supporting board 15'.

One end of the puzzle plate 11' is hinged to one end of the supporting board 15', forming a hinged portion. The adjusting structure 50' is disposed below a portion of the puzzle plate 11' away from the hinged portion. Specifically, one end of the adjusting structure 50' is hingedly connected to either the puzzle plate 11' or the supporting board 15'.

One end of the adjusting structure 50' is hinged to the puzzle plate 11' for allowing the puzzle board 10' to be supported in an inclined position (a locked state). A carrying handle 54' is mounted on a top surface of the puzzle plate 11'. The carrying handle 54' is located on an end of the puzzle plate 11' away from the hinged portion. The adjusting structure 50' comprises a driving unit 52' and a limiting strip 55' having a limiting slot 56'. The driving unit 52' of the adjusting structure 50' is adapted to fit into the limiting slot 56'. When in use, the carrying handle 54' is held by a user's hand, and the puzzle plate 11' is pulled upward from the supporting board 15'. Subsequently, the adjusting structure 50' at the bottom of the puzzle plate 11' may swing at a certain angle to enable an end portion thereof to be received in the limiting slot 56'. In this way, the puzzle plate 11' is tilted at a certain angle, allowing the user to play with the puzzle pieces 100'. The adjusting structure 50' is placed on the supporting board 15' to abut against the bottom surface of the puzzle plate 11', thereby inclining the puzzle plate 11' with respect to the supporting board 15'.

The puzzle board 10' further comprises a reinforcing arm 45' connected to the supporting board 15' for forming at least one drawer cavity 13' and at least one puzzle drawer 14' received in the corresponding drawer cavity 13'. The reinforcing arm 45' comprises a pair of inner reinforcing portions 451' spaced apart from each other for forming an inner receiving space 452' and a pair of dividing reinforcing portions 453' connected to the corresponding inner reinforcing portion 451' and extending away from the inner reinforcing portion 451'. The reinforcing arm 45' further comprises at least one fixing hole 124' formed on the inner reinforcing portions 451' and coupled with the second coupling unit 25'.

The supporting assembly 3' comprises a board bracket 6' and a foot structure 7' connected to the board bracket 6'. The board bracket 6' comprises a supporting portion 43', an upper bracket 62' connected to the supporting portion 43', a lower bracket 63' positioned below the upper bracket 62', an adjusting bracket 64' connecting the upper and lower brackets 62' and 63'. The rotating assembly 20' is detachably coupled to both the puzzle board 10' and the supporting portion 43' of the supporting assembly 3'. At least part of the rotating assembly 20' is exposed through the supporting portion 43'. The supporting portion 43' comprises a main frame 322', a fastening arm 323' connected with the main frame 322' for enhancing the strength of the main frame 322' and an installation window 44' surrounded by the main frame 322' and the fastening arm 323'. The main frame 322' has a closed annular shape. In an alternative embodiment, the main frame 322' can have a semi-enclosed structure or it can be omitted. The upper bracket 62' is directly connected to the fastening arm 323'. At least part of the rotating assembly 20' is exposed outside the outline of the fastening arm 323' of the supporting portion 43'.

The structure of the rotating assembly 20' in the first embodiment is completely identical to that of the second embodiment. The rotating assembly 20' of the second embodiment comprises a first moving member 21' detachably coupled to the supporting portion 43' along a fixing direction B1' and a second moving member 22' detachably coupled to the reinforcing member 45' of the puzzle board 10' along an assembling direction A1'. The first moving member 21' comprises a first coupling unit 24' fixed on the fastening arm 323' of the supporting portion 43' along the fixing direction B1'. The second moving member 22' comprises a second coupling unit 25' fixed on the inner reinforcing portions 451' of the puzzle board 10' along the assembling direction A1'. In an alternative embodiment, the second coupling unit 25' may be fixed to the dividing reinforcing portions 453' that have the fixing hole 124', as long as it secures the second moving member 22' to the puzzle board 10'. The first coupling unit 24' comprises a first coupling hole 242' and a first coupling portion 243' passed through the first coupling hole 242' and fixed on the supporting portion 43'. The second coupling unit 25' comprises a second coupling hole 252' and a second coupling portion 253' passed through the second coupling hole 252' and fixed on the puzzle board 10'.

In order to ensure the stability of the rotation of the puzzle board 10', the rotating assembly 20' should be sufficiently sized. Therefore, to facilitate the installation of the second coupling unit 25' on the puzzle board 10', the second coupling unit 25' is positioned further away from a rotating axis of the rotating assembly 20' than the fastening arm 323'. To facilitate the installation of the second coupling unit 25' onto the puzzle board 10', the second coupling unit 25' is positioned to be visible through the fastening arm 323'. This arrangement ensures that, during the assembly of the rotating assembly 20' and the puzzle board 10', the assembler has an unobstructed view of the fastening arm 323', enabling the second coupling unit 25' to be installed onto the puzzle board 10'.

To ensure the stability of the puzzle board 10' during rotation, it is preferable for the rotating assembly 20' to be slightly larger. Consequently, the second coupling unit 25' is positioned further from the rotating axis of the rotating assembly 20' than the fastening arm 323' to ease its installation onto the puzzle board 10'. Additionally, the second coupling unit 25' is arranged in such a way that it remains visible through the fastening arm 323'. This configuration guarantees that, when assembling the rotating assembly 20' with the puzzle board 10', the assembler has a clear line of sight to the fastening arm 323', facilitating the installation of the second coupling unit 25' onto the puzzle board 10'.

The fastening arm 323' comprises a pair of fastening beams 3231' spaced apart from each other for forming a middle space 3232' passed through the rotating axis of the rotating assembly 20'. Along an assembling direction A1' of the puzzle board 10' and the rotating assembly 20', the projections of the installation window 44' and the middle space 3232' on the puzzle board 10' do not overlap. The second coupling unit 25' is located outside the pair of fastening beams 3231'. In other words, the second coupling unit 25' is located outside of the middle space 3232'. The fastening arm 323' further comprises a connecting hole 46' communicated with the first coupling hole 242' for being engaged with the first coupling portion 243'.

The installation method for the jigsaw puzzle table 1' is as follows: First, assemble the rotating assembly 20' with the supporting assembly 3'. Specifically, position the upper surface of the supporting portion 43' facing the assembler. Observe the positioning of the connecting holes 46' of the supporting portion 43', and then place the rotating assembly 20' on the fastening arm 323' of the supporting portion 43' so that the first coupling hole 242' of the rotating assembly 20' aligns with the connecting holes 46' of the supporting portion 43'. Finally, insert the first coupling portion 243' into the first coupling hole 242' and the connecting holes 46' to secure the rotating assembly 20' to the supporting portion 43' along the fixing direction B1', thus forming a combination of the rotating assembly 20' and the supporting portion 43'.

Next, manually rotate the second moving member 22' to adjust the set position of the second coupling hole 252' so that the assembler can observe that the second coupling hole 252' is exposed from the fastening arm 323' of the supporting portion 43'. When manually rotating the second moving member 22', the first moving member 21' remains fixed relative to the fastening arm 323' and does not rotate; thus, the second moving member 22' will rotate relative to the first moving member 21'. If the assembler can already see the second coupling hole 252' exposed from the fastening arm 323' after completing the previous step, this step may not be necessary.

Finally, assemble the combined structure of the rotating assembly 20' and the puzzle board 10'. Specifically, position the puzzle board 10' facing away from the assembler. Observe the alignment of the fixing hole 124', and ensure that the second coupling hole 252' aligns with the fixing hole 124' by checking that the second coupling hole 252' is exposed from the fastening arm 323' along the assembling direction A1'. Finally, insert the second coupling portion 253' into the second coupling hole 252' and the fixing hole 124' along the assembling direction A1' to secure the rotating assembly 20' onto the puzzle board 10'.

Figure 39:
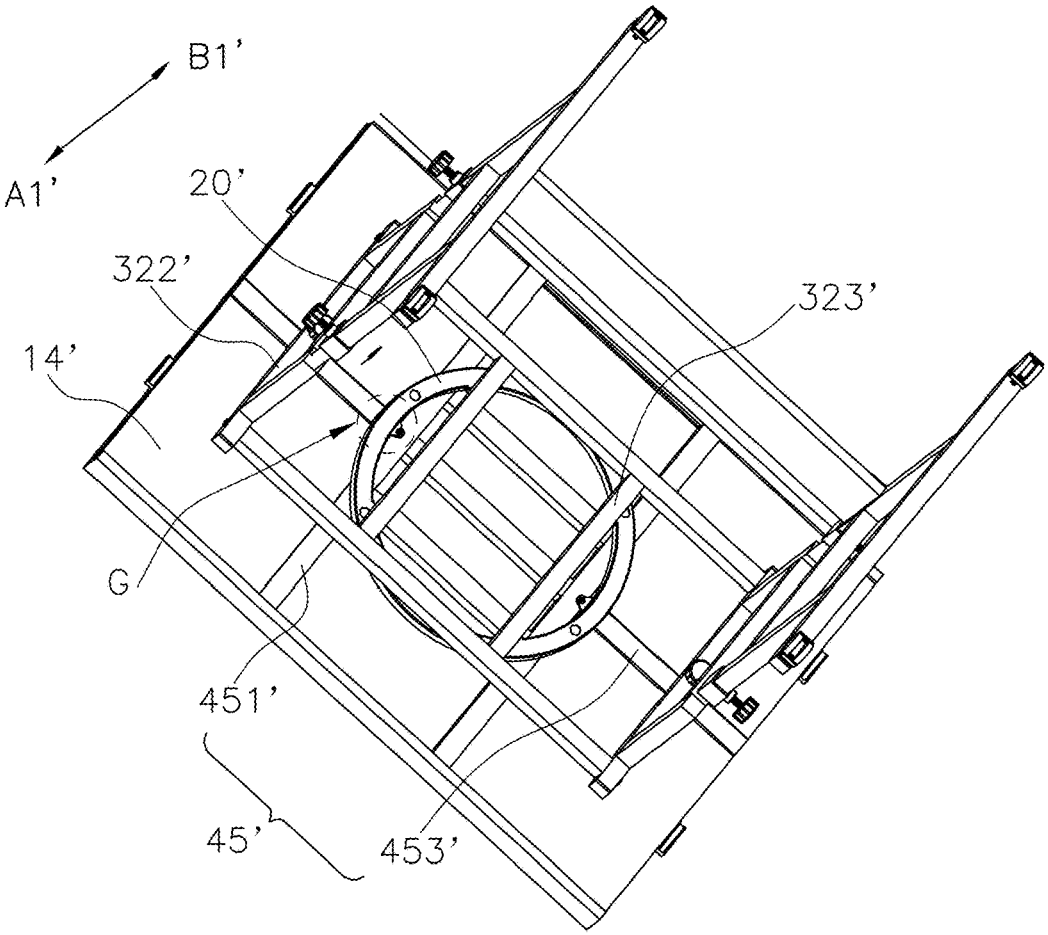
FIG. 39 is an illustrative isometric view of the jigsaw puzzle table shown in FIG. 38, but from another aspect.
Figure 40:
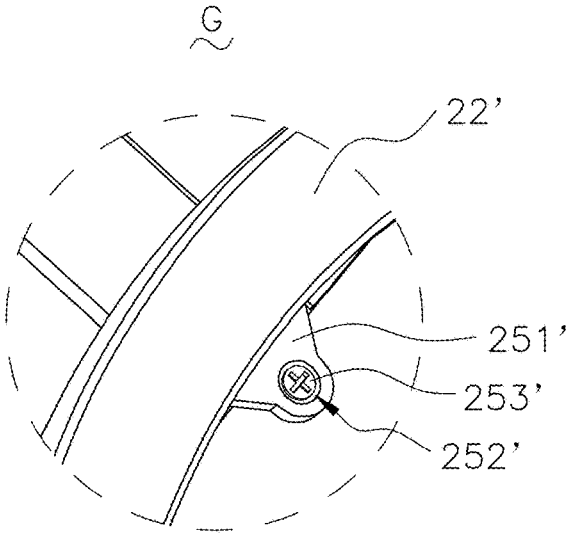
FIG. 40 is an enlarged view of Part G in FIG. 39.
Figure 41:
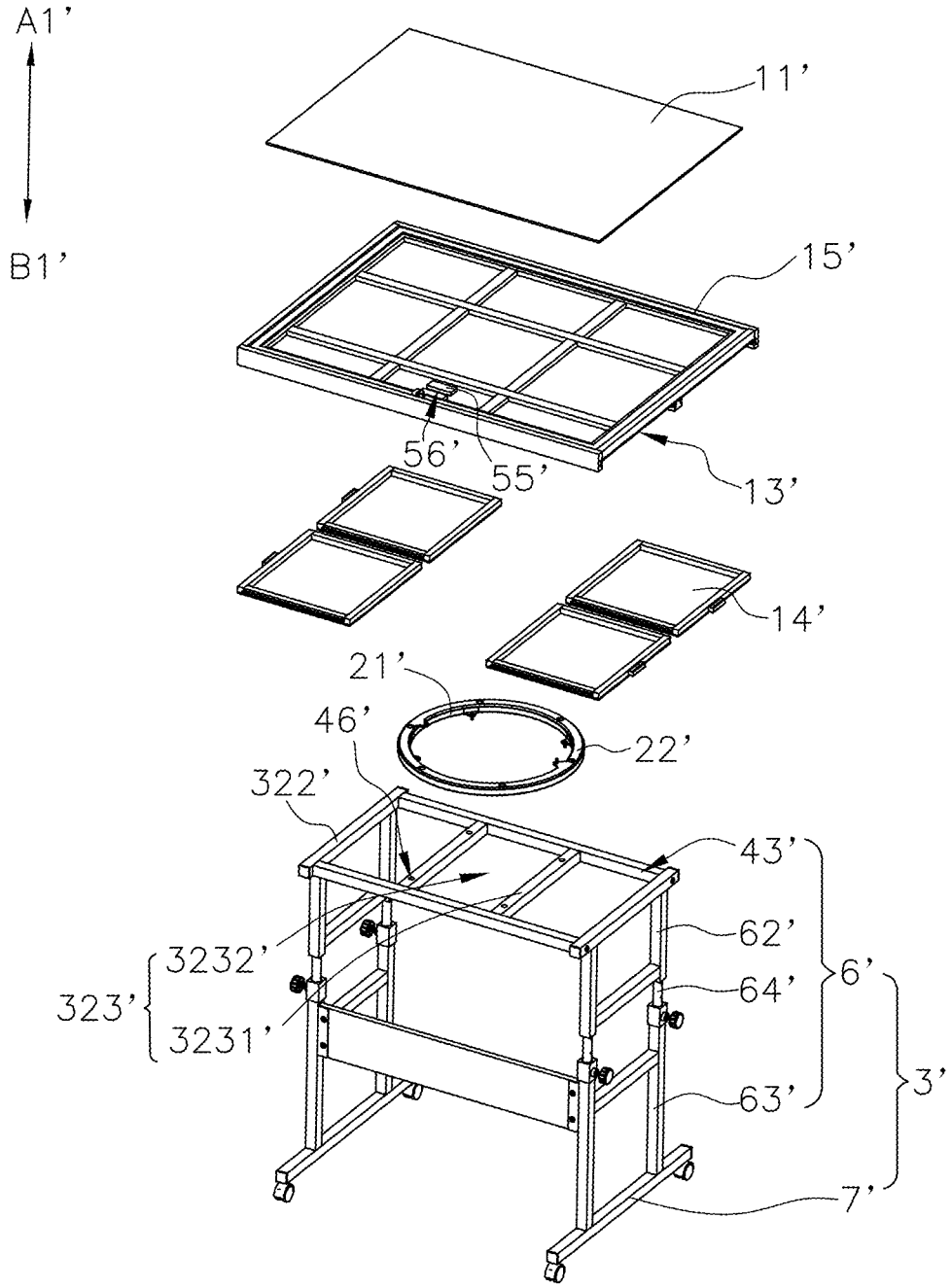
FIG. 41 is a partial exploded perspective view of the jigsaw puzzle table shown in FIG. 38.
Figure 42:
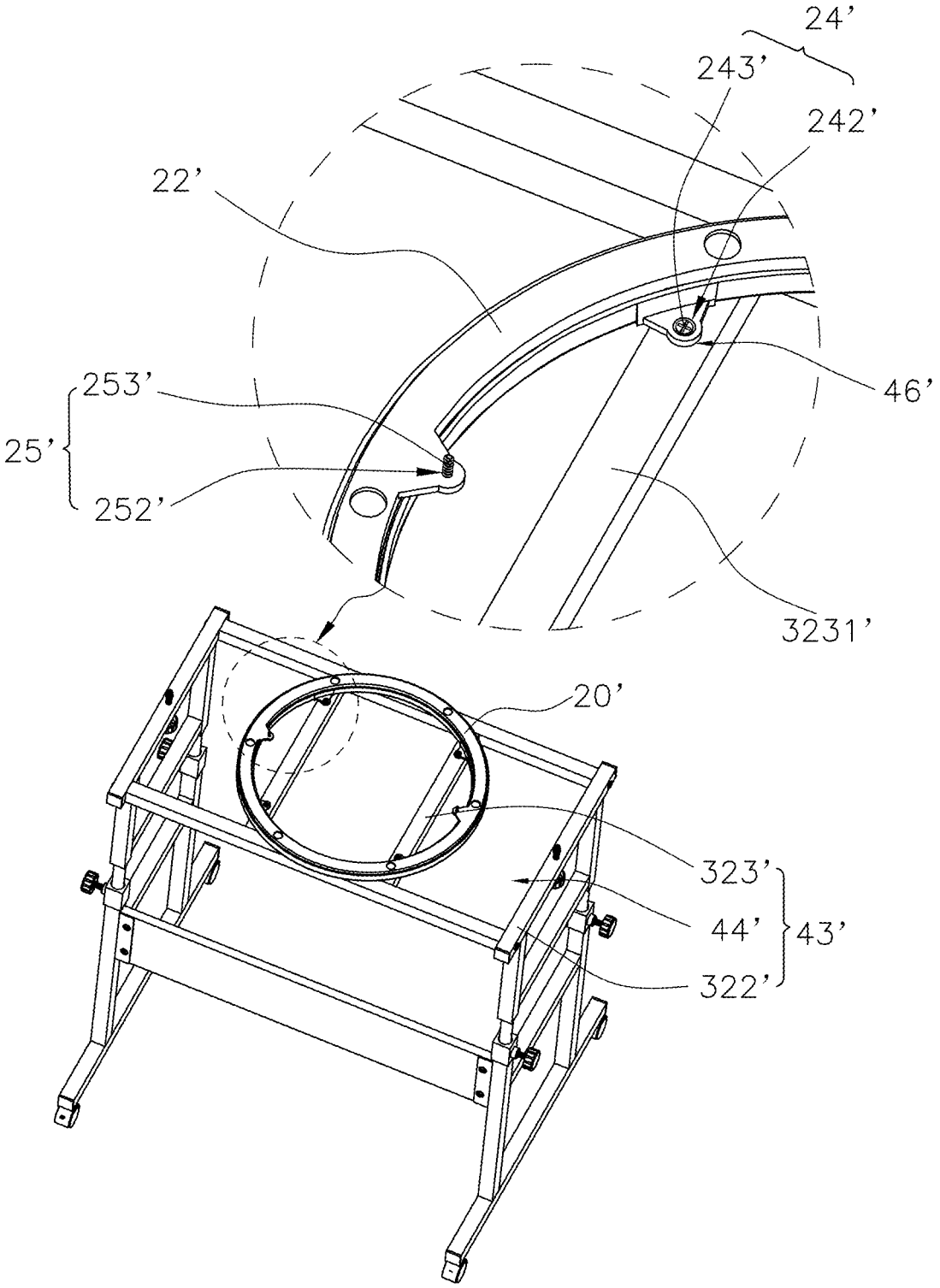
FIG. 42 is an illustrative isometric view of a rotating assembly and a supporting assembly of the jigsaw puzzle table shown in FIG. 38.
Figure 43:
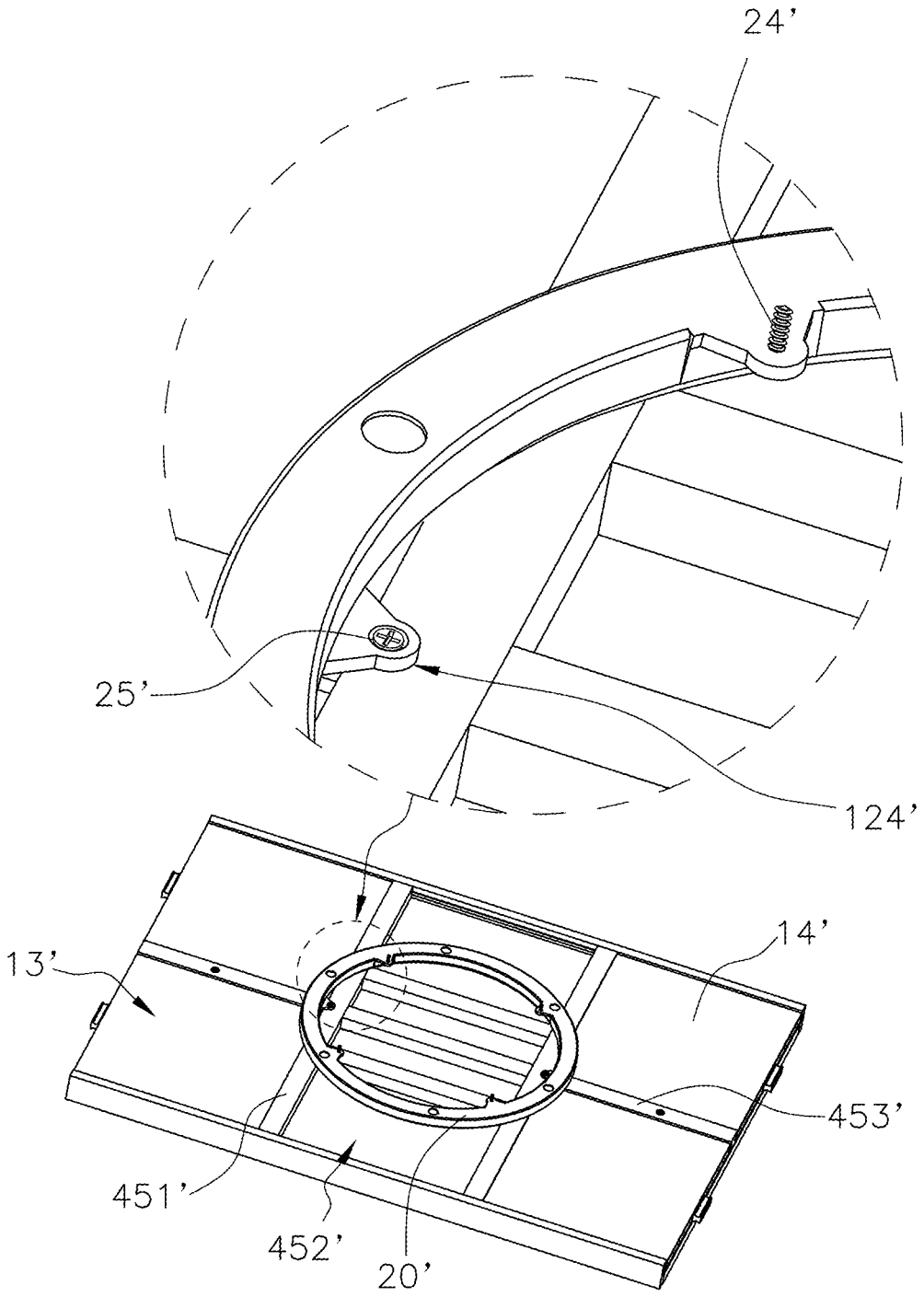
FIG. 43 is an illustrative isometric view of the rotating assembly and a puzzle board of the jigsaw puzzle table shown in FIG. 38.
Figure 44:
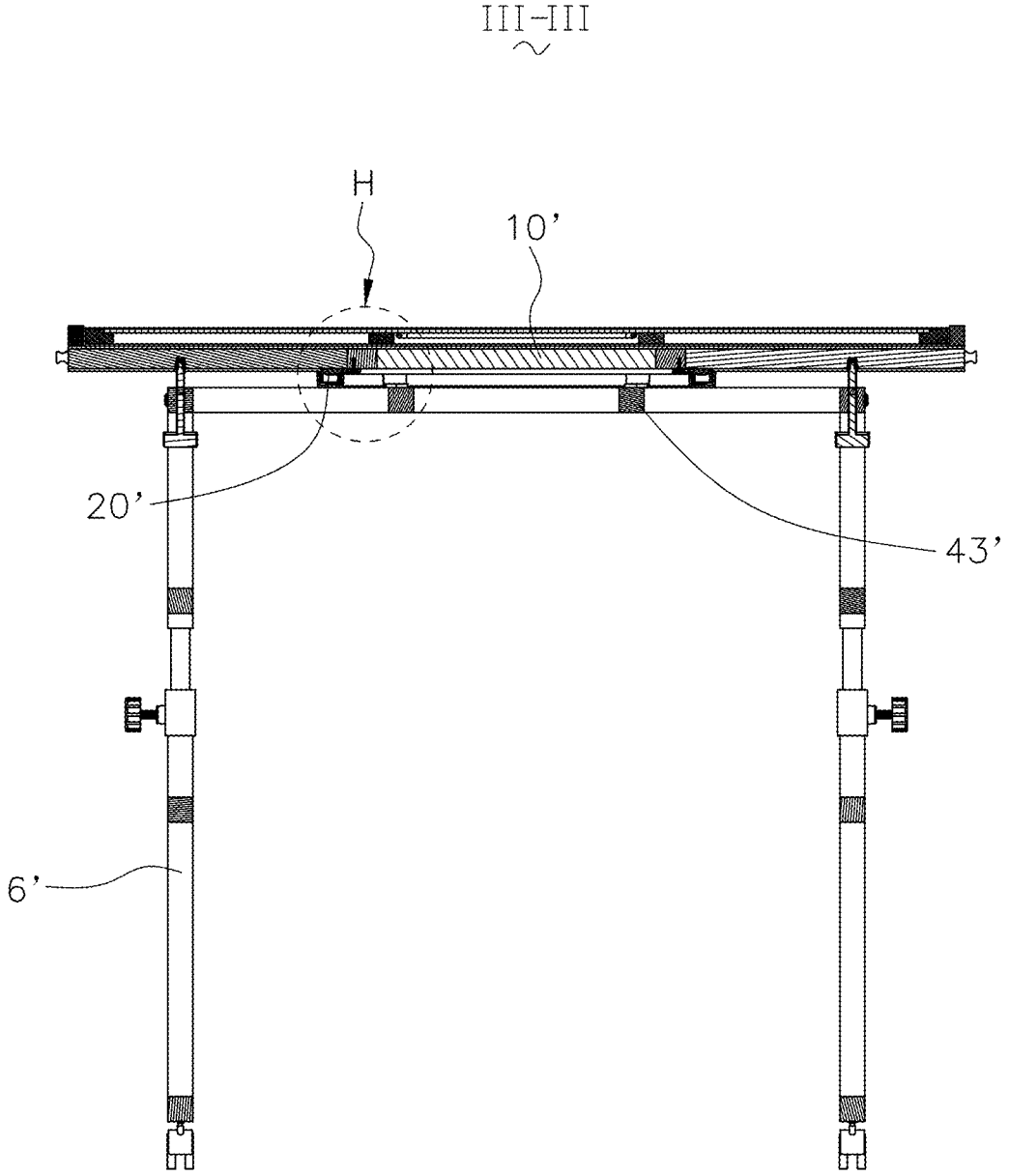
FIG. 44 is an illustrative cross-sectional view of the puzzle board of the jigsaw puzzle table taken along line III-III of FIG. 38.
Figure 45:
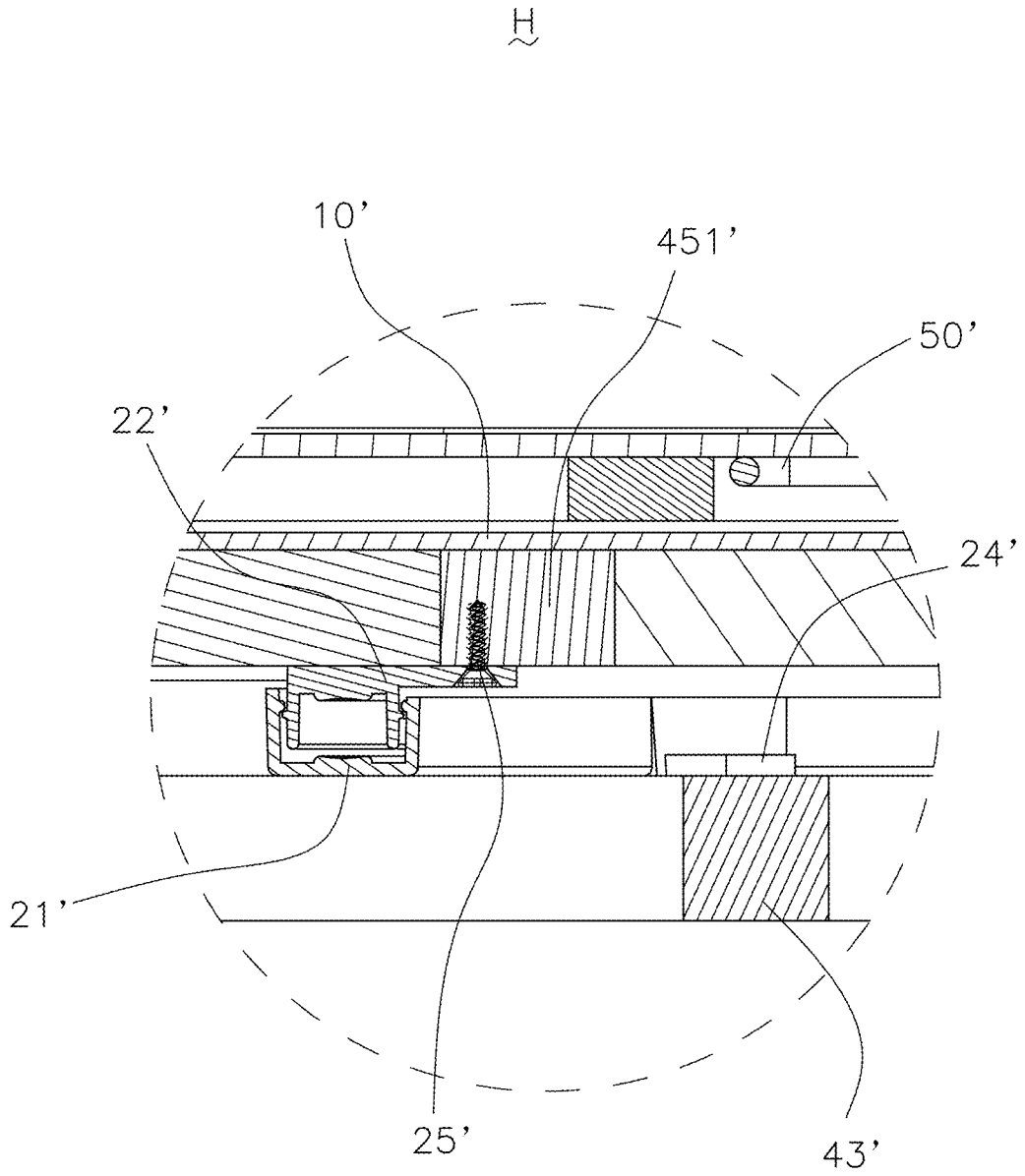
FIG. 45 is an enlarged view of Part H in FIG. 44.
Figure 46:
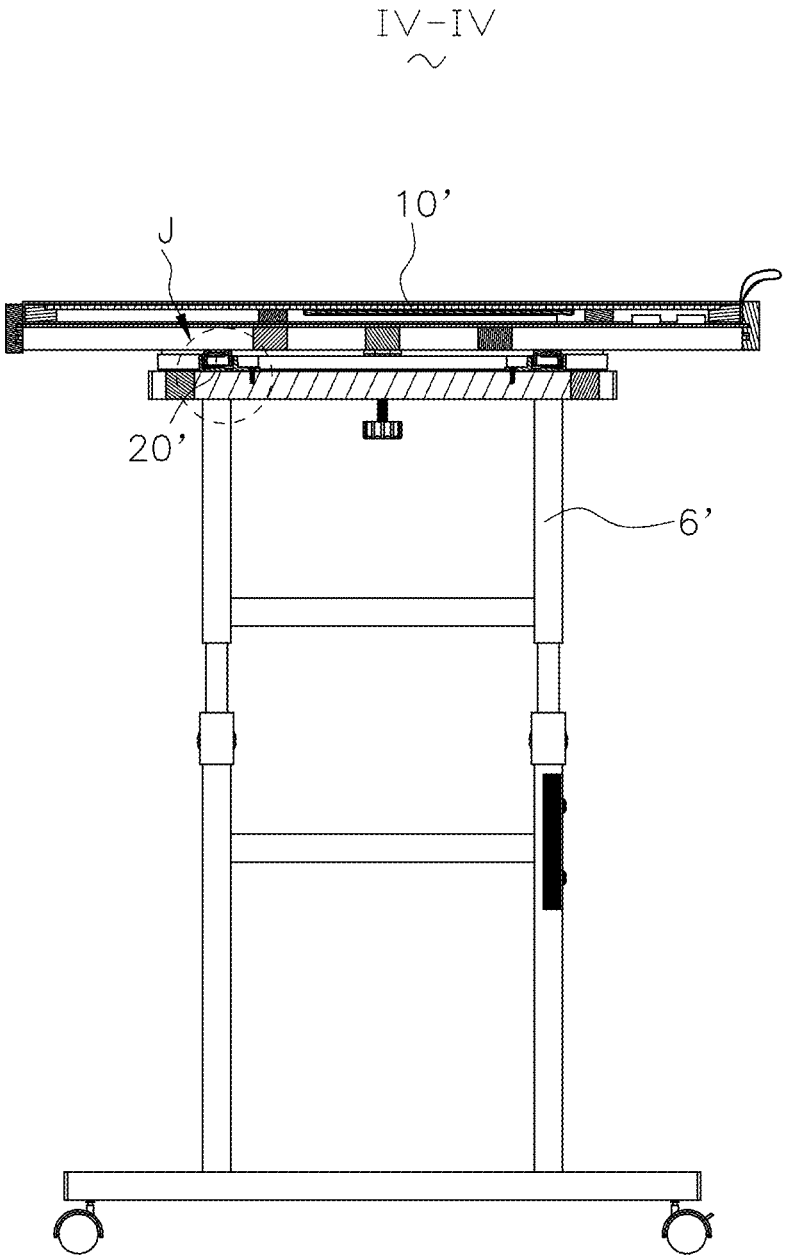
FIG. 46 is an illustrative cross-sectional view of the puzzle board of the jigsaw puzzle table taken along line IV-IV of FIG. 38.
Figure 47:
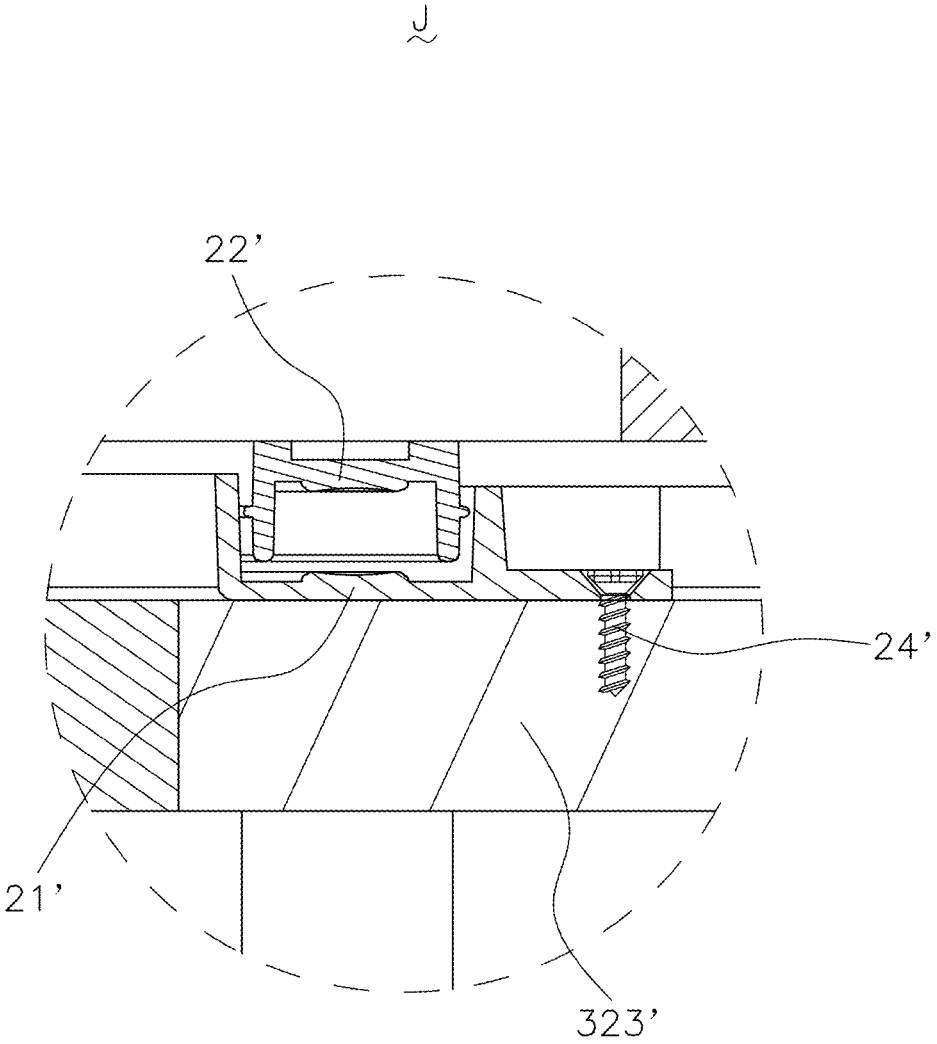
FIG. 47 is an enlarged view of Part J in FIG. 46.
Figure 48:
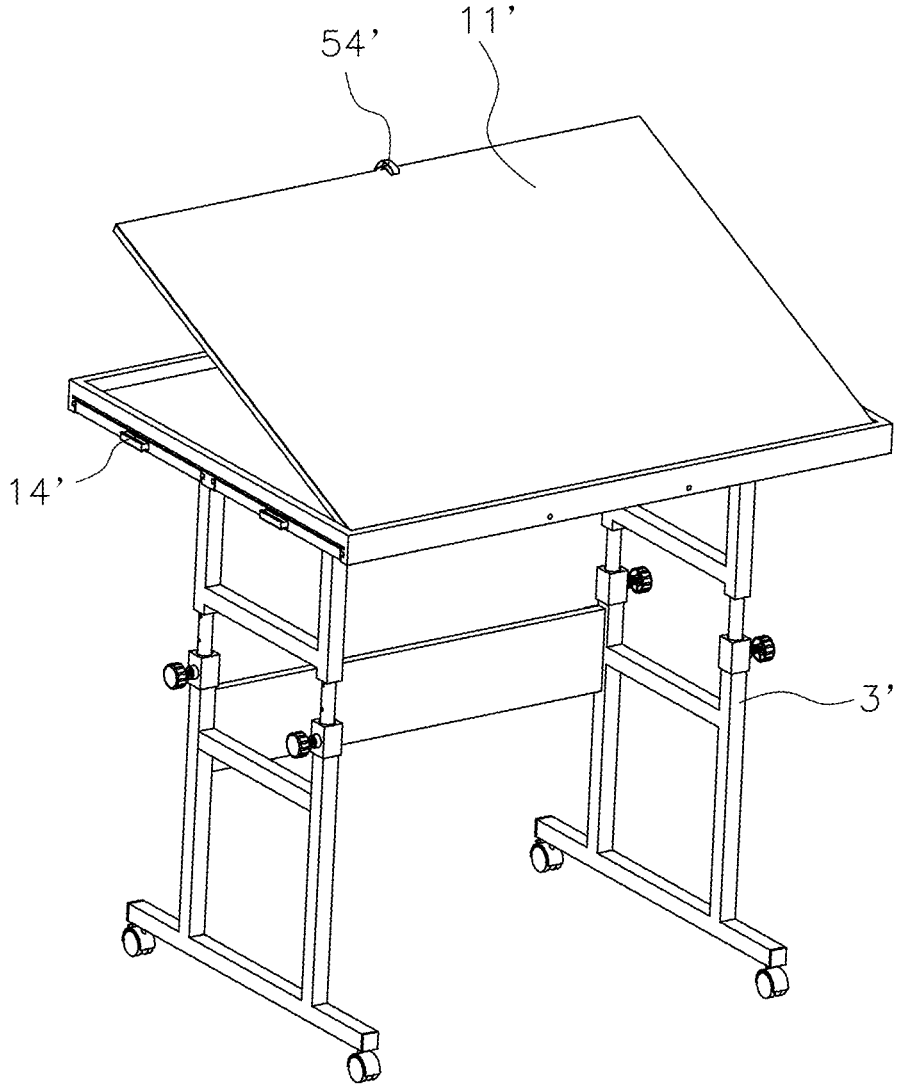
FIG. 48 is an illustrative isometric view of the jigsaw puzzle table of FIG. 38, illustrating the puzzle board tilted at a certain angle and in a locked state.
Figure 49:
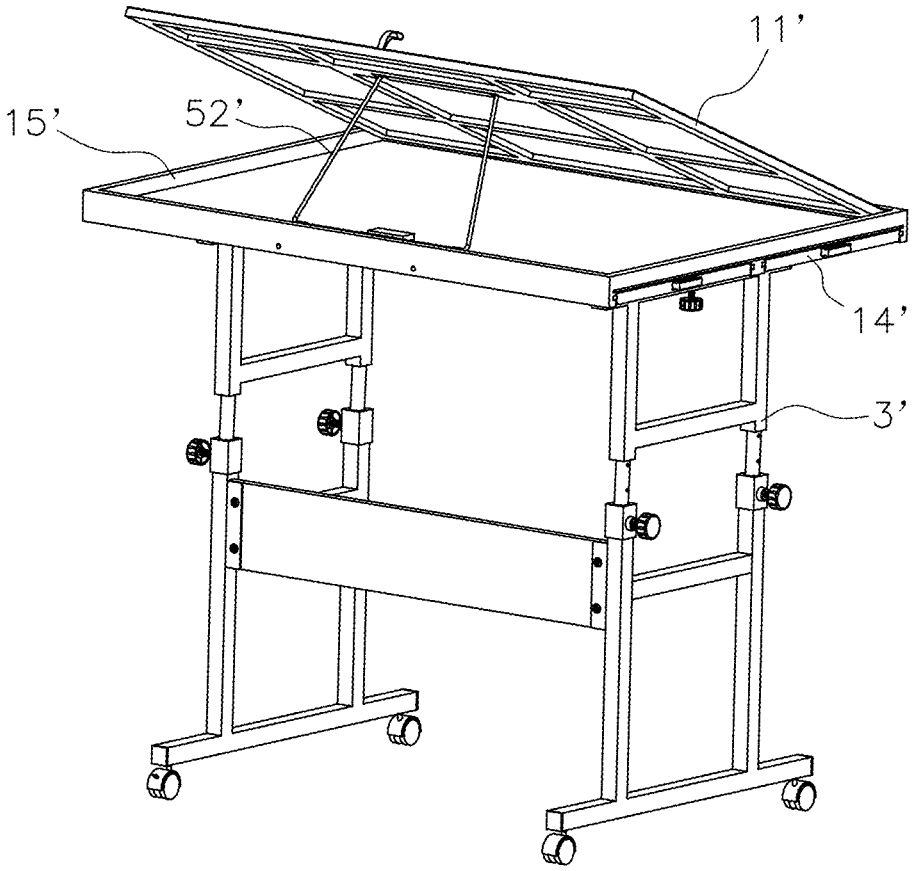
FIG. 49 is similar to FIG. 48, but from another aspect.
Figure 50:
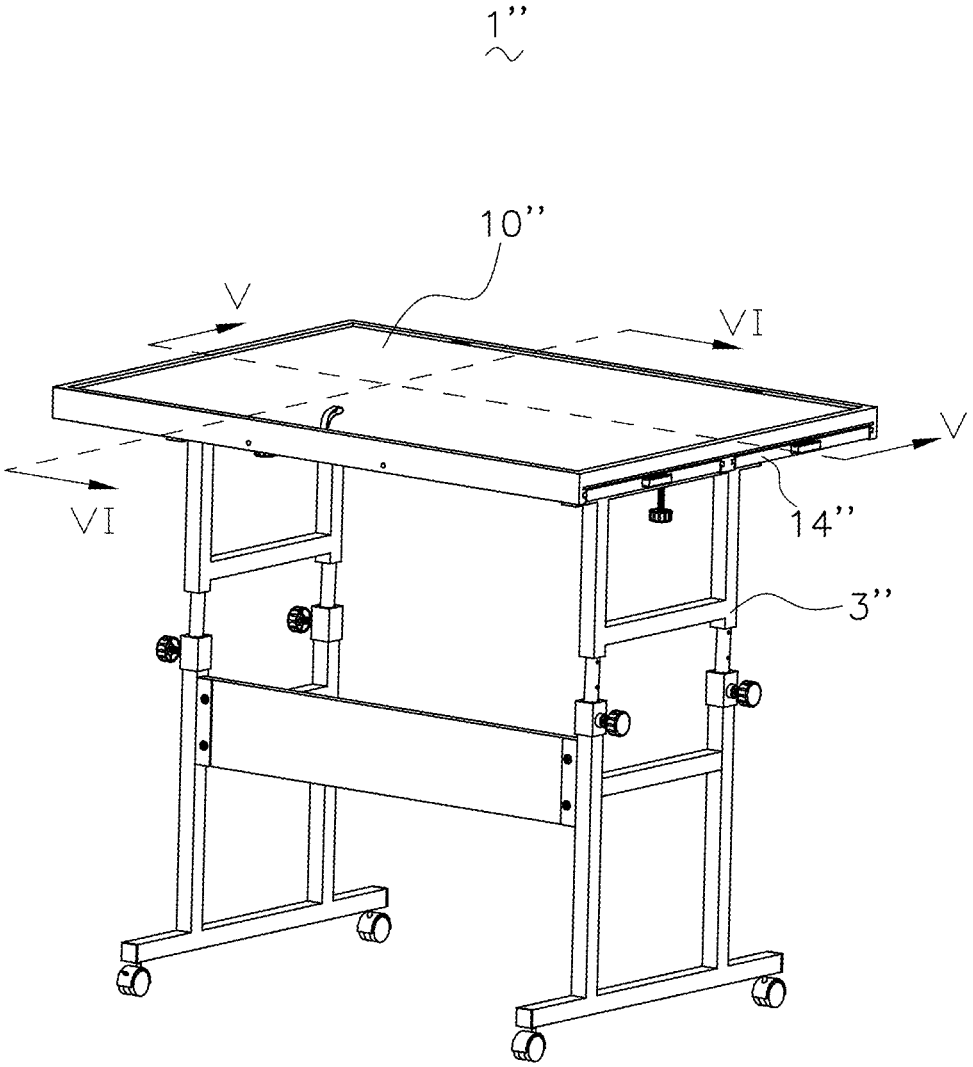
FIG. 50 is an illustrative isometric view of the jigsaw puzzle table according to a third embodiment of the present disclosure.
Figure 51:
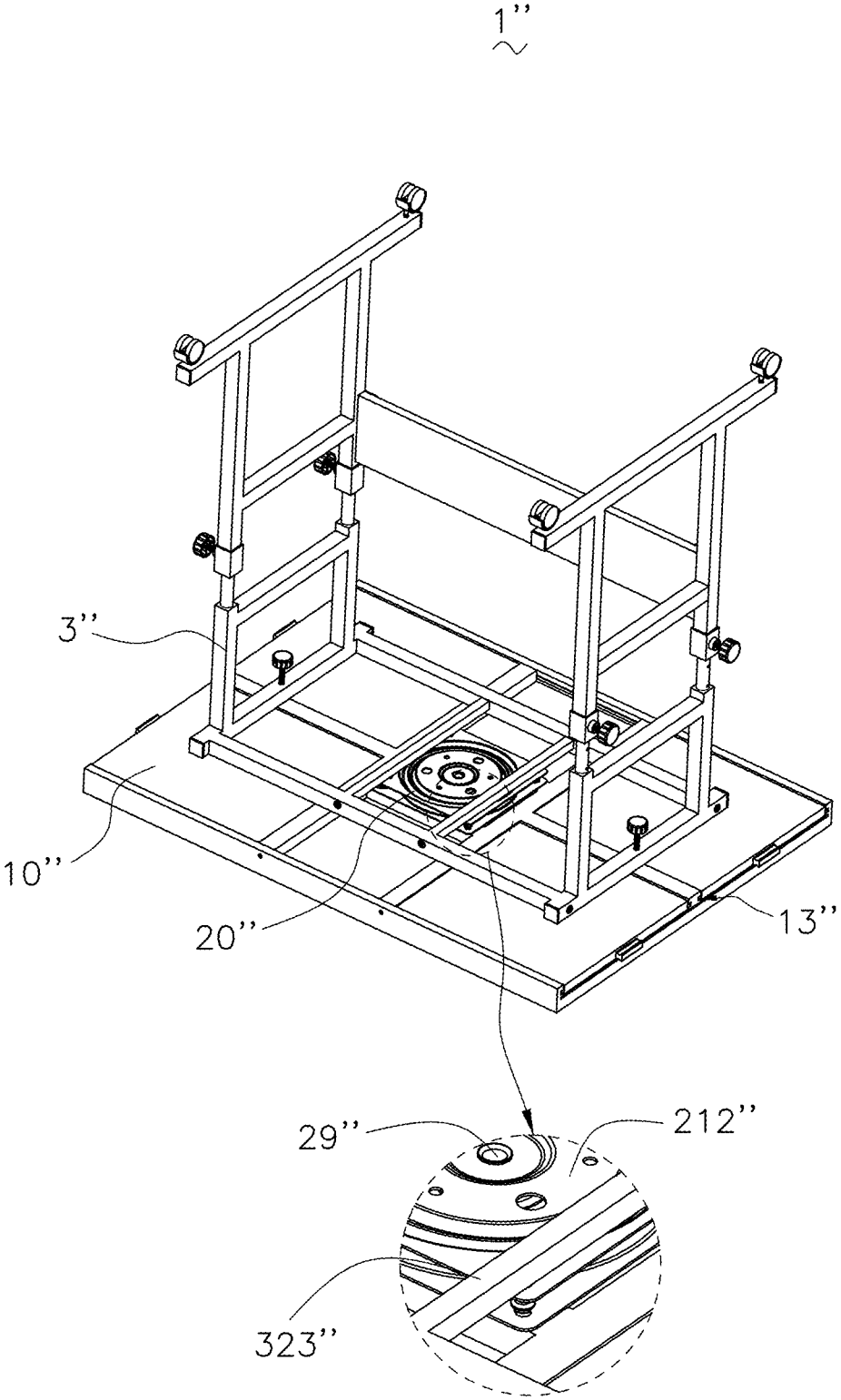
FIG. 51 is an illustrative isometric view of the jigsaw puzzle table shown in FIG. 50, but from another aspect.
Figure 52:
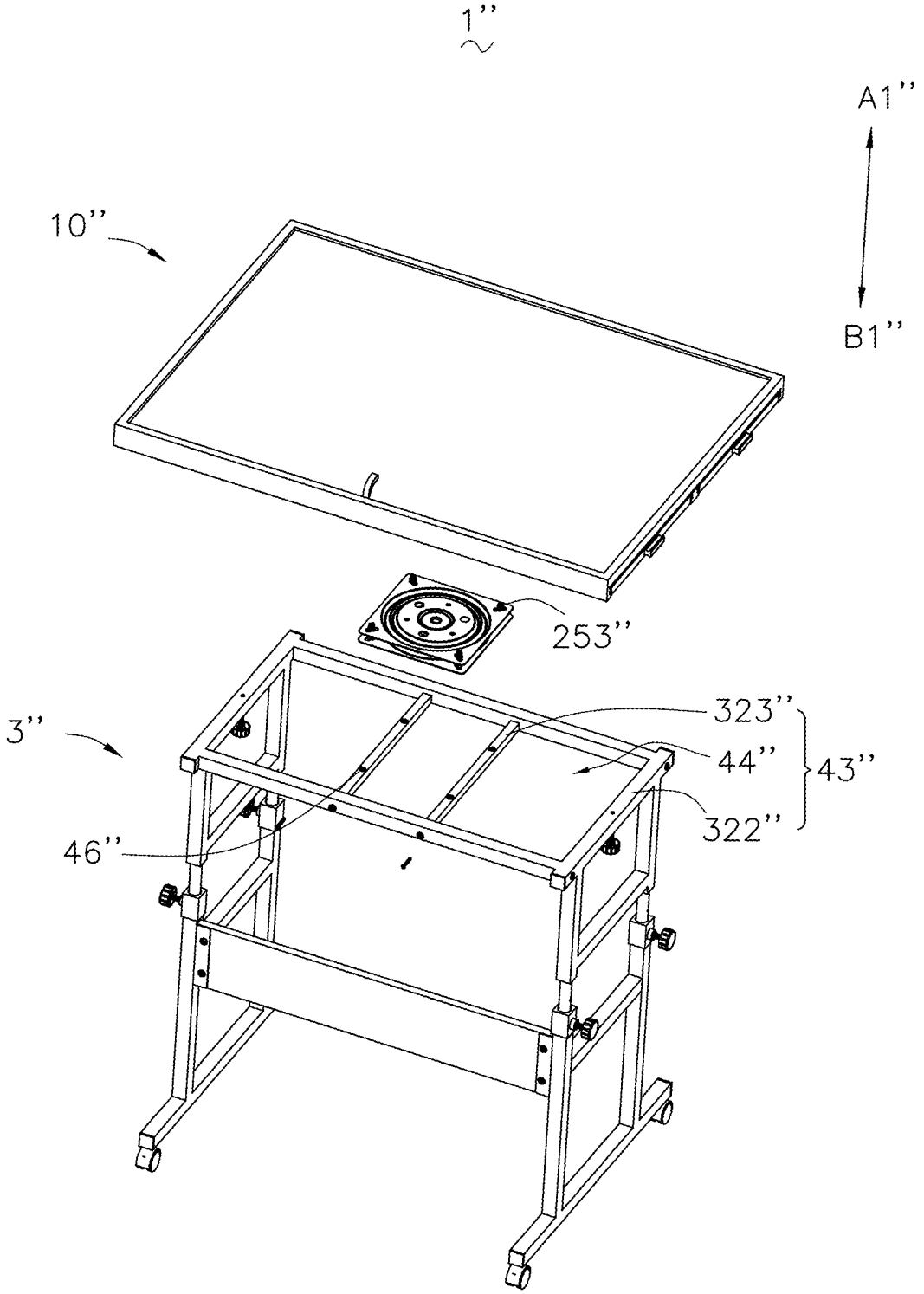
FIG. 52 is a partial exploded perspective view of the jigsaw puzzle table shown in FIG. 50.
Figure 53:
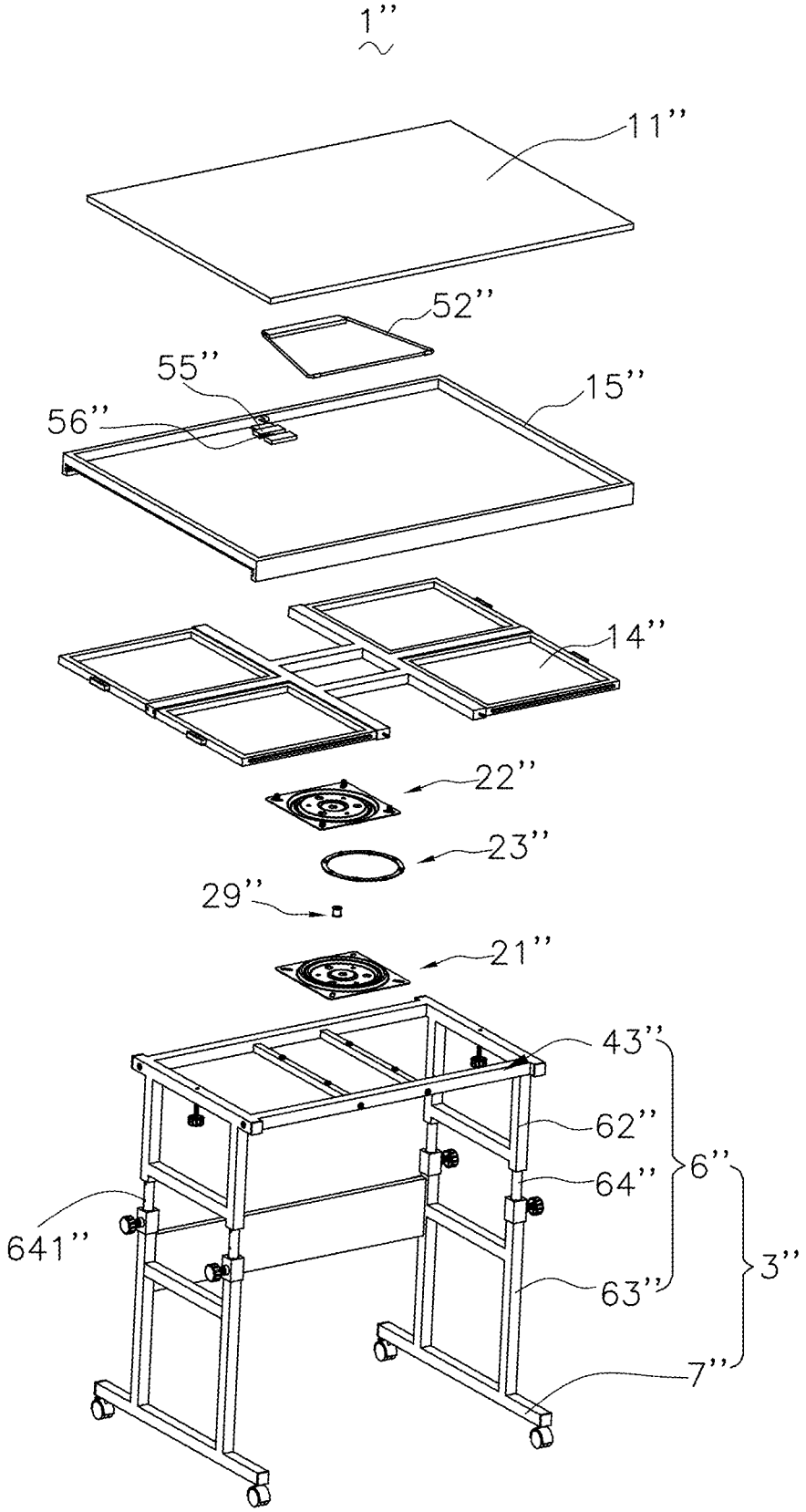
FIG. 53 is a partial exploded perspective view of the jigsaw puzzle table shown in FIG. 52.
Figure 54:
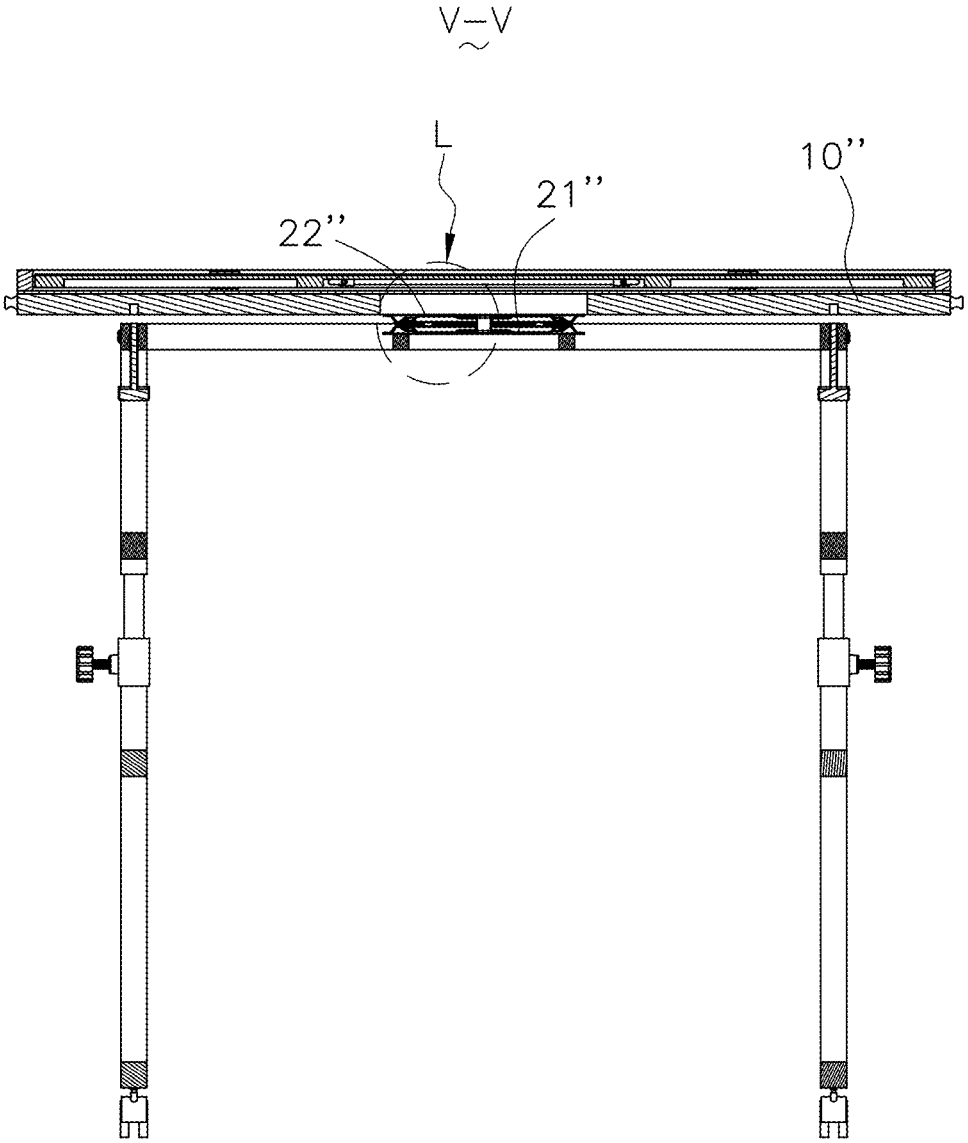
FIG. 54 is an illustrative cross-sectional view of the jigsaw puzzle table taken along line V-V of FIG. 50.
Figure 55:
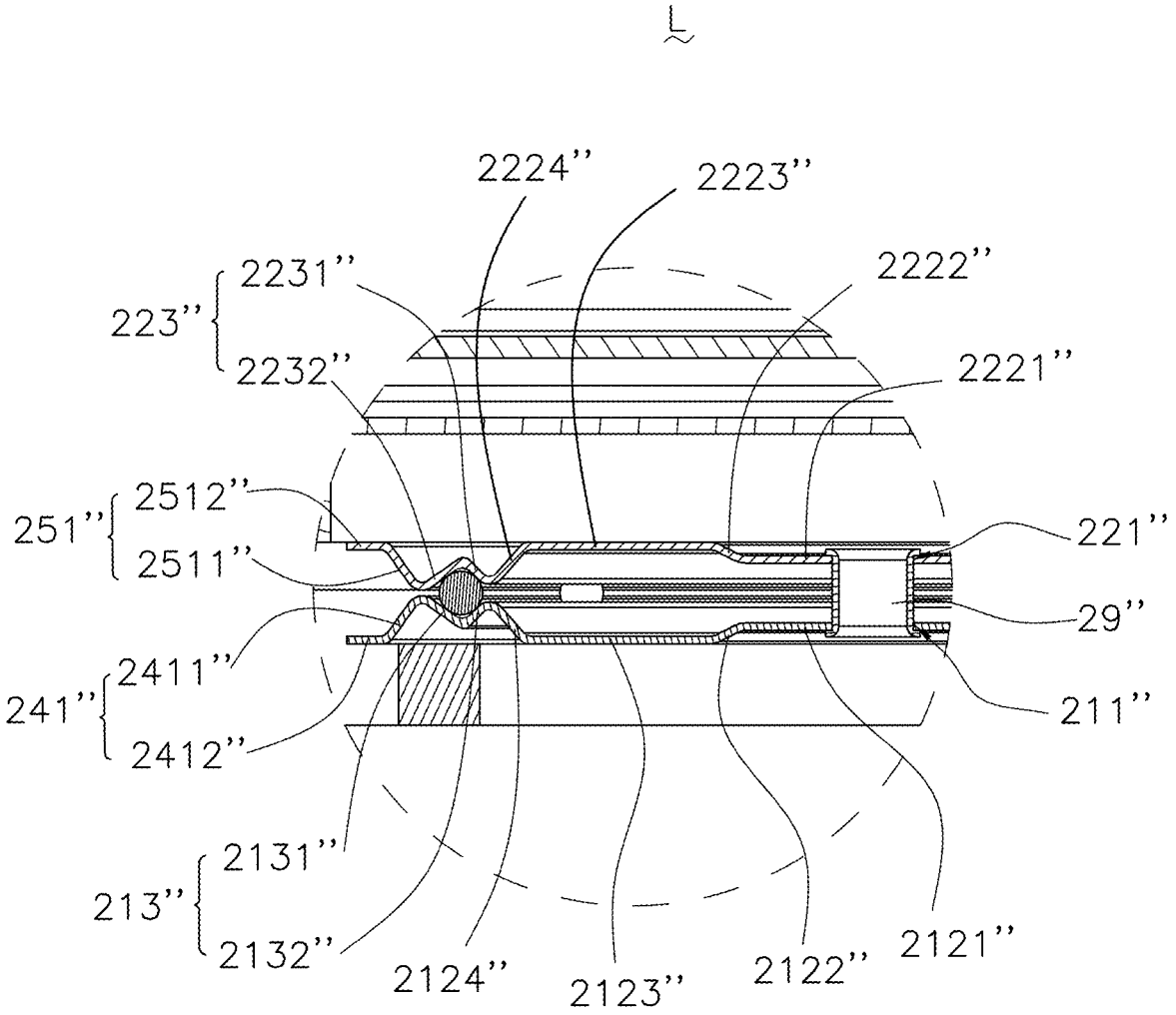
FIG. 55 is an enlarged view of Part L in FIG. 54.
Figure 56:
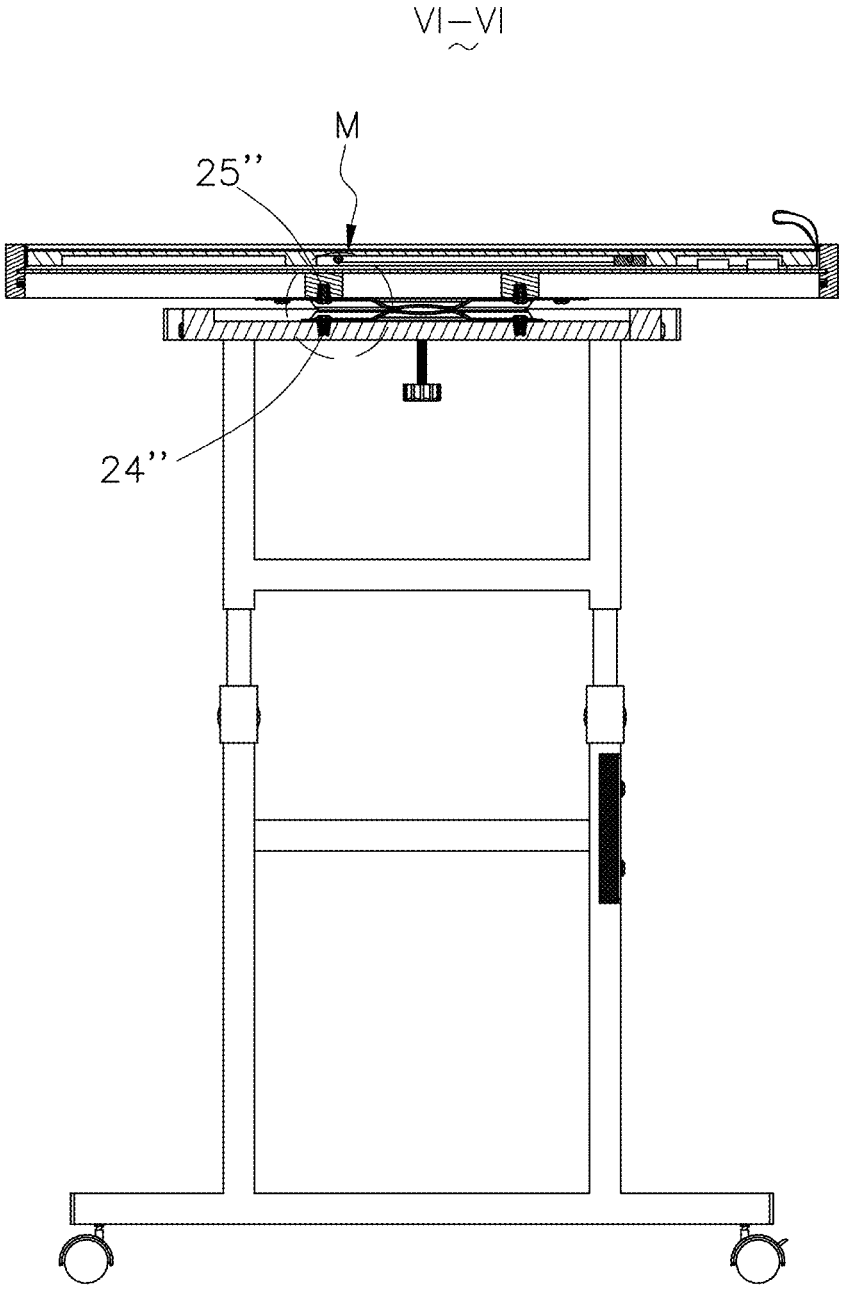
FIG. 56 is an illustrative cross-sectional view of the jigsaw puzzle table taken along line VI-VI of FIG. 50.
Figure 57:
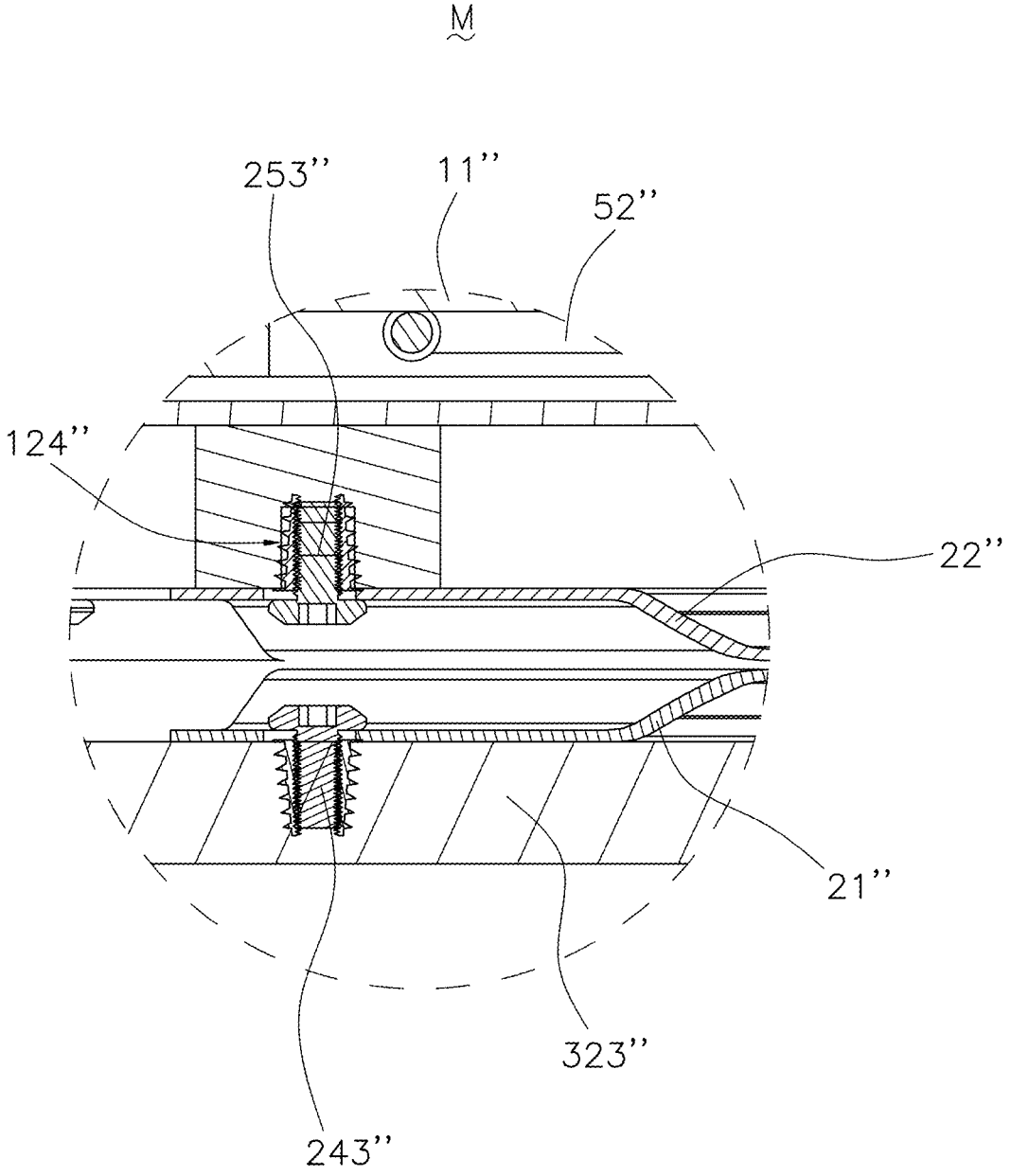
FIG. 57 is an enlarged view of Part M in FIG. 56.
Figure 58:
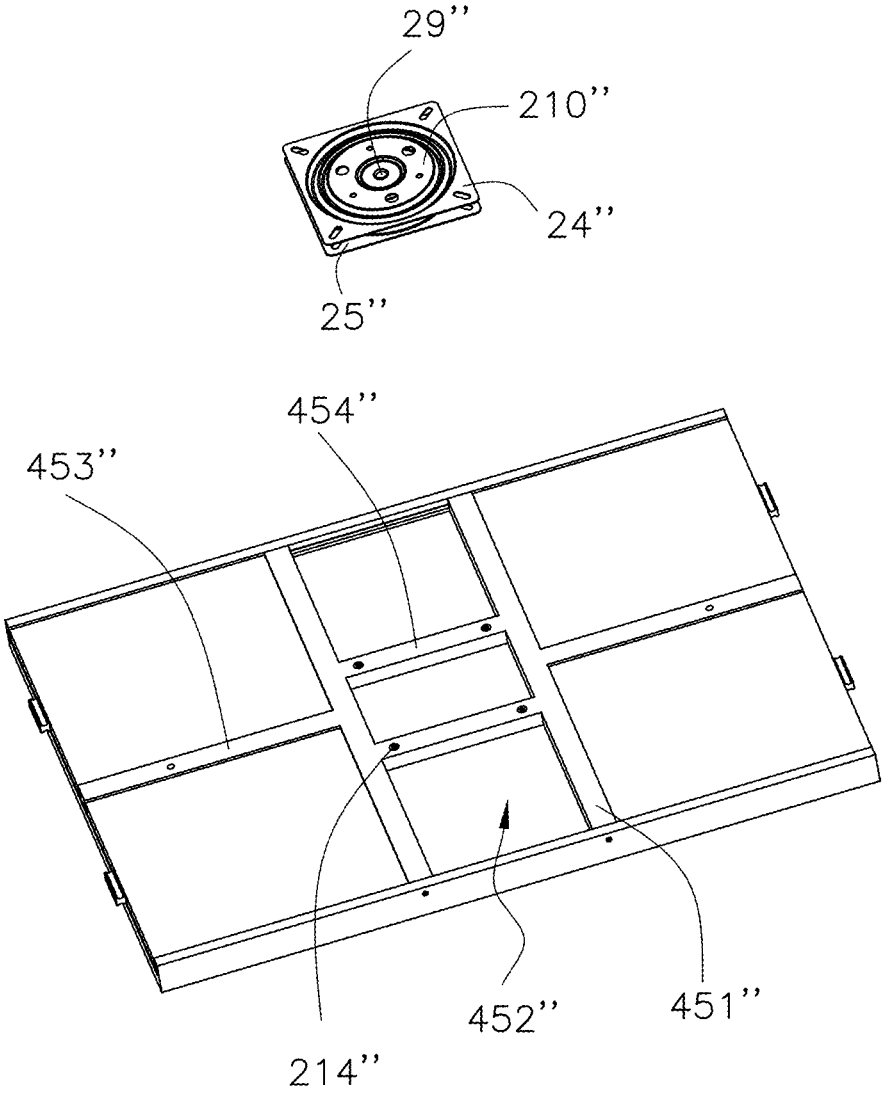
FIG. 58 is an exploded perspective view of a rotating assembly and a puzzle board of the jigsaw puzzle table shown in FIG. 50.
Figure 59:
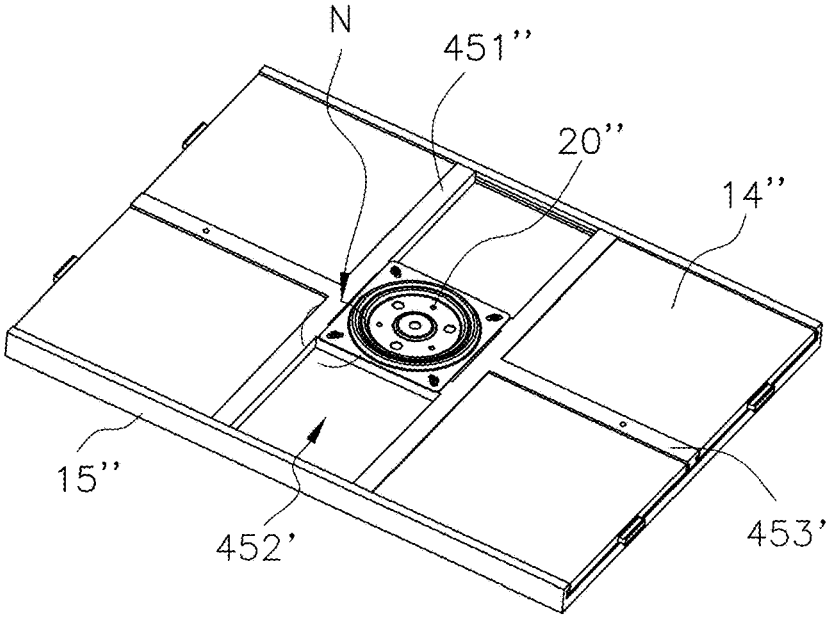
FIG. 59 is an illustrative isometric view of the rotating assembly and the puzzle board of the jigsaw puzzle table shown in FIG. 50.
Figure 60:
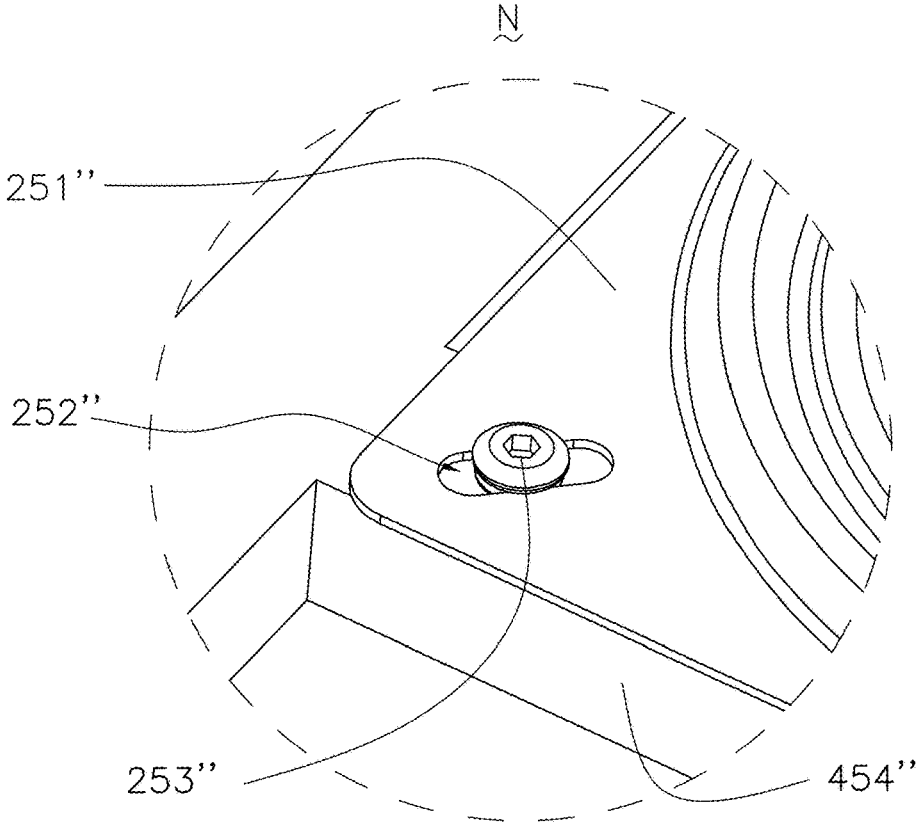
FIG. 60 is an enlarged view of Part N in FIG. 59.
Figure 61:
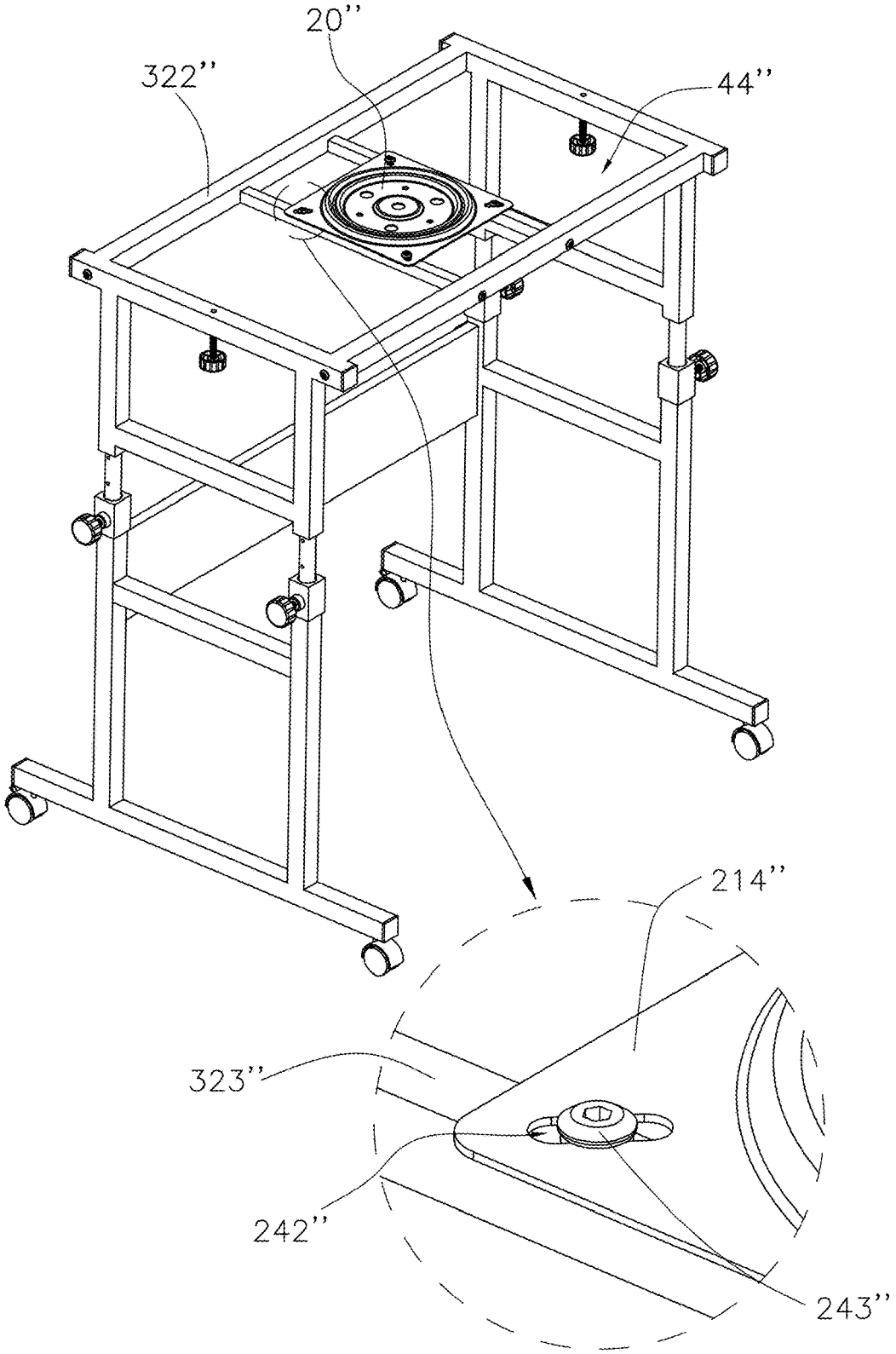
FIG. 61 is an illustrative isometric view of the rotating assembly and a supporting assembly of the jigsaw puzzle table shown in FIG. 50.

As shown in FIGS. 39 and 42-43, when the puzzle board 10' and the supporting assembly 3' are fully assembled, viewing from the bottom of the jigsaw puzzle table 1', the first coupling unit 24' and the second coupling unit 25' are arranged in a staggered formation. The second coupling unit 25' is visible through the supporting portion 43', while the first coupling unit 24' is concealed by the supporting portion 43'. In other words, the projections of the first coupling unit 24' and the second coupling unit 25' do not overlap on the puzzle plate 11'. However, at least part of the first coupling unit 24' does overlap with the fastening arm 323'.

The jigsaw puzzle table 1' can be adjusted to a higher or lower position by modifying the height of the supporting assembly 3'. The puzzle board 10' can be rotated on the supporting assembly 3' through a rotational movement of the rotating assembly 20'. And the tilt angle of the puzzle board 10' of the jigsaw puzzle table 1' can be altered by controlling the adjusting structure 50' while it is in the locked state.

FIGS. 50-70 show a jigsaw puzzle table 1" of a third embodiment of the present disclosure. The jigsaw puzzle table 1" is arranged for a user or player to assemble a plurality of puzzle pieces 100" thereon. Accordingly, the jigsaw puzzle table 1" comprises a puzzle board 10", a rotating assembly 20" attached to the puzzle board 10", and a supporting assembly 3" for adjusting the height of the jigsaw puzzle table 1". The rotating assembly 20" is mounted between the puzzle board 10" and the supporting assembly 3". The puzzle board 10" and the rotating assembly 20" are supported by the supporting assembly 3", respectively. The supporting assembly 3" is capable of adjusting the height of the jigsaw puzzle table 1". The supporting assembly 3" comprises a supporting portion 43" for supporting both the rotating assembly 20" and the puzzle board 10".

The structure of the supporting assembly 3" and the puzzle board 10" in the second embodiment is completely identical to that of the second embodiment. The third embodiment is similar to the second embodiment of the present disclosure except for the structure of the rotating assembly 20". The rotating assembly 20" comprises a first moving member 21" detachably coupled to the supporting portion 43" along a fixing direction B1" and a second moving member 22" detachably coupled to the puzzle board 10" along an assembling direction A1 ". The fixing direction B1" is opposite to the assembling direction A1".

The first moving member 21" comprises a first through hole 211", a first moving frame 212" surrounding the first through hole 211", a first rolling portion 213" extending from the periphery of the first moving frame 212" and surrounding the first moving frame 212", and a first coupling unit 24" extending from the first rolling portion 213" away from the first moving frame 212".

The first coupling unit 24" comprises a first coupling base 241" extending from the periphery of the first rolling portion 213", a first coupling hole 242" drilled completely through the first coupling base 241", and a first coupling portion 243" passed through the first coupling hole 242" and fixed to the supporting portion 43" along the fixing direction B1". The outline of the first coupling base 241" has a rectangular shape. The first coupling hole 242" is formed at the four corners of the first coupling base 241". In this embodiment, the first coupling base 241" is an integral annular structure that completely surrounds the first rolling portion 213". In an alternative embodiment, the number of first coupling bases can be multiple, spaced apart from each other by a certain distance. This design allows for greater flexibility and adaptability, enabling adjustments to the number and layout of coupling bases according to actual needs, thereby optimizing the performance and stability of the rotating assembly.

Referring to FIGS. 54-55 and 66-68, the first moving frame 212" comprises a first inner portion 2121" surrounding the first through hole 211", a first inclination portion 2122" extending downwardly from the periphery of the first inner portion 2121", a first extending portion 2123" extending from the periphery of the first inclination portion 2122" away from the first inner portion 2121", and a first connecting portion 2124" extending upwardly from the periphery of the first extending portion 2123" and connected to the first rolling portion 213". The first coupling base 241" comprises a first extending part 2411" extending downwardly from the periphery of the first rolling portion 213" and a first contacting part 2412" extending from the first extending part 2411" away from the first rolling portion 213". The first coupling hole 242" is drilled completely through the first contacting part 2412". The lower surface of the first rolling portion 213" is taller than an upper surface of the first extending portion 2123". The lower surface of the first rolling portion 213" is substantially level with an upper surface of the first inner portion 2121".

The second moving member 22" comprises a second through hole 221", a second moving frame 222" surrounding the second through hole 221", a second rolling portion 223" extending from the periphery of the second moving frame 222" and surrounding the second moving frame 222", a second coupling unit 25" extending from the second rolling portion 223" away from the second moving frame 222".

The second coupling unit 25" comprises a second coupling base 251" extending from the periphery of the second rolling portion 223", a second coupling hole 252" drilled completely through the second coupling base 251", and a second coupling portion 253" passed through the second coupling hole 252" and fixed to the puzzle board 10" along the assembling direction A1 ". The outline of the second coupling base 251" has a rectangular shape. The second coupling unit 25" is formed at the four corners of the second edge portion 224". In an alternative embodiment, the number of second coupling bases can be multiple, spaced apart from each other by a certain distance.

The second moving frame 222" comprises a second inner portion 2221" surrounding the second through hole 221", a second inclination portion 2222" extending upwardly from the periphery of the second inner portion 2221" away from the second inner portion 2221", a second extending portion 2223" extending from the periphery of the second inclination portion 2222" away from the second inner portion 2221", and a second connecting portion 2224" extending downwardly from the periphery of the second extending portion 2223" and connected to the second rolling portion 223". The second coupling base 251" comprises a second extending part 2511" extending upwardly from the periphery of the second rolling portion 223" and a second contacting part 2512" extending from the second extending part 2511" away from the second rolling portion 223". The second coupling hole 252" is drilled completely through the second contacting part 2512". The upper surface of the second rolling portion 223" is ower than that of the second extending portion 2223". The upper surface of the second rolling portion 223" is substantially level with that of the second inner portion 2221". The rotating assembly 20" further comprises a connecting element 29" and a rotor mechanism 23". The rotor mechanism 23" comprises a retainer unit 231" and a plurality of ball-shaped rotors 232" that are rotatably retained within the retainer unit 231". The retainer unit 231" is configured to spacedly retain the plurality of rotors 232" in a rollable manner, allowing each rotor to freely roll on both the first rolling portion 213" and the second rolling portion 223". The rotor mechanism 23" is rotatably positioned between the first rolling portion 213" and the second rolling portion 223", enabling the first moving member 21" to rotate with respect to the second moving member 22". This configuration allows the puzzle board 10" to rotate smoothly in various planar directions relative to the supporting assembly 3". The connecting element 29" passes through the first and second through holes 211" and 221" to be rotatably connected with the first and second moving members 21" and 22".

The first rolling portion 213" is substantially inverted V-shaped and symmetrically positioned with respect to the second rolling portion 223". Each of the plurality of rotors 232" is free to roll on both the first rolling portion 213" of the first moving member 21" and the second rolling portion 223" of the second moving member 22". The first rolling portion 213" comprises a first engaging part 2131" connected to the first connecting portion 2124" of the first moving frame 212" and a second engaging part 2132" extending from the first engaging part 2131". The extension length of the first engaging part 2131" is less than that of the second engaging part 2132", thereby allowing for better wrapping around the rotors 232". The second rolling portion 223" is substantially V-shaped, comprising a first engaging portion 2231" connected to the second connecting portion 2224" of the second moving frame 222" and a second engaging portion 2232" extending from the first engaging portion 2231". The extension length of the first engaging portion 2231" is less than that of the second engaging portion 2232", thereby facilitating better wrapping around the rotors 232" together with the first rolling portion 213". The distance between the first connecting portion 2124" and the second connecting portion 2224" is larger than that between the second engaging part 2132" and the second engaging portion 2232", facilitating better guidance of the rotors 232" within the motion space formed by the first rolling portion 213" and the second rolling portion 223". In other words, the first rolling portion 213" is spaced apart from the second rolling portion 223". An inner distance of the first rolling portion 213" and the second rolling portion 223" is larger than an outer distance of the first rolling portion 213" and the second rolling portion 223".

The first rolling portion 213" is substantially V-shaped and symmetrically positioned with respect to the second rolling portion 223". Each of the plurality of rotors 232" is free to roll on both the first rolling portion 213" of the first moving member 21" and the second rolling portion 223" of the second moving member 22". The first rolling portion 213" comprises a first engaging part 2132" connected to the first connecting portion 2124" of the first moving frame 212" and a second engaging part 2131" extending from the first engaging part 2131". The extension length of the first engaging part 2132" is less than that of the second engaging part 2131", thereby allowing for better wrapping around the rotors 232". The second rolling portion 223" is substantially inverted V-shaped, comprising a first engaging portion 2231" connected to the second connecting portion 2224" of the second moving frame 222" and a second engaging portion 2232" extending from the first engaging portion 2231". The extension length of the first engaging portion 2231" is less than that of the second engaging portion 2232", thereby facilitating better wrapping around the rotors 232" together with the first rolling portion 213". The distance between the first connecting portion 2124" and the second connecting portion 2224" is larger than that between the second engaging part 2131" and the second engaging portion 2232", facilitating better guidance of the rotors 232" within the motion space formed by the first rolling portion 213" and the second rolling portion 223".

In other words, the first rolling portion 213" is spaced apart from the second rolling portion 223". An inner distance of the first rolling portion 213" and the second rolling portion 223" is larger than an outer distance of the first rolling portion 213" and the second rolling portion 223". The puzzle board 10" includes a puzzle plate 11", a supporting board 15", and an adjusting structure 50". The puzzle plate 11" is hinged to the supporting board 15". The adjusting structure 50" is disposed between the puzzle plate 11" and the supporting board 15". The puzzle plate 11" may be switched, via the adjusting structure 50", between a state in which the puzzle plate 11" is placed flat on the supporting board 15" and a state in which the puzzle plate 11" is tilted at an angle with respect to the supporting board 15".

One end of the puzzle plate 11" is hinged to the supporting board 15", forming a hinge point. The adjusting structure 50" is located below a portion of the puzzle plate 11" that is distant from the hinge point. Specifically, one end of the adjusting structure 50" is hingedly connected to either the puzzle plate 11" or the supporting board 15".

One end of the adjusting structure 50" is hinged to the puzzle plate 11" to hold the puzzle board 10" in an inclined position (a locked state). A carrying handle 54" is mounted on a top surface of the puzzle plate 11". The carrying handle 54" is located at an end of the puzzle plate 11" that is distant from the hinge point. The adjusting structure 50" comprises a driving unit 52" and a limiting strip 55" with a limiting slot 56". The driving unit 52" of the adjusting structure 50" is adapted to fit into the limiting slot 56". When in use, the carrying handle 54" is held by the user's hand, and the puzzle plate 11" is pulled upward from the supporting board 15". Subsequently, the adjusting structure 50" at the bottom of the puzzle plate 11" may swing at a certain angle to enable an end portion thereof to be received in the limiting slot 56". In this way, the puzzle plate 11" is tilted at a certain angle, allowing the user to play with the puzzle pieces 100". The adjusting structure 50" is placed on the supporting board 15" to abut against the bottom surface of the puzzle plate 11", such that the puzzle plate 11" is inclined with respect to the supporting board 15".

The puzzle board 10" further comprises a reinforcing arm 45" connected to the supporting board 15" for forming at least one drawer cavity 13" and at least one puzzle drawer 14" received in the corresponding drawer cavity 13". The reinforcing arm 45" comprises a pair of inner reinforcing portions 451" spaced apart from each other for forming an inner receiving space 452", a pair of dividing reinforcing portions 453" connected to the corresponding inner reinforcing portion 451" and extending away from the inner reinforcing portion 451', and a pair of contacting arms 454" received in the inner receiving space 452" and connected with the inner reinforcing portions 451" for fixing with the second coupling unit 25". The reinforcing arm 45" comprises at least one fixing hole 124" formed on the inner contacting arms 454" and coupled with the second coupling unit 25".

The supporting assembly 3" comprises a board bracket 6" and a foot structure 7" connected to the board bracket 6". The board bracket 6" comprises a supporting portion 43", an upper bracket 62" connected to the supporting portion 43", a lower bracket 63" positioned below the upper bracket 62", and an adjusting bracket 64" connecting the upper and lower brackets 62" and 63". The rotating assembly 20" is detachably coupled to both the puzzle board 10" and the supporting portion 43" of the supporting assembly 3". The adjusting bracket 64" has a plurality of position locating parts 641" for quickly adjusting the overall height of the jigsaw puzzle table 1". At least part of the rotating assembly 20" is exposed through the supporting portion 43". The supporting portion 43" comprises a main frame 322" and a fastening arm 323" connected to the main frame 322" for enhancing the strength of the main frame 322". The main frame 322" has a closed annular shape. In an alternative embodiment, the main frame 322" can have a semi-enclosed structure or it can be omitted. The upper bracket 62" is directly connected to the fastening arm 323". A part of the rotating assembly 20" extends outside the outline of the fastening arm 323" of the supporting portion 43", indicating that part of the rotating assembly 20" is exposed beyond the fastening arm 323" of the supporting portion 43".

The installation method for the jigsaw puzzle table 1" is as follows: First, assemble the rotating assembly 20" with the supporting assembly 3". Specifically, position the upper surface of the supporting portion 43" facing the assembler. Observe the positioning of the connecting holes 46" of the supporting portion 43", and then place the rotating assembly 20" on the fastening arm 323" of the supporting portion 43" so that the first coupling hole 242" of the rotating assembly 20" aligns with the connecting holes 46" of the supporting portion 43". Finally, insert the first coupling portion 243" into the first coupling hole 242" and the connecting holes 46" to secure the rotating assembly 20" to the supporting portion 43" along the fixing direction B1", thus forming a combination of the rotating assembly 20" and the supporting portion 43".

Next, manually rotate the second moving member 22" to adjust the set position of the second coupling hole 252" so that the assembler can observe that the second coupling hole 252" is exposed from the fastening arm 323" of the supporting portion 43". When manually rotating the second moving member 22", the first moving member 21" remains fixed relative to the fastening arm 323" and does not rotate; thus, the second moving member 22" will rotate relative to the first moving member 21". If the assembler can already see the second coupling hole 252" exposed from the fastening arm 323" after completing the previous step, this step may not be necessary.

Finally, assemble the combined structure of the rotating assembly 20" and the puzzle board 10". Specifically, position the puzzle board 10" facing away from the assembler. Adjust the relative positions of the first coupling unit 24" and the second coupling unit 25" so that the first coupling unit 24" is staggered with respect to the second coupling unit 25", allowing the second coupling hole 252" of the second coupling unit 25" to be visible from the first moving member 21", facilitating observation by the assembler. Ensure the alignment of the fixing hole 124", and confirm that the second coupling hole 252" aligns with the fixing hole 124" by checking that the second coupling hole 252" is exposed from the fastening arm 323" along the assembling direction A1". Finally, insert the second coupling portion 253" into the second coupling hole 252" and the fixing hole 124" along the assembling direction A1" to secure the rotating assembly 20" onto the puzzle board 10".

In this embodiment, the fixing direction B1" is opposite to the assembling direction A1". In an alternative embodiment, a fixing direction B1" is similar to the assembling direction A1". Referring to FIG. 67-70, the first coupling unit 24" further comprises a fixing part 244" fixed to the first coupling portion 243" to cooperate with the first coupling portion 243" in securing the rotating assembly 20" to the supporting assembly 3". The connecting holes 46" are fully drilled in the fastening arm 323" of the supporting portion 43". The first coupling portion 243" first passes through the connecting holes 46" at the bottom of the fastening arm 323", and then protrudes from the connecting holes 46" to be fixed to the fixing part 244". During the process of fixing the first coupling portion 243" to the fixing part 244", if necessary, the assembler needs to secure the position of the fixing part 244" to prevent it from detaching from the first coupling base 241". The assembler may first install the rotating assembly 20" and the puzzle board 10" together, and then assemble the rotating assembly 20" with the supporting assembly 3". Conversely, the assembler may first assemble the rotating assembly 20" with the supporting assembly 3", and then install the rotating assembly 20" and the puzzle board 10" together.

Figure 62:
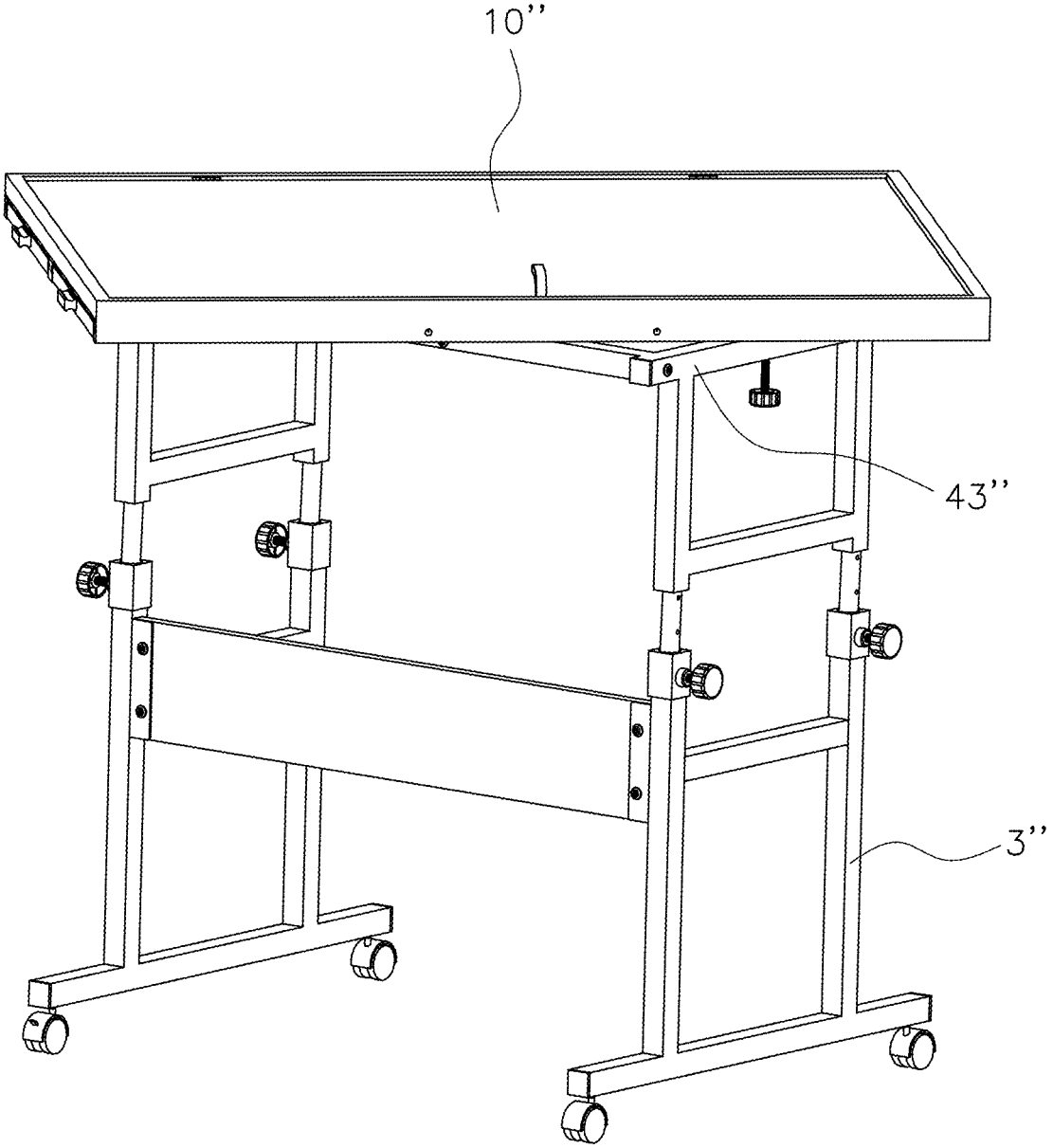
FIG. 62 is an illustrative isometric view of the assembly process for the rotating assembly and the puzzle board of the jigsaw puzzle table shown in FIG. 50.
Figure 63:
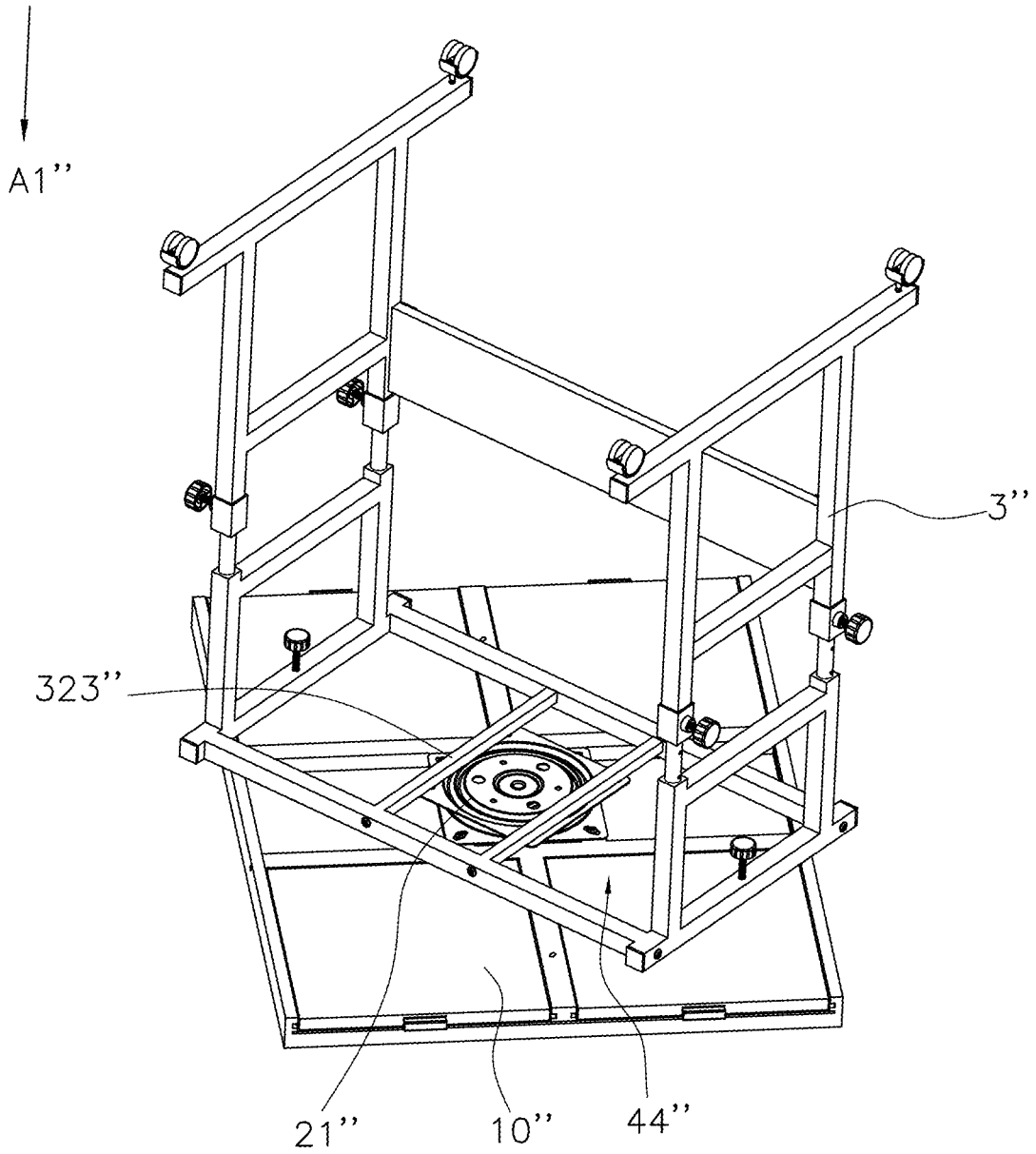
FIG. 63 is similar to FIG. 62, but from another aspect.
Figure 64:
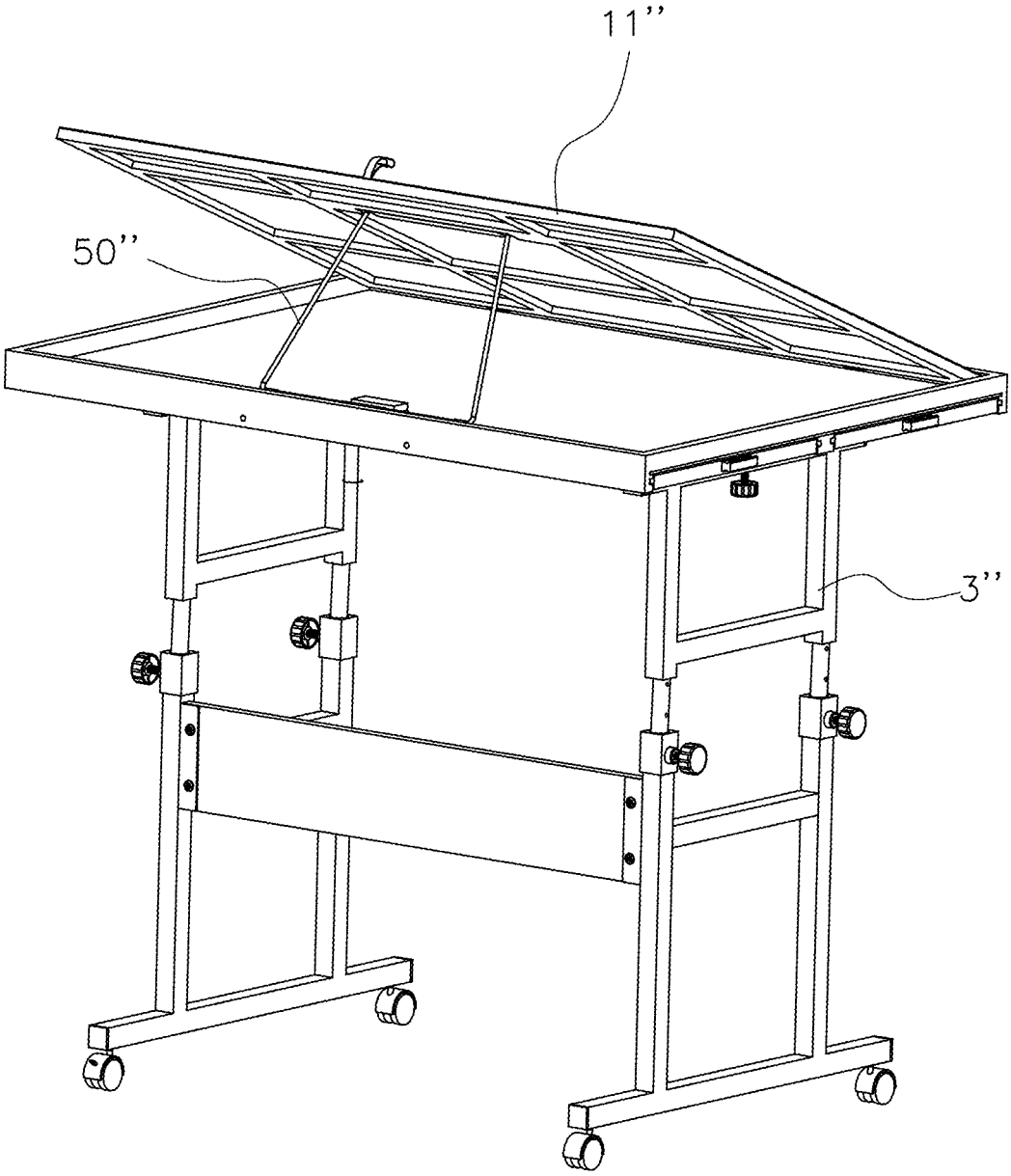
FIG. 64 is an illustrative isometric view of the jigsaw puzzle table of FIG. 50, illustrating the puzzle board tilted at a certain angle.
Figure 65:
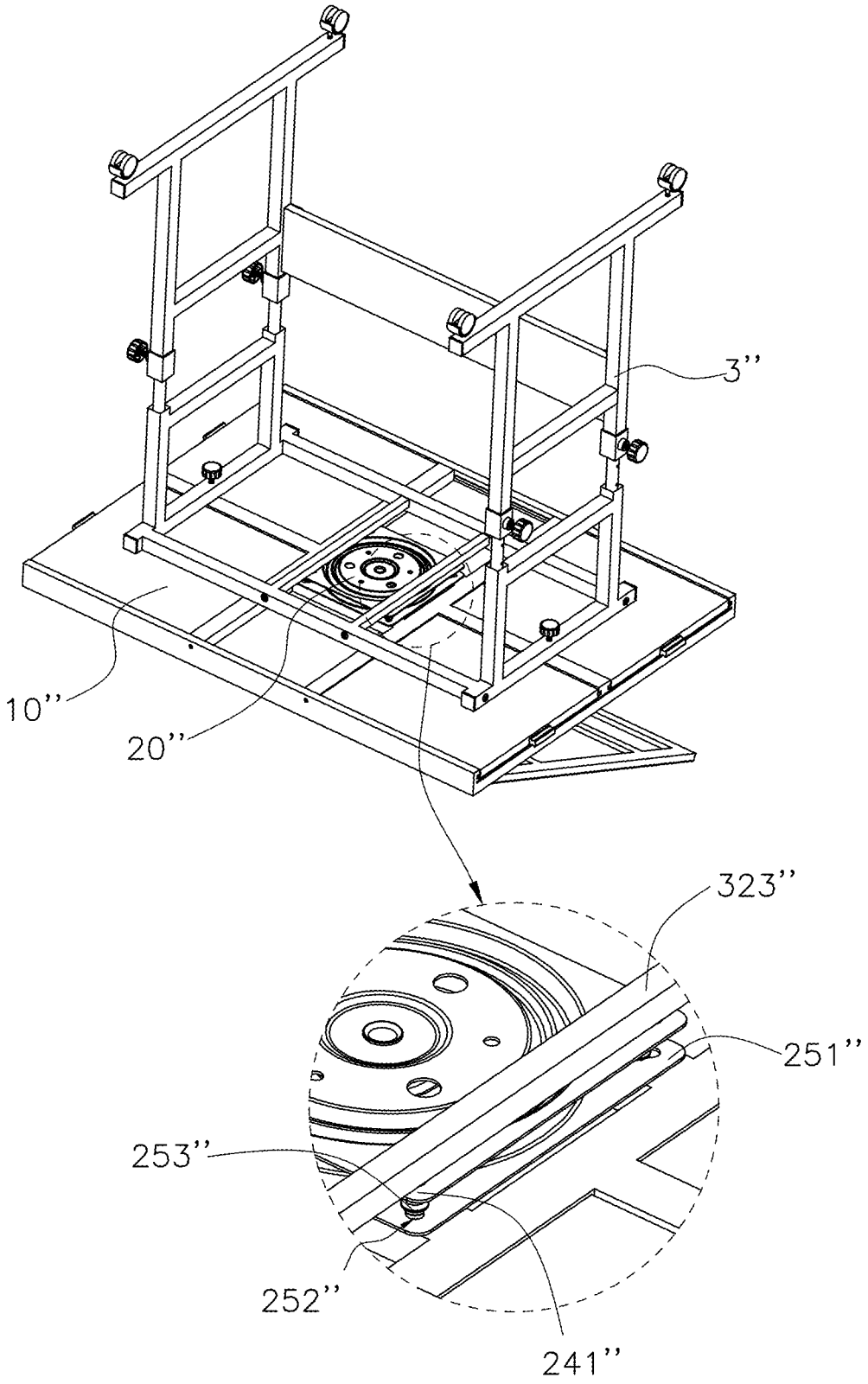
FIG. 65 is similar to FIG. 64, but from another aspect.
Figure 66:
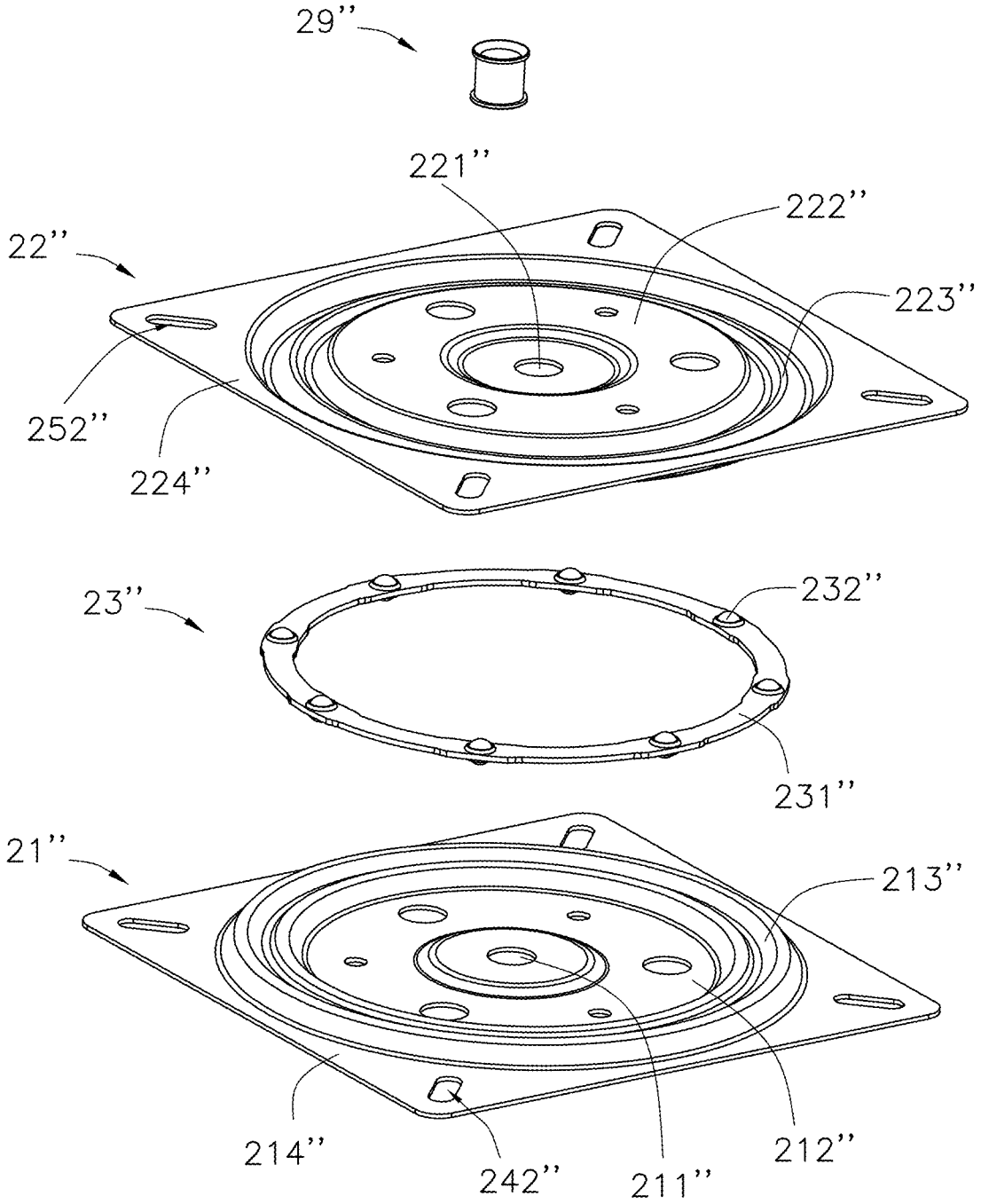
FIG. 66 is an exploded perspective view of the rotating assembly of the jigsaw puzzle table shown in FIG. 50, with a first coupling portion and a second coupling portion being removed.
Figure 67:
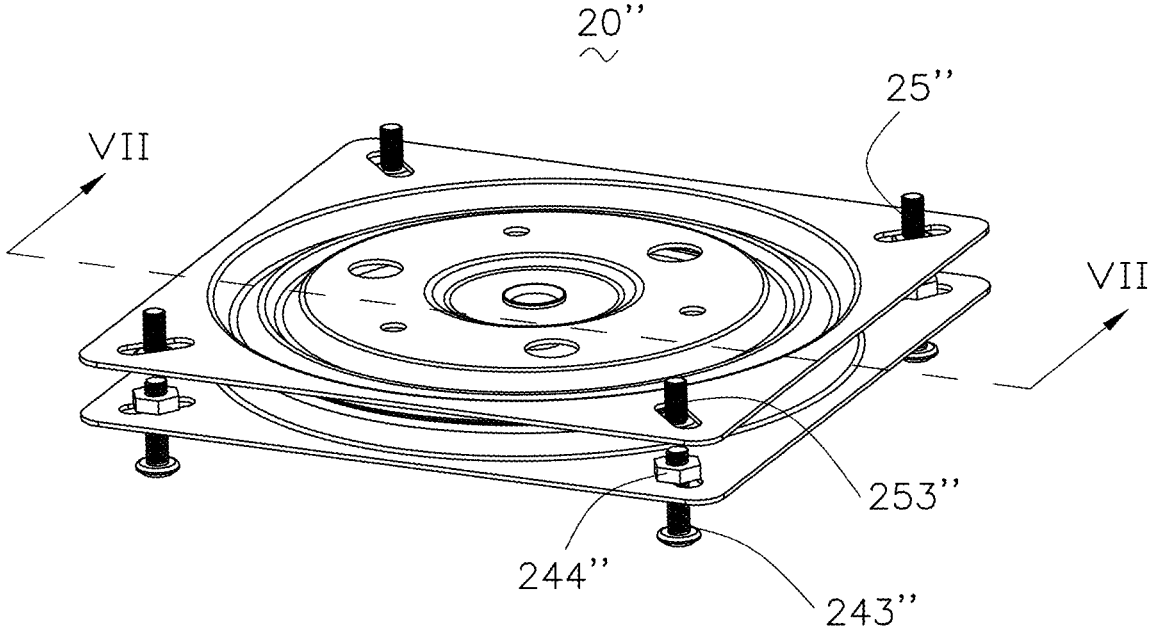
FIG. 67 is an illustrative alternative mode of a rotating assembly of the jigsaw puzzle table shown in FIG. 50.
Figure 68:
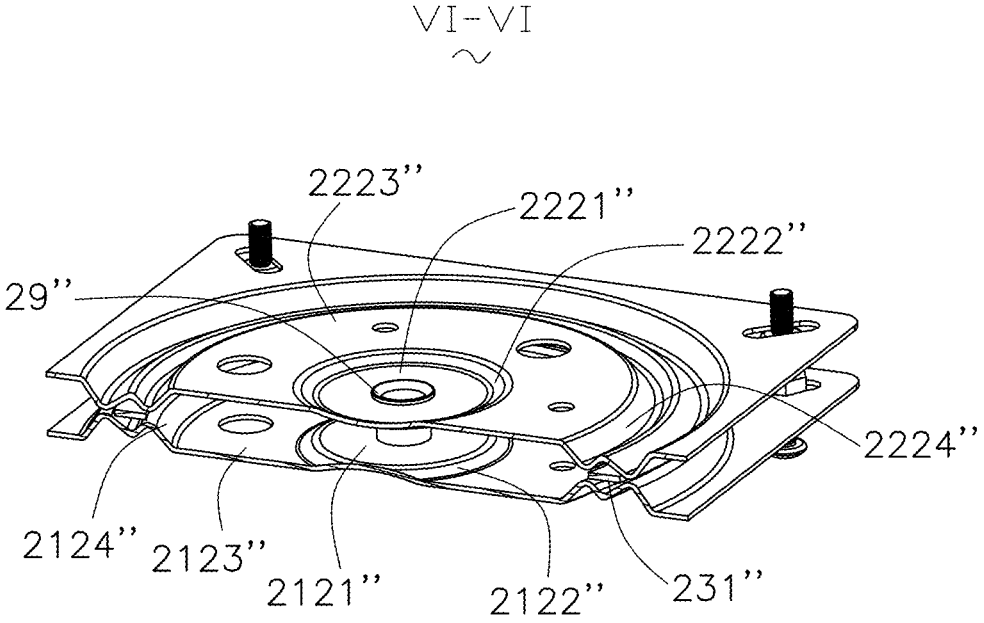
FIG. 68 is an illustrative cross-sectional view of the rotating assembly of the jigsaw puzzle table taken along line VII-VII of FIG. 67.
Figure 69:
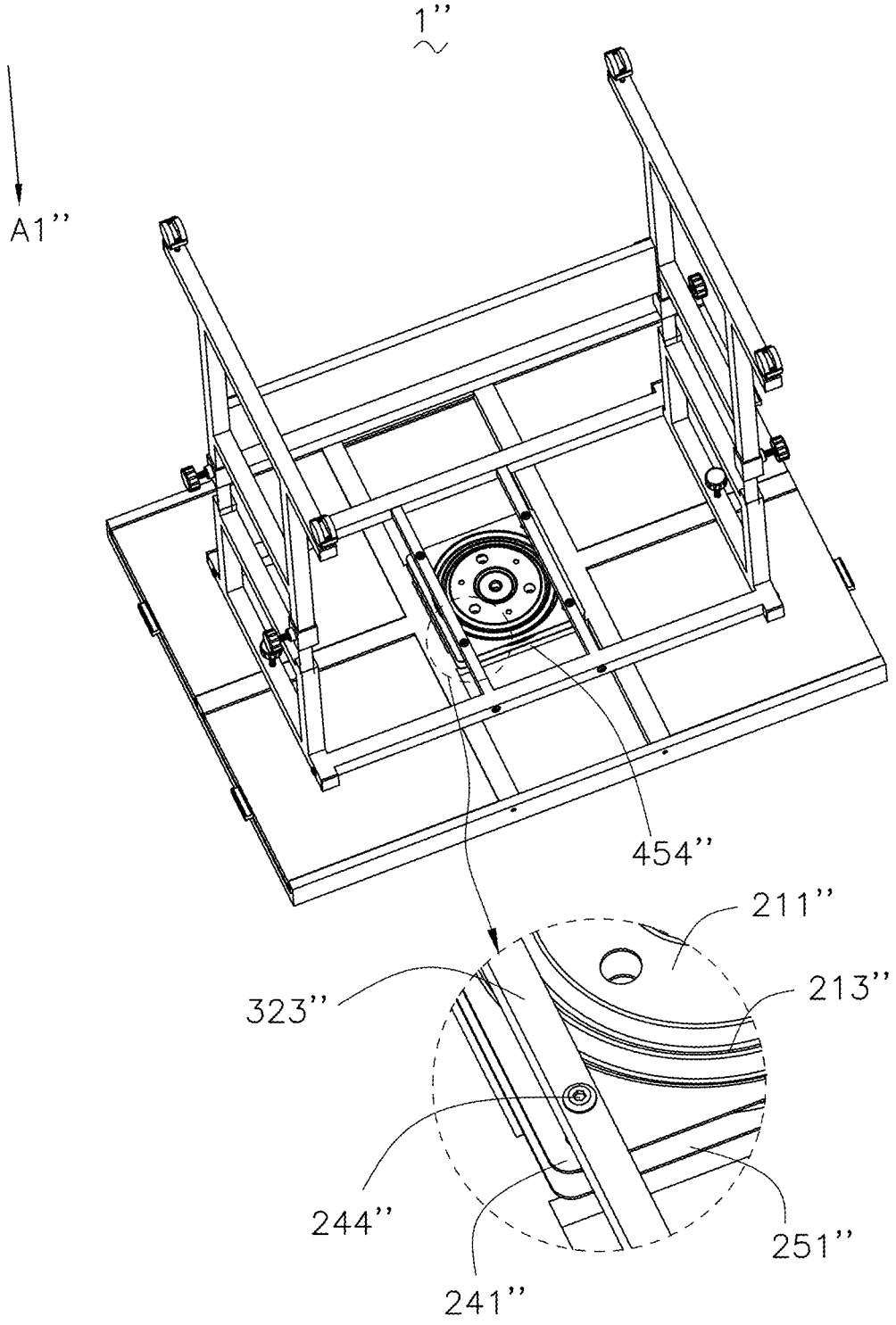
FIG. 69 is an illustrative isometric view of the jigsaw puzzle table of FIG. 50, illustrating the rotating assembly shown in FIG. 68.
Figure 70:
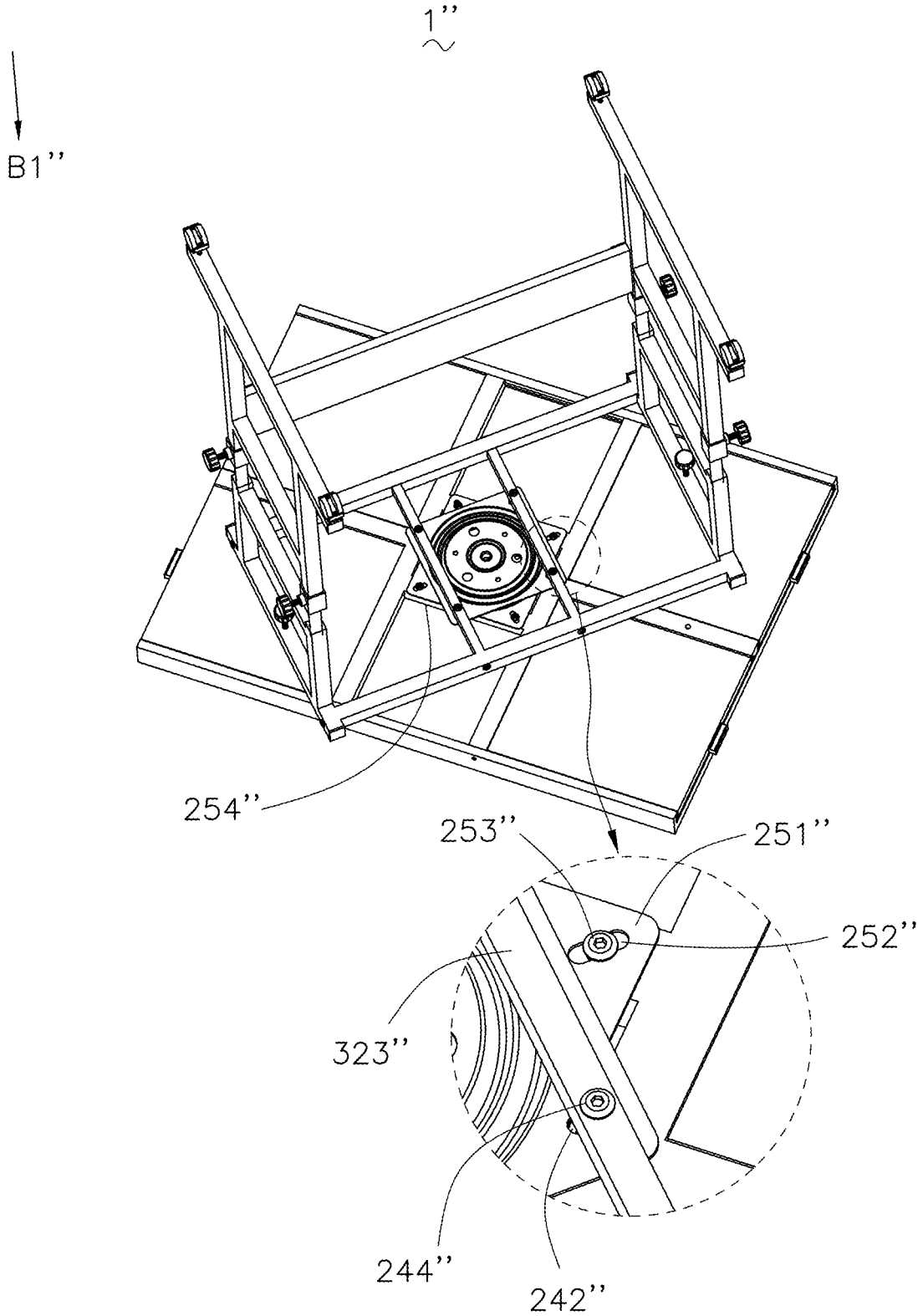
FIG. 70 is similar to FIG. 69, but from another aspect.

Referring to FIGS. 62-63, when assembling the puzzle board 10" and the supporting assembly 3", a viewpoint from below the jigsaw puzzle table 1" shows that the first coupling unit 24" and the second coupling unit 25" are staggered. The second coupling unit 25" is visible from the supporting portion 43", whereas the first coupling unit 24" is covered by the supporting portion 43". In other words, the first coupling unit 24" and the second coupling unit 25" do not overlap in their projection onto the puzzle plate 11". However, at least part of the first coupling unit 24" and the fastening arm 323" overlap in their projection on the puzzle plate 11".

Referring to FIGS. 64-70, when the puzzle board 10" and the supporting assembly 3" are fully assembled, the viewpoint from below the jigsaw puzzle table 1" shows that the first coupling unit 24" and the second coupling unit 25" are substantially aligned. The second coupling unit 25" and the first coupling unit 24" are covered by the fastening arm 323" of the supporting portion 43". In other words, the first coupling hole 242" of the first coupling unit 24", the second coupling hole 252" of the second coupling unit 25", and the reinforcing hole 26" of the fastening arm 323" are substantially overlapping in their projection onto the puzzle plate 11".

The jigsaw puzzle table 1" can be adjusted to a higher or lower position by modifying the height of the supporting assembly 3". The puzzle board 10" can be rotated on the supporting assembly 3" through a rotational movement of the rotating assembly 20". And the tilt angle of the puzzle board 10" of the jigsaw puzzle table 1" can be altered by controlling the adjusting structure 50" while it is in the locked state.

Various technical features of the above-described embodiments can be combined arbitrarily. In order to make the description concise, not all possible combinations of the various technical features are described. However, as long as no contradiction occurs, any combination thereof should be included in the scope of the present disclosure.

The above-described embodiments show only several embodiments of the present disclosure, which are described in a more specific and detailed manner, but shall not be interpreted as a limitation of the scope of the present disclosure. To be noted that, any ordinary skilled person in the art may perform various deformations and improvements without departing from the concept of the present disclosure, all of which shall fall within the scope of the present disclosure. Therefore, the scope of the present disclosure shall be subject to the appended claims.

What is claimed is:

1. A jigsaw puzzle table, comprising:

a board portion configured to be selectively placed in either a flat position or a tilted position, the board portion comprising a bottom surface;

at least two puzzle drawers located below the bottom surface;

a reinforcing arm connected to the bottom surface of the board portion for improving the structural strength of the board portion;

a first pivoting arm connected to the bottom surface of the board portion;

a supporting shaft located below the board portion and separated from the first pivoting arm; and at least one rotating connection component connecting the first pivoting arm and the supporting shaft, the rotating connection component being configured to enable the board portion to switch between the flat position and the tilted position.

2. The jigsaw puzzle table according to claim 1, further comprising a fastening portion fixing the rotating connection component to the first pivoting arm.

3. The jigsaw puzzle table according to claim 2, wherein the rotating connection component is configured as a circular tube.

4. The jigsaw puzzle table according to claim 2, wherein the rotating connection component is a hinge.

5. The jigsaw puzzle table according to claim 1, wherein the at least one rotating connection component comprises at least two rotating connection components fixed to the first pivoting arm in a spaced-apart arrangement, such that a gap is maintained between adjacent rotating connection components.

6. The jigsaw puzzle table according to claim 1, wherein the reinforcing arm comprises a pair of inner reinforcing portions spaced apart from each other to from an inner receiving space, and the first pivoting arm is received in the inner receiving space.

7. The jigsaw puzzle table according to claim 6, wherein no drawer is disposed in the inner receiving space.

8. The jigsaw puzzle table according to claim 6, wherein the board portion has two shorter sides, and the puzzle drawers are configured to slide toward at least one of the shorter sides.

9. The jigsaw puzzle table according to claim 1, wherein the board portion has two shorter sides and two longer sides; the reinforcing arm comprises an inner reinforcing portion extending between the two longer sides of the board portion, and a dividing reinforcing portion connected to the inner reinforcing portion and extending toward one of the shorter sides; wherein the first pivoting arm and the dividing reinforcing portion are positioned on opposite sides of the inner reinforcing portion.

10. The jigsaw puzzle table according to claim 9, wherein the dividing reinforcing portion is substantially parallel to the first pivoting arm.

11. The jigsaw puzzle table according to claim 1, wherein the board portion has two shorter sides opposite to each other, and the reinforcing arm comprises a pair of inner reinforcing portions spaced apart from each other and a pair of dividing reinforcing portions, each dividing reinforcing portion being connected to a respective inner reinforcing portion and extending toward a corresponding shorter side.

12. The jigsaw puzzle table according to claim 1, wherein the board portion comprises a puzzle plate and a rotating assembly supporting the puzzle plate, the rotating assembly being configured to enable the puzzle plate to rotate in different planar directions.

13. A jigsaw puzzle table, comprising:

a board portion configured to be selectively placed in either a flat position or a tilted position, the board portion comprising a bottom surface;

at least two puzzle drawers located below the bottom surface;

a first pivoting arm connected to the bottom surface of the board portion;

a main frame located below the board portion and separated from the first pivoting arm; and an adjusting structure connecting the main frame and the first pivoting arm for adjusting a tilt angle of the board portion;

wherein when the board portion is in the flat position, the adjusting structure is connected to both the main frame and the first pivoting arm;

wherein when the board portion is in the tilted position, the adjusting structure remains connected to the main frame and the first pivoting arm; and wherein a distance between the first pivoting arm and the main frame increases when the board portion is tilted compared to when the board portion is flat.

14. The jigsaw puzzle table according to claim 13, wherein the first pivoting arm is substantially parallel to the main frame.

15. The jigsaw puzzle table according to claim 13, further comprising a second pivoting arm connected to the bottom surface of the board portion, a supporting shaft located below the board portion and spaced apart from the second pivoting arm, and a rotating connection component connecting the first pivoting arm and the supporting shaft, the rotating connection component being configured to enable the board portion to switch between the flat position and the tilted position.

16. The jigsaw puzzle table according to claim 15, wherein the board portion has two shorter sides, and the first pivoting arm is substantially parallel to the second pivoting arm and extends toward the two shorter sides.

17. The jigsaw puzzle table according to claim 13, wherein the board portion has two shorter sides, and the puzzle drawers are configured to slide toward at least one of the shorter sides.

18. A rotating assembly comprising:

a first moving member comprising a first moving frame, a first rolling portion extending from the periphery of the first moving frame, and a first coupling unit extending from the first rolling portion away from the first moving frame;

a second moving member comprising a second moving frame, a second rolling portion extending from the periphery of the second moving frame, and a second coupling unit extending from the second rolling portion away from the second moving frame; and a plurality of rotors rotatably mounted between the first rolling portion of the first moving member and the second rolling portion of the second moving member;

wherein the first rolling portion is symmetrically positioned with respect to the second rolling portion, and each of the plurality of rotors is free to roll on both the first rolling portion of the first moving member and the second rolling portion of the second moving member; and wherein the first moving frame comprises a first inner portion, a first inclination portion extending at an angle from the periphery of the first inner portion, and a first extending portion extending from the periphery of the first inclination portion away from the first inner portion, the first inner portion being substantially parallel to the first extending portion.

19. The rotating assembly according to claim 18, wherein the second moving frame comprises a second inner portion, a second inclination portion extending at an angle from the periphery of the second inner portion away from the first inclination portion, and a second extending portion extending from the periphery of the second inclination portion away from the second inner portion and substantially parallel to the first extending portion.

* * * * *